US011558685B2

(12) United States Patent
Cherry

(10) Patent No.: US 11,558,685 B2
(45) Date of Patent: Jan. 17, 2023

(54) EARPHONE CORD CONTAINMENT ADAPTOR AND HOLDER

(71) Applicant: Untangled Sound LLC, Memphis, TN (US)

(72) Inventor: Ernest Chrispino Cherry, Memphis, TN (US)

( * ) Notice: Subject to any disclaimer, the term of this patent is extended or adjusted under 35 U.S.C. 154(b) by 0 days.

(21) Appl. No.: 17/688,882

(22) Filed: Mar. 7, 2022

(65) Prior Publication Data

US 2022/0191610 A1 Jun. 16, 2022

Related U.S. Application Data

(63) Continuation of application No. 17/023,105, filed on Sep. 16, 2020, now Pat. No. 11,277,680.

(60) Provisional application No. 63/026,115, filed on May 17, 2020, provisional application No. 62/916,784, filed on Oct. 17, 2019, provisional application No. 62/902,880, filed on Sep. 19, 2019.

(51) Int. Cl.

| | |
|---|---|
| ***H04R 25/00*** | (2006.01) |
| ***H04R 1/10*** | (2006.01) |
| ***B65H 75/10*** | (2006.01) |

(52) U.S. Cl.

CPC ..... *H04R 1/1033* (2013.01); *B65H 75/10* (2013.01); *B65H 2701/34* (2013.01)

(58) Field of Classification Search

CPC ..... B65H 75/06; B65H 75/26; B65H 75/28; B65H 2701/3919; H04R 1/1033; H04R 1/1016

See application file for complete search history.

(56) References Cited

U.S. PATENT DOCUMENTS 10,979,797 B2 * 4/2021 Putnam, Jr. ..... H04R 1/1016
2008/0245919 A1 * 10/2008 Peng ..... H02G 11/02 242/407

* cited by examiner

*Primary Examiner* — Amir H Etesam

(57) ABSTRACT

A cord containment adaptor can be adaptively anchored or fixed to or removed from an earphone cord of a set of earphones by hand via an anchor slot of the adaptor. The anchor slot can have a frame or structure that may have multiple earphone cord entrapment chambers and/or an offset or non-linear path leading to an earphone cord entrapment chamber or chambers to help anchor the cord containment adaptor on the cord segment to prevent inadvertent dislodgement of the cord containment adaptor from the earphones. The structure of the anchor slot can be rigid and serves to firmly grip or compress earphone cord segments positioned between gapped-apart opposing sidewalls within the anchor slot. Entrapment chambers of the anchor slot are connected to every other entrapment chamber via cord passageways through which an earphone cord segment can pass. The cord containment adaptor may contain cord containment slots separate from the anchor slot. When a cord containment adaptor is anchored via the anchor slot, earphone cord segments can be gripped into slots in a manner that contains loose cord ends and helps prevent tangling of earphone cords when the earphones are stored or not in use. The adaptor can remain fixed to an earphone cord segment during audio listening by a user and during storage of an earphone set.

18 Claims, 23 Drawing Sheets

EARPHONE CORD CONTAINMENT ADAPTOR AND HOLDER

PRIORITY APPLICATIONS

The present application hereby claims the benefit of priority to related: (1) U.S. Provisional Patent Application No. 62/902,880 entitled "Earphone Cord Containment Adaptor and Attachment Systems"; (2) U.S. Provisional Patent Application No. 62/916,784 entitled "Earphone Cord Containment Adaptor and Attachment Systems"; and (3) U.S. Provisional Patent Application No. 63/026,115 entitled "Earphone Cord Containment Adaptor and Devices" and related parent U.S. Non-Provisional patent application Ser. No. 17/023,105. The present non-provisional application is related in subject matter to U.S. Non-Provisional patent application Ser. No. 17/591,596 which also claims the benefit of the above-referenced provisional applications.

FIELD OF THE DISCLOSURE

The present disclosure generally relates to systems, apparatus and methods in the field of earphone and earphone cord storage and management.

BACKGROUND

In various environments, lightweight earphones are used to listen to audio from small portable communication devices, such as mobile telephones, tablet computers, and digital music players.

In many environments, a problem encountered with earphones is the lack of handy or tangle-free storage. Although many earphones with cords can be easily stored in a person's pocket, purse, book bag, gym bag, or hand bag, the cords often become tangled or knotted in these places when the person moves around. Apple Corporation's wired earphones with an earphone jack have an integrated small slider on the cord segment containing one of the earbuds to which the other earpiece cord segment can be attached, this slider fails to solve the problem of earphone cord tangling when the earphones are stored. Some corded wireless earbuds that are tethered by a cord between earbuds have a slider that is coupled to the cord between earbuds for adjusting the length of the loop that dangles between the earbuds. Similarly, this slider does not solve the earphone cord tangling problem for traditional wired earphones and does not provide a convenient storage solution.

Prior solutions for storing earphone cords are typically variations of spools or spindles around which earphone cords are wrapped, a strap or tie that wraps around earphone cords, or a clamp that clamps an earphone cord. Some of these solutions can be bulky and/or they require a place for storage when the earphones are being used to listen to audio, which may be problematic or not convenient. Consequently, many people do not use earphone holders and instead choose to bear the burden of untangling earphone cords that result from the storage of earphones in pockets or bags. An inconvenience of using some earphone holders is that a person may have to spend more time than desired to wind and/or unwind his or her earphone cords when the earphones are to be stored or used.

Systems or devices are needed that help prevent earphones cords from knotting or tangling when not in use and that address one or more problems or inconveniences of prior solutions.

SUMMARY

In general, various embodiments of earphone cord containment adaptors, discussed herein, help to conveniently store and/or contain earphone cords when earphones are not in use, such as when earphones are stored in pockets or bags. Various embodiments of earphone cord containment adaptors couple securely to an earphone cord segment and can remain on the earphone cord segment while a user is listening to audio and can prevent cord entanglement when the earphones are stored or not in use.

Earphone cord containment adaptors include a shell, frame or structure either of which can have or form a part of an anchor slot that enables the slots of the cord containment adaptor to be fixed, via the anchor slot, in a stationary manner on the cord segment, such as, for example, a cord segment containing the plug of an earphone set. The cord containment adaptor can be adaptively anchored or fixed to or removed from an earphone cord of a set of earphones by hand via the anchor slot. The anchor slot can have a frame or structure that may have multiple earphone cord entrapment chambers and/or an angled or non-linear path to an earphone cord entrapment chamber or chambers to help anchor the cord containment adaptor, via the anchor slot, on the cord segment to prevent inadvertent dislodgement of the cord containment adaptor from the earphones. The open ends of the slots serve as outlets for portions of an earphone cord segment to extend out of the slot. An entrapment chamber, of multiple entrapment chambers of the anchor slot, can serve as an anchor chamber that enables, in some embodiments, an earphone cord to be embedded in an entrapment chamber at a level farther away from the anchor slot entrance than other entrapment chambers that may hold other earphone cord segments. A single anchor slot with multiple entrapment chambers can serve a dual purpose of anchoring the adaptor on an earphone set in one entrapment chamber yet enabling other segments, such as cord segments near earpieces of an earphone set, to be gripped in other entrapment chambers of the anchor slot.

In addition to a cord segment anchored to the adaptor in the anchor slot, earphone cord segments, such as those near the earpieces, in some embodiments, can be securable to the cord containment adaptor via other earphone cord containment slots along various or upstanding walls or sides of the cord containment adaptor. The other earphone cord containment slots may be quick release slots that are structured in a manner that enable a cord segment in the quick release slot to be removed with greater ease than a cord segment secured within or at a distal end of an anchor slot, such as, for example, a cord contained within an entrapment chamber at a distal or terminal end of the anchor slot. When a cord containment adaptor is anchored via the anchor slot, earphone cord segments can be gripped into slots in a manner that contains loose cord ends to help prevent tangling of earphone cords when the earphones are stored or not in use. Various embodiments are constructed with a variety of features that individually and/or collectively help to contain cords, such as for example, by configurations of rigid support structures, entrapment chambers, cord conduits, and/or cord pathways and/or a completely rigid slotted structure that is molded, carved or shaped to grip or compress cord segments between opposing walls that are gapped apart.

It is to be understood that both the foregoing general description and the following detailed description are examples and explanatory and are not restrictive of the invention, as claimed.

BRIEF DESCRIPTION OF THE DRAWINGS

The accompanying drawing figures, which are incorporated in and constitute a part of this specification, illustrate several embodiments according to one or more inventive aspects or principles of invention and together with the description, serve to describe one or more inventive aspects or principles of the invention.

DESCRIPTION OF THE EMBODIMENTS

Figure 1A:
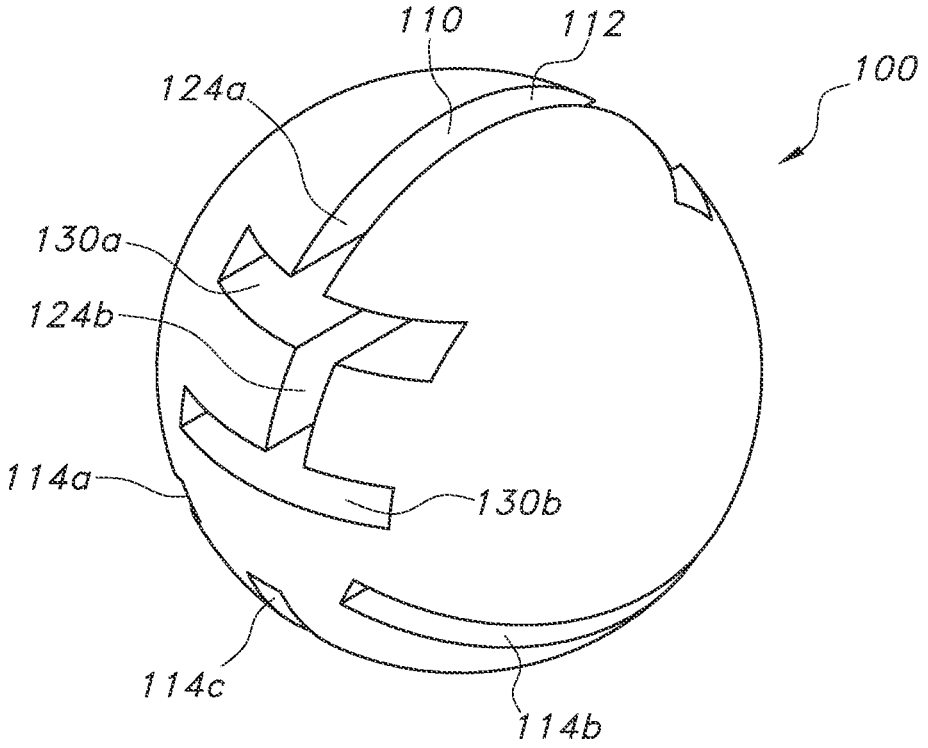
FIGS. 1A, 1B, 1C, 1G, 1H, and 1I are views of a cord containment adaptor in accordance with an embodiment of the invention.

Reference will now be made in detail to example embodiments. Reference numbers are used in the drawings and the description to refer to the same or like parts. Like or similar features or configurations of various embodiments may not be discussed in repetitive detail with respect to each figure or embodiment when the features or configurations would be readily understood from other figures or descriptions of embodiments that have been discussed or illustrated in more detail.

Various embodiments enable cord containment slots to be attached and remain attached, via an anchor slot, on a variety of earphones while the earphones are in use and yet provide an easy-to-use structure that helps prevent cord entanglement when the earphones are stored. Cord containment slots, via the adaptor, may be selectively attachable to and removeable by hand from an earphone cord segment of a set earphones.

Various embodiments of earphone cord containment adaptors couple securely at a selected position on an earphone cord segment of a set of earphones. A cord containment adaptor can remain positioned on an earphone cord segment, such as a segment containing the audio plug of a set of earphones, while the earphones are used for listening to audio. A cord containment adaptor can have various cord containment slots positioned on the outer surface of the adaptor. When a cord containment adaptor is coupled to the cord segment of earphones that contains the male plug of a set of earphones and when the ends of the primary segments of the earphone cords are secured in the slots of the cord containment adaptor, the earphones may be stored in a pocket, purse, or bag with little concern that the earphone cords will become entangled when the earphones are moved or jostled during activities. An anchor slot, as discussed herein, serves to anchor or securely position a cord containment adaptor on a set of earphones. Various embodiments of anchor slot structures, described herein, are advantageous to attaching objects and cord containment adaptors to an earphone cord. Embodiments, with upstanding adaptor walls or surfaces, may remain on an earphone cord that is plugged into a mobile telephone and may rest against or flush on the surface of the telephone in a manner that positions cord containment slots upward away from the telephone surface so that a slot or slots can grip and contain earphone cords that are wrapped around the mobile telephone when the telephone is not in use. Embodiments, features, and combinations are described or are readily apparent or inherent from the described embodiments and examples. It should be appreciated that aspects of different embodiments are structured or operate in a similar manner as other embodiments and may be combined, modified, or interchanged in accordance with the scope and teachings herein.

Figure 1B:
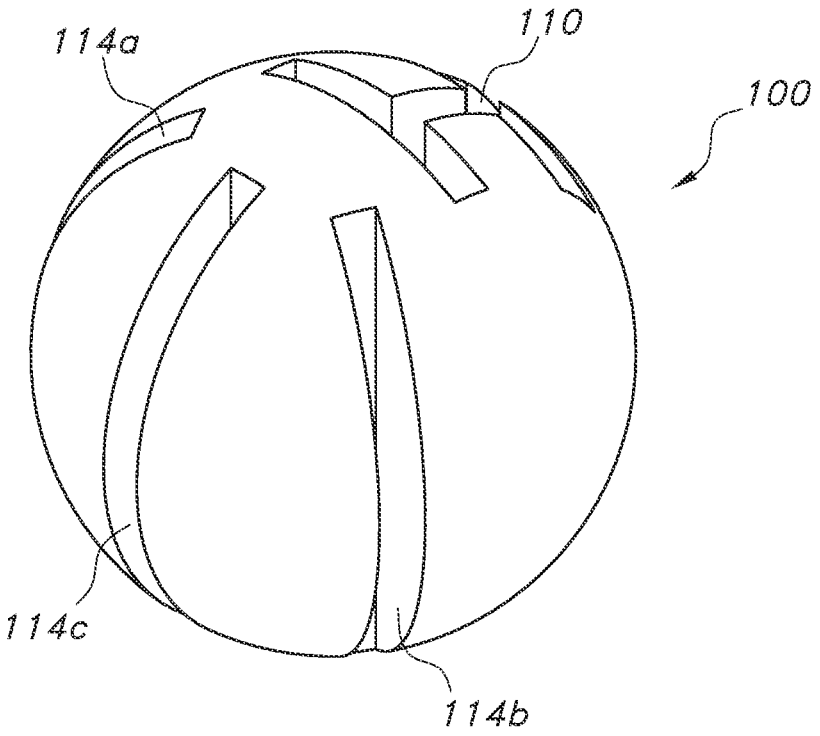
Figure 1C:
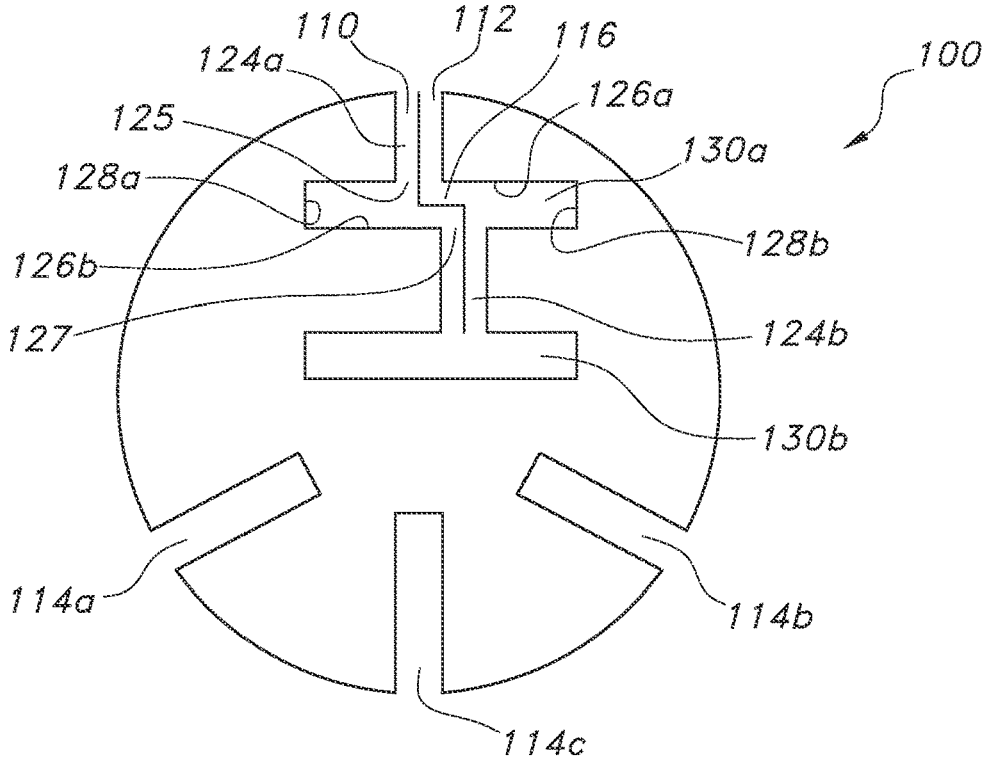

Referring to FIGS. 1A and 1B, perspective views of an embodiment of an earphone cord containment adaptor 100 are illustrated, and referring to FIG. 1C, a front side view of the earphone cord containment adaptor 100 is illustrated. The cord containment adaptor 100 is configured to be attached to a cord segment, such as for example, the end of a cord segment containing the audio jack or plug of a set of earphones and can be used to help prevent earphone cords from tangling when the earphones are stored or not in use. The cord containment adaptor 100 has a set of cord containment slots and each cord containment slot is structured to receive and hold an earphone cord as discussed herein. The cord containment adaptor 100 has an anchor slot 110 for attachment to an earphone cord. The cord containment adaptor 100 is embodied as a sphere or spherical body. The anchor slot 110 enables the slots of the cord containment adaptor 100 to be secured in a stationary manner on cords of an earphone set, such as for example, the earphone set 150 shown in FIG. 1D. An anchor slot may have components, conduits, chambers, walls or surfaces that engage an earphone cord to compress an earphone cord so that the cord containment adaptor 100 is held in a stationary position on the earphone cord. The anchor slot 110 provides an anchor to secure the cord containment adaptor 100 to the segment of the earphone cord, as desired by a user. It should be appreciated that the overall shape or embodiment of the cord containment adaptor may take on various three-dimensional features, shapes, characters, or figures, and embody, for example, flat surfaces, straight surfaces, conical surfaces, cylinders, rectangles, ellipsis, curved surfaces, polyhedrons, ovoids, cubes, cuboids, or various combinations or modifications thereof. A spherical shaped cord containment adaptor is advantageous to a user because the lack of sharp or angular edges can help prevent the adaptor from getting caught on or snagging objects that the cord containment adaptor brushes against or touches inside or outside a person's pocket, backpack, purse, satchel, or bag.

An earphone cord may be fitted or compressed into the anchor slot 110 through the opening defining the anchor slot entrance 112 on the outer surface of the cord containment adaptor 100. The anchor slot entrance 112 is at the top or beginning of the anchor slot 110 and provides the primary entrance or opening through which a lengthwise segment of an earphone cord is inserted or fitted into the anchor slot. The cord containment adaptor 100 also has cord containment slots 114*a*, 114*b*, and 114*c* into which cord segments or free ends of cords of an earphone set can be gripped and contained to help prevent entanglement of the cords when the cord containment adaptor 100 is attached to the earphone set. The cord containment slots 114*a*, 114*b*, and 114*c* are positioned at different spaced apart locations on the surface of the adaptor 100 to aid with positioning and securing earphone cords in a manner to help prevent cord tangling. Each of the slots shown has a first open side and a second open side at the ends of the slot. Each slot illustrated extends and provides a linear opening from one-opened side of the slot to the other open-ended side of the slot. Each slot provides a cord through-passage through which a cord can extend from one open-ended side of the slot to the other open-ended side of the slot. Each of the slots has an entrance extending along the slot and defined between and extending through the first and second open sides of each slot. The entrance provides an opening for the earphone cord to be pressed or pushed between the sidewalls of each slot. The interior walls, sides, or sidewalls of an anchor slot delineate passageways through which an earphone cord can pass. The anchor slot 110 has multiple paths and chambers that are structured in a manner to hold and entrap a selected segment of an earphone cord within the anchor slot 110 so as to anchor the cord containment adaptor 100 on the earphone cord segment, and some slots or chambers are structured to hold and enable the quick release, when desired, of other cord segments that are near the earbuds or earpieces of an earphone set. The combination of both the hand releasable anchor slots and quick release slots for earphone cords in various embodiments herein is advantageous for use and storage of earphones.

Figure 1I:
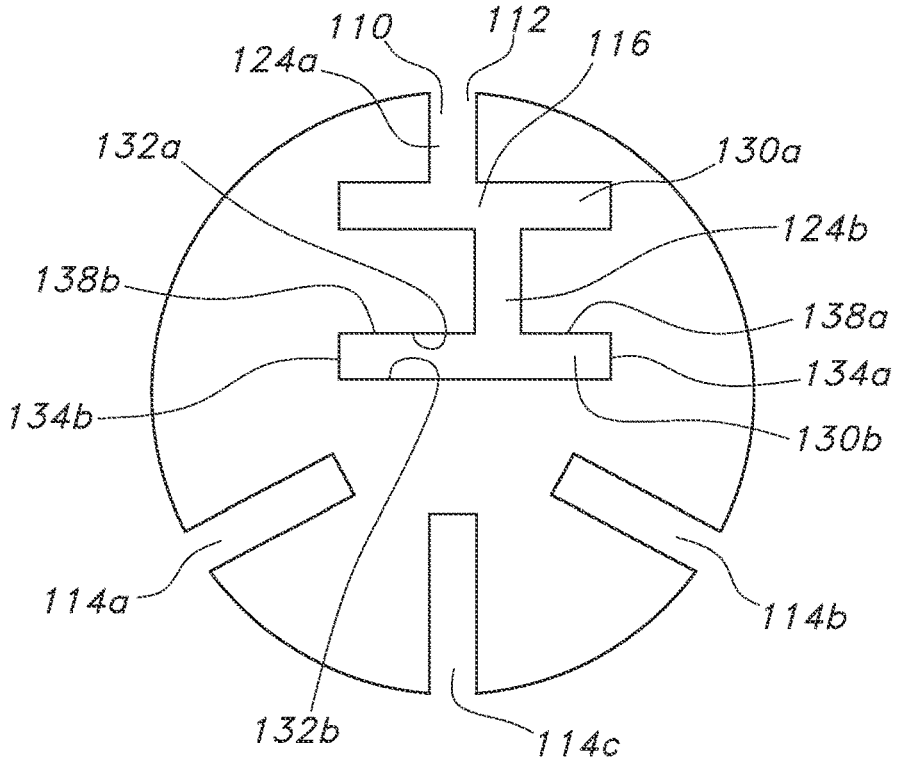
Figure 1D:
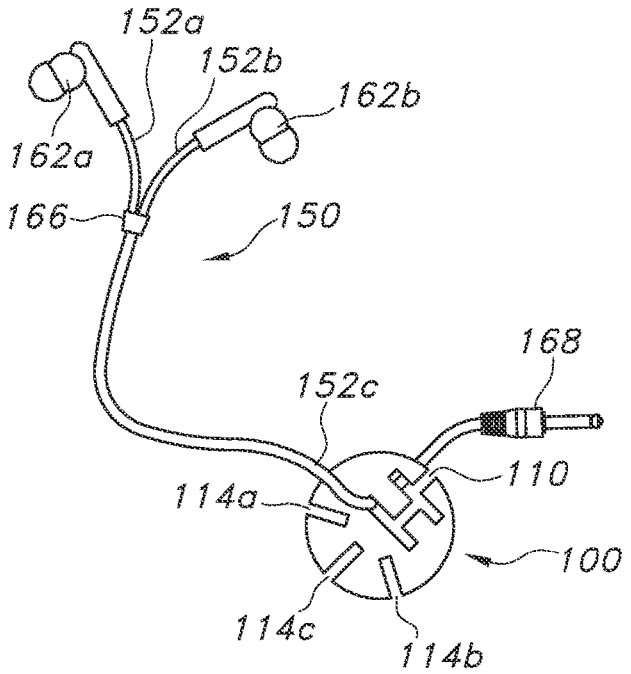
FIGS. 1D, 1E, and 1F are views of earphone cord segments of a set of earphones compressed or contained in various cord containment slots or channels of a cord containment adaptor in accordance with an embodiment of the invention.

Referring to FIG. 1D, the cord containment adaptor 100 is shown fixed in a stationary position on and near the end of the rounded cord segment 152*c* containing the audio plug 168 of a set of earphones 150. The cord segment 152*c* extends entirely through the body of the cord containment adaptor 100 via the through-passages of the anchor slot 110. The through-passages extend between open ends or sides of the anchor slot 110. Through-passages, such as cord conduits and chambers, are discussed in more detail herein. The anchor slot 110 has a first open side and a second open side through which an earphone cord can extend all the way through the anchor slot and cord containment adaptor 100. Earphones 150 have a pair of earpieces 162*a* and 162*b* that deliver audio to a person's ears. The earpieces may be in-ear earpieces, in-ear monitors, earbuds, or the like or any earphones with parts that sit within a person's outer ear. The earpieces 162*a* and 162*b* are attached respectively to an end of each of the rounded earphone cord segments 152*a* and 152*b*, and the other end of each segment 152*a* and 152*b* couple with a segment junction point 166. One end of the earphone cord segment 152*c* is coupled to the segment junction point 166, and the other end of the segment 152*c* extends down to couple with an audio jack or audio input plug 168. For ease of illustration, it should be appreciated that the size of the earphones 150 are not depicted in exact scale with respect to the cord containment adaptor 100.

The anchor slot 110 compresses the cord segment 152*c* within the cord containment adaptor 100 which attaches the cord containment adaptor 100 in a generally fixed stationary position along the length of the cord segment. In this generally stationary position, the cord containment adaptor 100 is both rotationally fixed about the axis of the length of an earphone cord and fixed lengthwise along the length of the earphone cord. In the generally stationary position, the cord containment adaptor 100 is not generally moveable by inadvertent forces along the cord segment and is structured to hinder inadvertent removal from an earphone cord segment. By fixing the cord containment adaptor 100 at a position on the length of the cord segment 152*c* and in a manner that significantly limits or prevents rotation of the cord containment adaptor 100 around the point at which the adaptor is fixed lengthwise on the cord, movement of the cord containment adaptor is minimized and helps prevent cords from tangling when cord segments of the earphones are compressed or secured in the slots as discussed herein.

When the cord containment adaptor 100 is connected at the end of the earphone cord segment containing the male audio plug 168, earphones 150 may still be used to listen to audio of an audio device, such as, for example, a mobile phone, when the cord containment adaptor 100 is attached to the earphones 150. When the cord containment adaptor 100 remains attached to the earphones 150 but is disconnected from an audio player, the cord containment adaptor 100 may be used to contain the cord segments of a set of earphones by holding the cords in cord containment slots 114*a*-114*c*, as discussed in connection with FIGS. 1E and 1F.

Figure 1E:
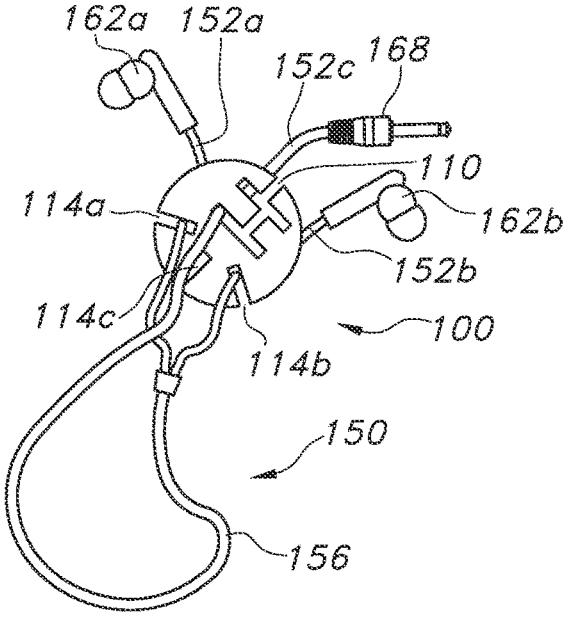

Referring to FIG. 1E, the cord containment adaptor 100 is shown with a section of the earphone cord segment 152*c* being compressed and secured in the anchor slot 110 and cord segments 152*a* and 152*b* being compressed and secured in the through-passages of the cord containment slots 114*a* and 114*b*, respectively. The cord segments 152*a*, 152*b*, and 152*c* are inserted or pressed into the slots by a user. The free terminal end of each cord segment, such as the ends containing earpieces 162*a*, earpiece 162*b*, and plug 168 is coupled in proximity to each other via the cord containment adaptor 100. As shown, the end of each segment that terminates in an audio component, such as an earpiece or audio plug, is coupled at a central location via the cord containment adaptor 100 to form a loop. By coupling the ends of the three cord segments of the earphones 150 in proximity to each other at a central location (e.g. the adaptor casing), the free ends of the earphone segments that terminate in an audio component are not free to jostle and knot or intertwine. Loops are formed between the earphone segments that have their ends connected at or in proximity to the central location of the cord containment adaptor housing. A large loop 156 is formed from the earphone cord containing cord segment 152*c* when the three ends are attached in the adaptor. The cord containment slots should be sized to grip an earphone cord to prevent the earphone cords from easily or readily sliding lengthwise in the slots to maintain the audio components of the earphones at or near the central location. When the ends of each segment of the earphones are coupled in the adaptor, such as within two to three inches of the ends, the cord containment adaptor 100 contains loose ends of cord segments and helps prevent tangling of earphone cords when the earphones are stored or not in use.

Figure 1F:
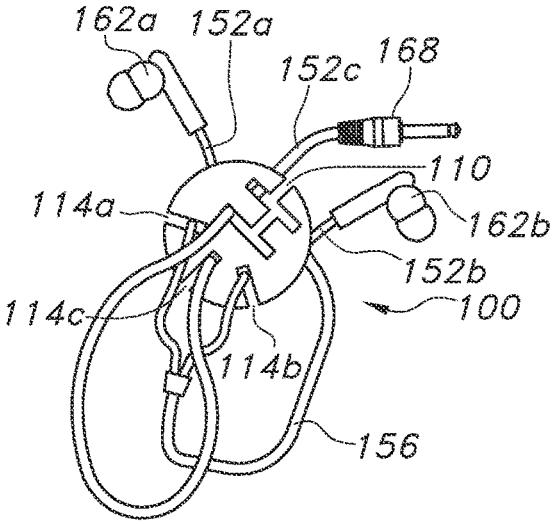

Referring to FIG. 1F, the largest loop 156 formed by the longest segment 152*c* of the earphones 150 is further coupled to the cord containment adaptor 100 by securing a portion of the loop into the cord containment slot 114*c*. This arrangement enables the largest loop 156 formed by the longest segment to be shortened and provides for more compact storage or containment of the loop 156 than when only the ends of the earphone cord segments are joined at the central location of the adaptor 100. The closed loops formed between the cord segments of a set of earphones to help prevent tangling when the earphones are stored. The earphones may be stored in a pocket, purse, or bag with little concern that the earphone cords will become entangled when the earphones are moved or jostled during activities.

Referring again to FIGS. 1A and 1C, the structures or features of anchor slots individually and/or collectively anchor a cord containment adaptor to an earphone cord. Anchor slot cord conduits 124*a* and 124*b* and anchor slot entrapment chambers 130*a* and 130*b* are structured to help retain an earphone cord within the anchor slot 110. A cord conduit provides a cord passageway within an anchor slot to an entrapment chamber or cord conduit or between entrapment chambers as illustrated and discussed herein. FIG. 1C illustrates a side view of one side of the anchor slot 110 and cord containment adaptor 100. The opposite side of the cord containment adaptor 100 and anchor slot 110 is not illustrated for simplicity of the drawings as the features of the opposite side are identical to or the mirror image of the side shown in FIGS. 1A and 1C. The anchor slot 110 has a first open-ended side, as illustrated in FIGS. 1A and 1C, at a first position on one side of the exterior surface of the cord containment adaptor 100, and a second open ended side (not visible in FIGS. 1A and 1C) at a second position on another or opposite surface area on the exterior surface of the cord containment adaptor 100. The anchor slot entrance 112 extends from and through a section or top part of each open-ended side of the anchor slot 110. The first open-ended side of one side of the anchor slot 110 collectively comprises, as illustrated herein, the open ends of one side of the cord conduit 124*a*, cord conduit 124*b*, entrapment chamber 130*a* and entrapment chamber 130*b*, and the second open-ended side of the anchor slot 110 (not visible in FIG. 1C) collectively comprises the open ends of the other side of the cord conduit 124*a*, cord conduit 124*b*, entrapment chamber 130*a* and entrapment chamber 130*b*. The distance between the two open ended exterior sides of a slot can be generally referred to as the length of the slot or length of a segment or component of the slot, such as, for example, a cord conduit, ridge or chamber. Slot lengths greater than or equal to 6 millimeters (mm) can help ensure sufficient resistance within the slot to hold a gripped or compressed earphone cord segment within a slot to help prevent inadvertent movement or dislodgement from the slot.

One feature that may be used to help keep an earphone cord containment adaptor attached to an earphone cord is an offset or a non-linear path, passageway or pathway defined between the anchor slot entrance and an entrapment chamber. As shown in FIG. 1C, a non-linear anchoring pathway 116 of the anchor slot 110 extends from the anchor slot entrance 112 to the entrapment chamber 130*b* of the anchor slot 110. A non-linear anchoring pathway of an anchor slot, as discussed herein, is a cord pathway that begins at and extends away from the anchor slot entrance into the anchor slot and terminates at the terminal end of the pathway at the intersection point with a cord entrapment chamber, cord conduit, or another cord pathway of the anchor slot and that becomes non-linear along a section or sections of the pathway between the anchor slot entrance and the terminal end of the cord pathway. For example, in FIG. 1C, the non-linear anchoring pathway 116 begins at the anchor slot entrance 112 as a straight line path through cord conduit 124*a* and becomes non-linear in the vertical or depth-wise orientation of the anchor slot 110 as the pathway turns into the earphone cord entrapment chamber 130*a* and again turns back into the cord conduit 124*b* before the pathway terminates at the opening into the earphone entrapment chamber 130*b*. The non-linear anchoring pathway 116 has two angular turns or changes in direction in the single pathway leading from the anchor slot entrance to the entrapment chamber 130*b*. Although two turns or changes in direction are illustrated in the non-linear anchoring pathway 116, an anchoring type non-linear pathway has at least one change of direction of the pathway as the pathway extends away from the anchor slot entrance to the pathway's termination at the entrance of a particular entrapment chamber. The non-linear anchoring pathway 116, shown as a line in FIG. 1C, from the anchor slot entrance 112 to the entrapment chamber 130*b* can be seen in FIGS. 1A and 1B and includes two vertical anchor slot cord conduits 124*a* and 124*b* and a segment of anchor slot entrapment chamber 130*a*. The anchor slot cord conduits 124*a* and 124*b* and openings of the conduits 124*a* and 124*b* into the entrapment chamber passageway are shown offset horizontally or laterally from each other via a segment of the width or passageway of the entrapment chamber 130*a* (e.g. a distance along an axis transverse to each cord conduit). The horizontal offset of the cord conduits 124*a* and 124*b* hinder direct or linear movement of an earphone cord from one cord conduit to the other, which in this example would hinder the linear movement of an earphone cord from the entrapment chamber 130*b* or cord conduit 124*b* to the cord conduit 124*a* or anchor slot entrance 112. Neither cord conduit 124*a* or 124*b* is linear with respect to either entrapment chamber 130*a* or entrapment chamber 130*b*. The non-linear anchoring pathway 116 extends from the anchor slot entrance 112 through the cord conduit 124*a* and entrapment chamber 130*a* and out of entrapment chamber 130*a* into and through cord conduit 124*b* and to the opening into the entrapment chamber 130*b*. The linear earphone cord pathway from the anchor slot entrance 112 through the cord conduit 124*a* that terminates at the opening of the cord conduit 124*a* into the entrapment chamber 130*a* is not highlighted in FIG. 1C. It should be appreciated that an anchor slot may have various earphone cord pathways extending between an anchor slot entrance and the various entrapment chambers of an anchor slot. It should be appreciated that in other embodiments illustrated herein that a single anchor slot with multiple entrapment chambers can have multiple non-linear anchoring pathways, with each respective non-linear anchoring pathway extending from the single anchor slot entrance to each respective entrapment chamber of the anchor slot.

The cord conduit 124*a* and cord conduit 124*b* have internal or entrance open ends 125 and 127, respectively, inside the anchor slot 110 between the open-ended exterior sides of the anchor slot 110. The entrance open ends provide entrances for an earphone cord segment to enter a cord conduit to move into or between chambers of the anchor slot. The cord conduit 124*a* extends between the entrapment chamber 130*a* and the anchor slot entrance 112, and the open end of the cord conduit 124*a* that is opposite the open end 125 opens into and is co-extensive with the opening of the anchor slot entrance 112. Both the cord conduits 124*a* and 124*b* open into the entrapment chamber 130*a*. As shown in various embodiments, cord conduits have two sets of open ends. One set of open ends of the cord conduits is referred to as an external set, and the other set of open ends of the cord conduits is referred to as an internal or entrance set. Each opening of the external set of open ends opens externally into one of the open sides of the anchor slot, and each opening of the entrance set of open ends opens into an earphone cord passageway (e.g. another cord conduit or entrapment chamber) or anchor slot entrance. The cord conduit 124*a* opens into a side of the entrapment chamber 130*a*, and the cord conduit 124*b* opens into a side of entrapment chamber 130*b*. The cord conduits 124*a* and 124*b* each connect with the entrapment chamber 130*a* at ninety-degree angles and each cord conduit has one set of opposing parallel or substantially parallel sides or walls. It should be appreciated that cord conduits may connect with entrapment chambers at angles that are approximately ninety degrees and will accomplish a similar result as the structure illustrated in FIGS. 1A-1I. Although transverse connections between the cord conduits and entrapment chambers are shown as perpendicular in FIG. 1C and other embodiments, cord conduits and passageways herein may connect to entrapment chambers and cord conduits with curved or oblique angle connections and at other various transverse angles and provide the advantages discussed herein for a non-linear pathway or passageway that impedes a direct cord pathway from an entrapment chamber to an anchor slot entrance.

The entrapment chambers 130*a* and 130*b* are offset from each other vertically via a distance along the depth of the anchor slot cord conduit 124*b*. The entrapment chambers 130*a* and 130*b* are shown located at different depths in the anchor slot 110 relative to the anchor slot entrance 112, with the entrapment chamber 130*b* being located farther away from the anchor slot entrance 112 than the entrapment chamber 130*a*. The entrapment chamber 130*b* is located at a greater depth than the entrapment chamber 130*a* within the anchor slot 110 from the anchor slot entrance 112. The entrapment chamber 130*b* is located at a distal or terminal end of the anchor slot 110, and the entrapment chamber 130*a* is located at an intermediate level within the anchor slot 110. The entrapment chambers 130*a* and 130*b* each have two pairs of parallel or substantially parallel sides. One set of parallel sides of entrapment chamber 130*a* are sides 126*a* and 126*b*, and the other set of parallel sides are 128*a* and 128*b*. The opening 125 of the cord conduit 124*a* into side 126*a* of the entrapment chamber 124*a* is not directly across from or in line with the opening 127 of the cord conduit 124*b* on side 126*b*. As shown in FIG. 1C, none of the area of either the opening 125 or the opening 127 is directly across from the other opening on their respective sides. This misalignment of the openings 125 and 127 on opposite sides 126*a* and 126*b* provide an angular, offset or non-linear travel path from the entrapment chamber 130*b* to the anchor slot entrance 112, which is an added measure for keeping an earphone cord entrapped within the anchor slot 110. The openings 125 and 127 extend the entire length of the entrapment chambers in a straight line across the cord containment adaptor 100 from one open side of the anchor slot to the opposite open side of the anchor slot. The entrapment chamber 130*a*, positioned between the entrapment chamber 130*b* and the slot entrance 112, serves to provide an extra measure of containment or backup in the event that a cord segment stored in the entrapment chamber 130*b* inadvertently is pulled through the cord conduit 124*b* and into the entrapment chamber 130*a*. After a cord is in the entrapment chamber 130*a*, the cord would have to be pulled in alignment with the cord conduit 124*a* and up through the cord conduit 124*a* before the earphone cord is inadvertently dislodged. When an earphone cord has been inadvertently moved out of an entrapment chamber away from the terminal end of a cord pathway, an earphone set user may notice the cord being in the secondary or intermediate anchor slot passageway or chamber and can reposition the cord back into the primary anchoring chamber, such as entrapment chamber 130*b* or at the terminal end of a path before or without the cord being inadvertently dislodged from the anchor slot or cord containment adaptor.

In FIG. 1C, the line highlighting the non-linear path 116 illustrates the horizontal or lateral offset of the vertical cord conduits 124*a* and 124*b* from each other. When an earphone cord within the cord conduit 124*b* is pulled or pushed upward toward the anchor slot entrance 112, the earphone cord would encounter an edge or side of the entrapment chamber 130*a* that would block or impede upward movement into the cord conduit 124*a*, thus necessitating a horizontal or lateral movement or angular pull of the earphone cord to the cord conduit 124*a* in order for movement of the cord to continue towards the anchor slot entrance 112. This offset with respect to the entrapment chamber width to which the cord conduits are connected helps to prevent inadvertent dislodgement of the adaptor from an earphone cord. The various offset structures and passageways of an anchor slot help maintain the cord containment adaptor on an earphone cord. In the anchor slot 110, the open ends of the two cord conduits connected to the entrapment chamber 130*a* are not in direct alignment with each other to prevent unchecked passage from one cord conduit to the other. It should be appreciated that the amount of offset may vary as desired in a manner to minimize inadvertent dislodgement. The edges or bends in sides of sides or walls resulting from turns in the pathway to the entrapment chamber 130*b* prevent straight line movement of an earphone cord from the entrapment chamber 130*b* to the anchor slot entrance 112.

Other features that may be employed to aid in maintaining a cord containment adaptor secured to an earphone cord are the distances between opposing sides (e.g. depth shown in some illustrated embodiments) of the entrapment chambers and/or the distances between opposing sides (e.g. width as shown in some illustrated embodiments) of the cord conduits. A narrow distance between gapped-apart opposing sides or walls serve to compress earphone cords pushed or pulled into the anchor slot. As illustrated and discussed herein, the opposing sides or walls of a slot are gapped-apart and do not touch in resting rigid stationary positions. The rigidity of support for or along various opposing walls hold the walls at fixed gapped apart distances when an object is not positioned between opposing walls. The rigidity of structure of the opposing walls also serve to compress earphone cords inserted therebetween. The amount of distance or gap between opposing sides or walls for compressing various earphone cords are discussed herein. The rigidity of the anchor slot or rigid structure provided to support the anchor slot helps maintain a solid and rigid form for the anchor slot when a cord thicker than the distance between opposing walls enters the slot. The rigid structure helps maintain a firm compression or resistance force on an earphone cord segment in a slot to secure the cord containment adaptor to the cord segment. To aid in securing an adaptor on an earphone cord, either the width of the cord conduits 124*a* and 124*b* and/or the depths of the entrapment chambers 130*a* and 130*b* into which an earphone cord may pass is less than the diameter or thickness of an earphone cord so as to compress an earphone cord when it is positioned between the surfaces of opposing walls within the anchor slot 110. The compression resulting from narrow pathways or a narrow gap between walls within the anchor slot 110 help prevent rotation of a cord containment adaptor around the point or area of attachment of the cord containment adaptor to the earphone cord. The compression of the cord between rigid sides or pathways and the resulting outward force or resistance on the inner walls of the slot restricts free or easy movement of the compressed cord and makes significant inadvertent movement of an earphone cord in a slot difficult or unlikely. In some embodiments, the gap between the pair of opposing sidewalls that compress earphone cords may be spaced apart one distance for one set of such opposing sidewalls and the gap between a second set of such opposing sidewalls within a single anchor slot may be spaced apart another distance. For example, the compression distance between gapped apart walls of a cord conduit opening into the slot entrance may be slightly narrower than the compression distance between gapped apart walls of other cord conduits of an anchor slot. The narrower cord conduit opening into the entrance would help to provide additional resistance in a cord conduit to help prevent inadvertent dislodgement of the cord containment adaptor.

For cord containment slots 114*a*, 114*b*, and 114*c*, the gap between the opposing walls of the cord containment slots 114*a*, 114*b*, and 114*c*, as shown in FIG. 1*f*, are narrower than the earphone cord segment 152*a* or 152*c*, so as to compress the earphone cord segments between opposing walls to help maintain an earphone cord within the cord containment slot. The gapped apart opposing walls of cord containment slots, such as shown in cord containment slots 114*a*, 114*b*, and 114*c*, may be parallel or substantially parallel. As used herein, the word "parallel" shall include "substantially parallel" configurations unless otherwise specified. The rigidly structured gapped apart opposing slot sidewalls or sides shown herein do not touch the respective opposing sidewall or side. An earphone cord inserted into the cord containment adaptor can be hand removeable by a force or tug provided by the hand of a person directing an earphone cord along the passageway of the slot. The tug or pull by a person on a cord gripped or secured in a slot exerts a force to overcome the frictional resistance between an earphone cord in the slot and sidewalls of the slot to release the cord segment from the slot.

Figure 1G:
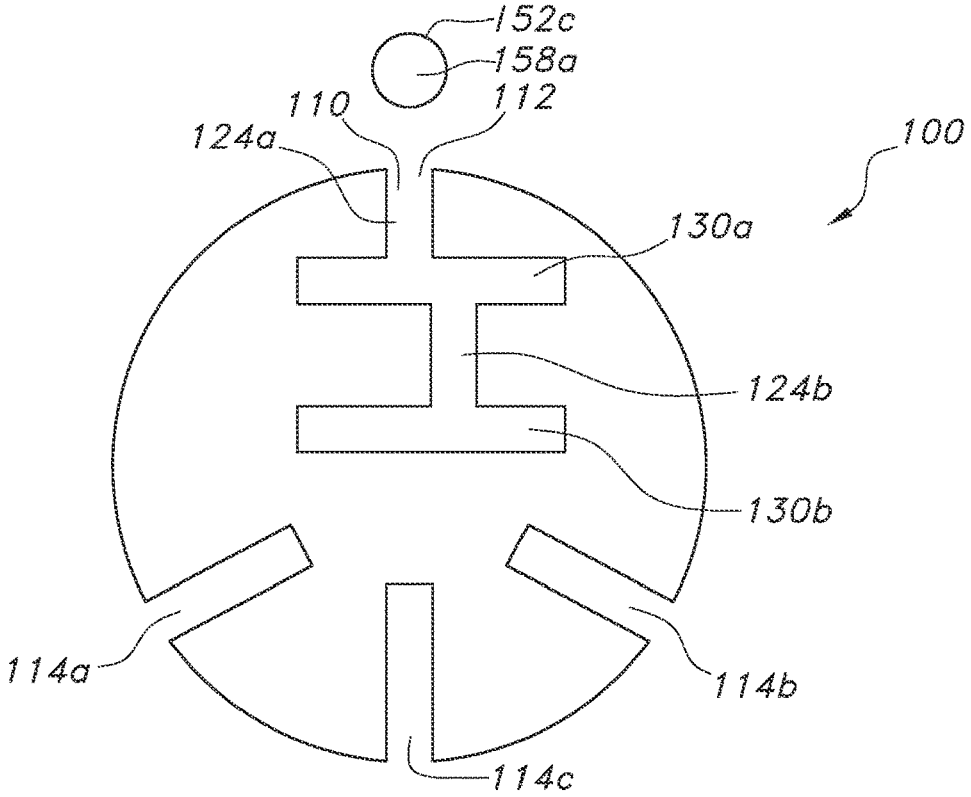
Figure 1H:
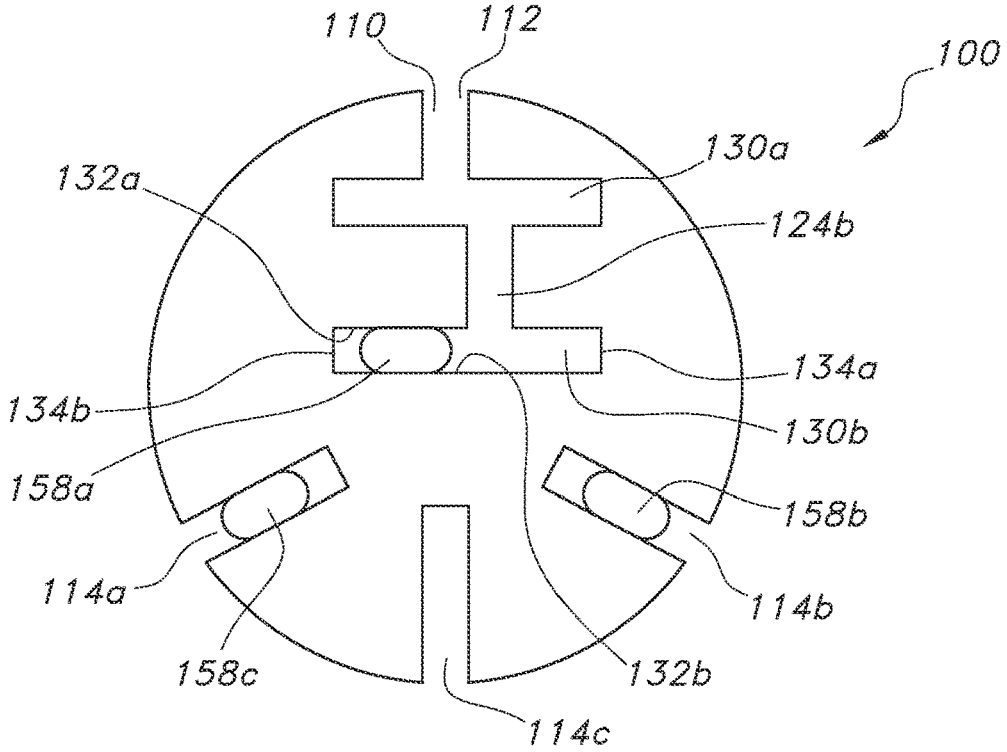

Referring to FIG. 1G, a widthwise or diameter cross-section shape 158*a* of the earphone cord segment 152*c* containing the plug of earphone set 150 is depicted above the anchor slot entrance 112 of the cord containment adaptor 100. The cross-section shape 158*a* depicts a round uncompressed cross-section of the earphone cord segment 152*c*. Referring to FIG. 1H, the earphone cord segment 152*c* is shown compressed or gripped in the anchor slot 110. The previously round cross-section, shown as cross-section shape 158*a*, of the earphone cord segment 152*c* in the entrapment chamber 130*b* is now compressed to an oval shape within the entrapment chamber 130*b* of the anchor slot 110. The earphone cord segment 152*c* is compressed when a user forcibly slides an earphone cord between opposing sidewalls of a cord conduit 124*a* or 124*b* or an entrapment chamber 130*a* or 130*b*. Opposing walls for compression of the cord conduits 124*a* and 124*b* and the opposing walls for the compression of a cord segment of the entrapment chambers 130*a* and 130*b* are illustrated with distances between those opposing walls being narrower than the diameter of the earphone cord segment 152*c*. The distance between the opposing sidewalls that compress or grip an earphone cord between the walls may be referred to as the compression distance or gripping distance, respectively. Earphone cords of earphone sets have electrical wires for transmitting audio or command signals along the wires or conductors of the earphone set and the wires are encased by a covering, which often is a flexible polymer covering. Because the covering is flexible and/or earphone cords typically have small gaps or space between the electrical conductors and the covering into which the electrical conductors extend, the covering or cord compresses when pressure is applied, such as when the earphone cord is compressed in a slot as discussed herein. This compression causes an outward pushing force from the earphone cord toward the sidewalls of a slot that provides a resistance between the sidewalls and the cord. The resistance holds the cords in place within the sidewalls of the anchor slot and restricts free movement of the cord within the slot. The earphone cord segment 152*c* may be compressed or gripped in the anchor slot 110 along the cord conduit 124*b* in the same manner as discussed in connection with the entrapment chamber 130*b*.

As discussed herein, by providing cord conduits, passageway, or entrapment chambers with channels narrower than the earphone cord to be compressed and gripped into the slot, a firm resistive force can be maintained between the earphone cord segment 152*c* and the anchor slot 110. The compression or resistance helps prevent an earphone cord from sliding in the slot in the absence of an external force by a physical thing pushing or pulling to overcome the frictional force between the edges or walls and the cord. The sides or walls may compress the cross-sectional diameter or thickness of the flexible length of an earphone cord to secure it within a slot. A consistent and suitable compression or resistance can be maintained within the slots by making the entire cord containment adaptor or anchor slot out of a rigid material or providing a rigid support frame or structure within or around the cord containment adaptor or the anchor slot to maintain the compression or structural features of the anchor slot. Utilizing a rigid material for the structure of a cord containment adaptor or anchor slot provides a rigid structure or frame. The anchor slot can be made of a rigid material or the structure of the anchor slot can be held in place by a rigid material. The cord containment adaptors and slots discussed herein in FIGS. 1A-1I and FIGS. 3-17 are shown as rigidly constructed. It should be appreciated that a rigid material as discussed herein encompasses a substantially rigid material that accomplishes the advantages or objectives of the cord containment adaptor.

Figure 2A:
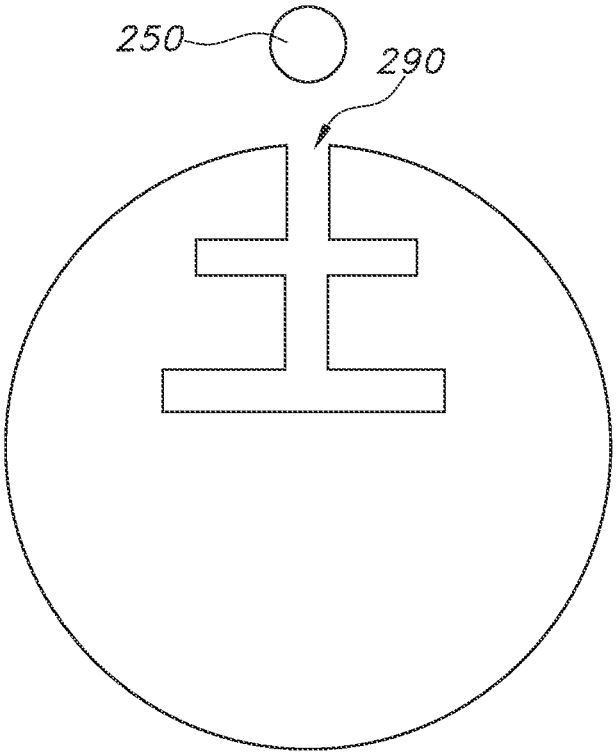
FIGS. 2A and 2B illustrate an example of a cord containment structure showing features of inventive aspects of the invention but that is too flexible for reliable anchoring.
Figure 2B:
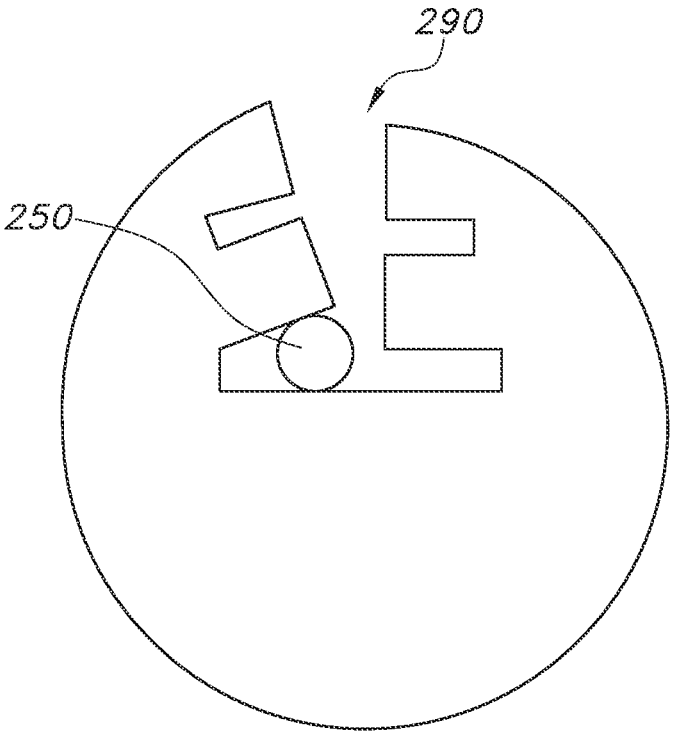

Although the cord containment adaptor 100 can have flexible sections, a rigid structure or support for the anchor slot provides a stable structure for containing compression of earphones cords within slot channels. It should be appreciated that rigid materials or structures have a measured elasticity and flex to some extent when under pressure but nevertheless are suitable, as described herein, to compress earphone cord segments as discussed herein. Structures that are firm enough to maintain the slot structure described herein to compress or anchor earphone cords in a slot to accomplish the objectives herein are considered rigid. With a structure that is too flexible for the anchor slot of a cord containment adaptor, an anchor slot will more easily spread when an earphone cord with a diameter larger than the distance between opposing walls presses against the slot walls so as to spread them in a manner that compromises the ability of the cord containment adaptor to remain secured or fixed at the original position when the cord moves around or the adaptor brushes against items. For example, FIG. 2A shows a cross-section of an earphone cord segment 250 and a structure 290 encompassing some inventive aspects but is not rigidly constructed, and FIG. 2B shows an example of undesirable spreading due to an undesirable flexible anchor slot of a structure 290 resulting from the earphone cord segment 250 being positioned into the anchor slot. Cord containment adaptors or earphone cord attachments can be made of or supported by a rigid polymer material, metal, composites, or other rigid material. Suitable polymer materials include, for example, various compositions of ABS, polyethylene, polypropylene, polystyrene, and PVC. It should be appreciated that a rigid frame or structure of a cord containment adaptor may be over-molded over, fitted around or covered with a softer or flexible material and yet maintain anchor slot firm structure firmness and wall gaps to compress or grip cords as discussed herein. Conversely, a rigid structure or frame may be provided around a flexible material to provide the rigid support to prevent a slot from spreading, such as for example a rigid shell or frame could be provided around the structure shown in FIG. 2A to prevent the structure 290 from spreading and provide a rigid cord containment adaptor or anchor slot structure, where the external frame would extend around but not cover the openings of the slots. A firm shell extending on or co-extensive with the outer surface of the structure 290 or frame supporting the anchor slot of the structure 290 can be provided to make the adaptor structure firm or rigid to support compression or gripping of an earphone cord to hold a cord containment adaptor on an earphone cord. Similarly, if the structures shown in other embodiments herein are constructed of a flexible polymer or rubber, a rigid or firm shell can extend around each such flexible structure to provide an anchor slot structure suitable for the use as discussed herein.

The diameter of earphone cords that have rounded cross sections generally range from 1.2 mm-3 mm. For "Y" shaped earphone sets containing a plug (e.g. as shown in FIG. 1D), the earphone cord that is attached directly to the earphone plug typically is wider or has a larger diameter than the earphone cords of the same set of earphones that are attached to the earpieces of the earphone set since the cord attached to the plug has conductors for both earpieces of the earphone set. Typical diameters for the earphone cord segment containing or attached directly to the plug range from around 1.8 mm to 2.2 mm. As an example, for various earphone cords with a diameter of 2 mm, a suitable distance between rigid or rigidly supported opposing sidewalls that are structured to grip an earphone cord segment within an earphone cord entrapment chamber is between 1.2 mm-1.8 mm, with the shorter distance making movement in the slot more restricted or difficult. Although a cord compresses more with a shorter distance between opposing sidewalls, rigid opposing wall distances that are less than half of the cord diameter or width for rounded cords may make it impossible or very difficult to move a cord within a slot or may damage a cord forced through a slot. The gapped apart walls should exceed 0.5 mm for rigidly structured and fixed interior anchor slot walls since typical earphone cord diameters or thicknesses exceed 0.8 mm. For an earphone cord having a diameter of approximately 1.7 mm, such as a cord attached to an earpiece of "Y" shaped earphone set, a suitable distance between opposing slot sidewalls of a cord containment adaptor that are structured to grip an earphone cord segment is between 0.9 mm-1.4 mm. Some earphones, such as rounded wireless earphones that do not have a plug but instead have only earpieces that are tethered together by a single rounded earphone cord, have cord diameters that often range from 2.1 mm-3 mm. For various earphone cords with a diameter that is approximately 2.5 mm, a suitable distance between opposing sidewalls for entrapping or gripping an earphone cord is 2.1 mm. It should be appreciated that the distance of opposing sidewalls of entrapment chambers and slots for use with specific earphone cords may vary depending on the diameter and specific make-up of the earphone cord to be used in the earphone cord adaptor. It should be appreciated that a selected fixed distance between opposing rigid sidewalls will sufficiently compress earphone cords of varying diameters falling within a relatively moderate range.

In FIG. 1H, entrapment chamber 130*b* has a first pair of opposing sidewalls 132*a* and 132*b* and second pair of opposing sidewalls 134*a* and 134*b*. Opposing sidewalls 132*a* and 132*b* are operative to compress the earphone cord segment 152*c* between them as illustrated. For an earphone cord that is approximately 2 mm in diameter, a suitable distance between the sidewalls 132*a* and 132*b* is generally 1.5 mm and the sidewalls compress and grip a cord sufficiently for the cord containment adaptor to remain sufficiently stationary on the earphone cord. The depth of the entrapment chamber 130*b* or the distance of 1.5 mm between the sidewalls 132*a* and 132*b* is equal to the height of each sidewall 134*a* and 134*b* in the illustrated embodiment. Similarly, the width of the entrapment chamber 130*b* or distance between the opposing sides 134*a* and 134*b* is the width of the side 132*b*. The opposing sides 132*a* and 132*b* are connected to and separated by the opposing sides 134*a* and 134*b* as illustrated to form a rectangular shaped entrapment chamber. The entrapment chamber 130*a* is rectangular and similarly constructed.

Another feature that is useful in helping to maintain an earphone cord in an anchor slot is the offset position of the cord conduits 124*a* and 124*b* relative to the ends of entrapment chambers to which the conduits are connected. Referring to FIG. 1I, the cord conduit 124*b* is shown offset by a first distance that is equal to the length of a first part 138*a* of the chamber side 132*a* from a first end of the entrapment chamber 130*b*. The first end of the entrapment chamber is defined by the sidewall 134*a*. The cord conduit 124*b* is shown offset by a second distance that is equal to the length of a second part 138*b* of the chamber side 132*a* from a second end of the entrapment chamber 130*b*. First and second parts of the same side of an entrapment chamber separated by the width of a cord conduit, such as the first part 138*a* and second part 138*b* of the chamber side 132*a* on the same side of the entrapment chamber 130*b*, though separated by the width of cord conduit 124*b*, are referred to herein as a single side or sidewall of an entrapment chamber. The second end of the entrapment chamber is defined by the sidewall 134*b*. The cord conduit 124*b* is similarly offset from the ends of entrapment chamber 130*a* at the area of connection of the cord conduit 124*b* to the entrapment chamber 130*a*. Likewise, the connection point or area of the cord conduit 124*a* to the entrapment chamber 130*a* is offset from both ends of the entrapment chamber 130*a*. By offsetting the connection point or area of the cord conduits 124*a* or 124*b* to the entrapment chambers 130*a* and 130*b* away from the ends of the entrapment chambers, when there is movement of an earphone cord within an entrapment chamber, the length of the earphone cord within the chamber is not easily inadvertently aligned with one of the cord conduits 124*a* or 124*b* because a cord may go to either side of the offset conduit. Although a prescribed offset of a conduit from the end of each entrapment chamber is not required for each cord conduit, without an offset, an earphone cord contained within an entrapment chamber that reaches the end of an entrapment chamber at the connection point of cord conduit may more easily funnel toward a path leading to an anchor slot entrance because it will be aligned with the cord conduit. For example, as shown in FIG. 4B, the connection point or area of the cord conduit 424*b* with the entrapment chamber 430*b* is not offset from the end of the entrapment chamber 430*b* and a cord reaching the end of the entrapment chamber 430*b* may more easily align with cord conduit 424*b*.

Another aspect that aids in maintaining a cord segment within an anchor slot is providing an increased surface area within the entrapment chamber, such as by configuring the distance (e.g. width) between opposing walls, such as between walls 134*a* and 134*b* (FIG. 1H), of an entrapment chamber that are not designated for compressing a cord to be at least three times the distance (e.g. depth) between opposing walls, such as between walls 132*a* and 132*b* (FIG. 1H), that are to compress a rounded cord within the entrapment chamber. This construction ensures that the entrapment chamber is sufficiently wider than the cord to be compressed and held within the entrapment chamber. It is useful to have the offset of the cord conduit from at least one end of the entrapment chamber to be about two to three times the expected diameter of the cord anticipated to be stored in an entrapment chamber. By providing more space on either side of the connection point of the conduit with the entrapment chamber, an earphone cord may be positioned farther away from a cord conduit within an entrapment chamber. Also, with more space to either side of the conduit, one or more cord segments can be stored in an entrapment chamber on a single side of the connection point within an entrapment chamber, if needed, for containing cord segments. Also, increased surface area for more frictional resistance can be accomplished by constructing the length of slot extending between the exterior open sides of an anchor slot to be longer. A length of 10 mm or more between open exterior sides of a slot helps provide sufficient length and a stable structure when a rigid material is used, although a length of less than 10 mm can provide sufficient structure for many embodiments.

Referring again to FIG. 1H, in addition to the cord containment slots 114*a*, 114*b*, and 114*c* being structured narrower than the diameter or thickness of an earphone cord for use with a cord containment adaptor 100, the depth of the straight cord containment slots 114*a*, 114*b*, and 114*c* can contribute to preventing dislodgement. A depth of the cord containment slot at least twice the diameter of an earphone cord is helpful. A depth of three to four times the width of a strait slot is better to provide more surface area resistance within the slot to help prevent inadvertent tugs or forces from dislodging a cord from the slot. By making the depth of a linear earphone cord slot significantly longer than the diameter or width of the earphone cord to be contained, an earphone cord can be positioned farther away from the slot entrance and requires a more continuous force against the earphone cord toward the slot entrance to dislodge the cord from the slot than if an earphone cord slot depth is sized nearly or essentially the same diameter of the earphone cord. For holding rounded cords that are approximately 2 mm in diameter, a straight slot depth of 5 mm-8 mm with a slot width of 1.5 mm should sufficiently secure an earphone cord within the slot. The combination of the cord containment slot depth and narrow wall width aids in preventing inadvertent dislodgement of a cord contained within a slot. The embodiments of FIGS. 1A-7D, 11A-15B and 17 are particularly adapted for use with rounded earphone cords.

Figure 3:
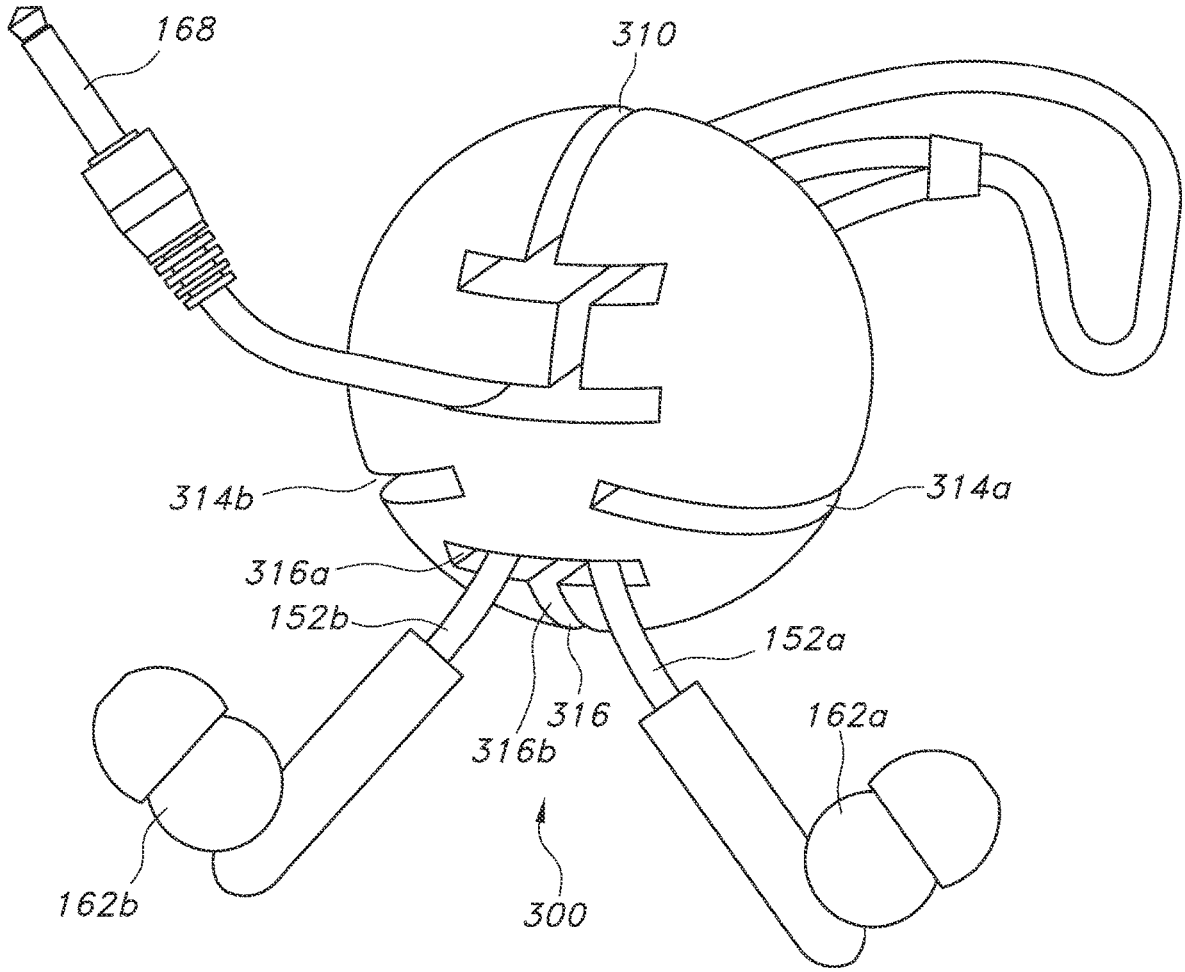
FIG. 3 is a view of a cord containment adaptor in accordance with an embodiment of the invention with an earphone set contained therein.

Referring to FIG. 3, another embodiment of a cord containment adaptor is illustrated. The cord containment adaptor 300 is spherical and is constructed in the same general manner as the cord containment adaptor 100. The cord containment adaptor 300 has an anchor slot 310 and cord containment slots 314*a*, 314*b*, and 316. The illustrated slots extend through the adaptor and open on the opposite side of the adaptor in a manner that mirrors the openings shown, like the other cord containment adaptors illustrated herein. The anchor slot 310 is constructed in the same manner and has many of the features as the anchor slot 110 (FIG. 1A). The cord containment slots 314*a* and 314*b* are constructed in the same manner as the cord containment slots 114*a* and 114*b*. The cord containment slot 316 has an entrapment chamber 316*a* and a cord conduit 316*b*. Although cord containment slot 316 has an entrapment chamber 316*a*, a cord inserted within the cord containment slot 316 will have fewer impediments for removal than an earphone cord inserted into the terminal entrapment chamber or end of the anchor slot 310. The entrapment chamber 316*a* and cord conduit 316*b* are constructed in the same manner respectively as similar entrapment chambers and cord conduits illustrated or discussed herein. With the entrapment chamber cord containment slot 316, two segments of an earphone cord can be stored on either side of the cord conduit 316*b*, where the cord segments 152*a* and 152*b* are shown compressed and gripped into the entrapment chamber 316*a* and the cord segment 152*c* containing the plug 168 is shown compressed in the anchor slot 310. The cord containment slot 316 enables one slot to serve as an entry for two segments, and the cords can be compressed and contained in an entrapment chamber 316*a*, where removal of a cord from the entrapment chamber 316*a* is restricted by the compression and where movement to the entrance can be indirect depending on the location of the cord within the entrapment chamber 316*a*. The cord containment slot 316 can provide more impediments to cord removal and containment than a straight slot, such as the slot 314. A cord containment slot 316 could serve as anchor slot but would lack the additional impediments provided by entrapment area or chamber between the slot entrance and the end of the slot pathway and the non-linear pathway from the slot entrance to the opening into the entrapment chamber, like illustrated in various anchor slots discussed herein. The loop resulting from the contained ends 152*a* and 152*b* of the earphone set 150 can be secured in any of the slots depicted. The cord containment adaptors 100 and 300, as well as other cord containment adaptors herein provide a combination of different type slots in a single adaptor where each slot enables the insertion and removal of a cord by hand, where one type anchor slot provides more features to hold and impede removal of a cord from the adaptor and where another type slot structure provides for easier removal of an earphone cord from the adaptor than the anchor slot of the adaptor.

Figure 4A:
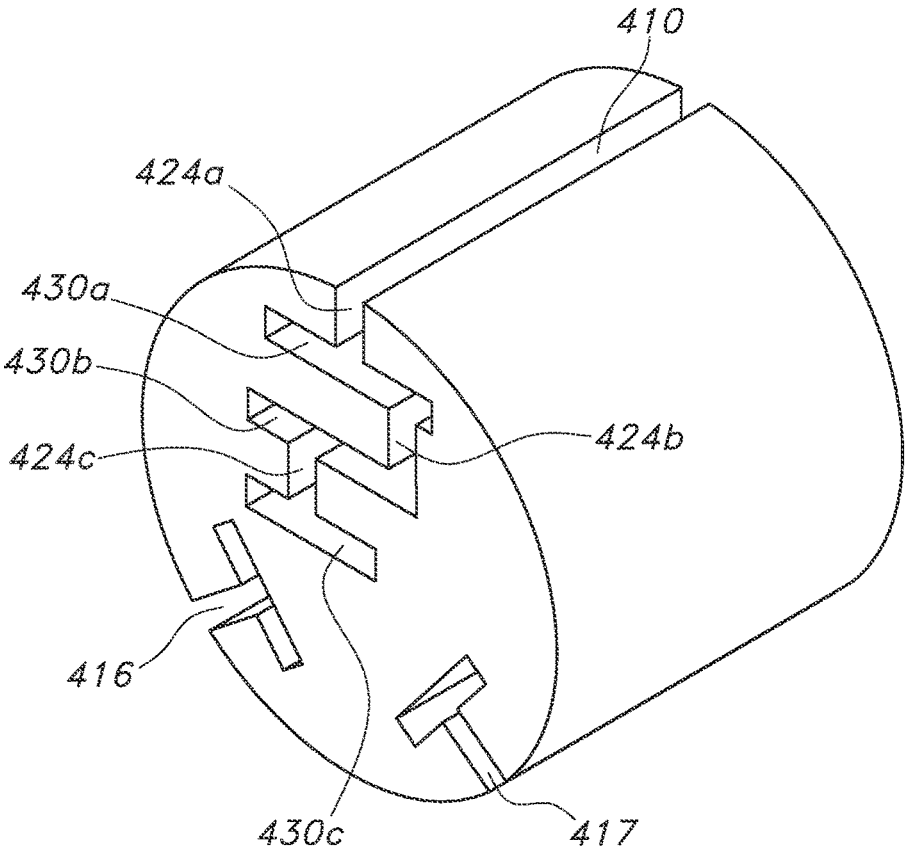
FIGS. 4A and 4B are views of a cord containment adaptor in accordance with an embodiment of the invention.
Figure 4B:
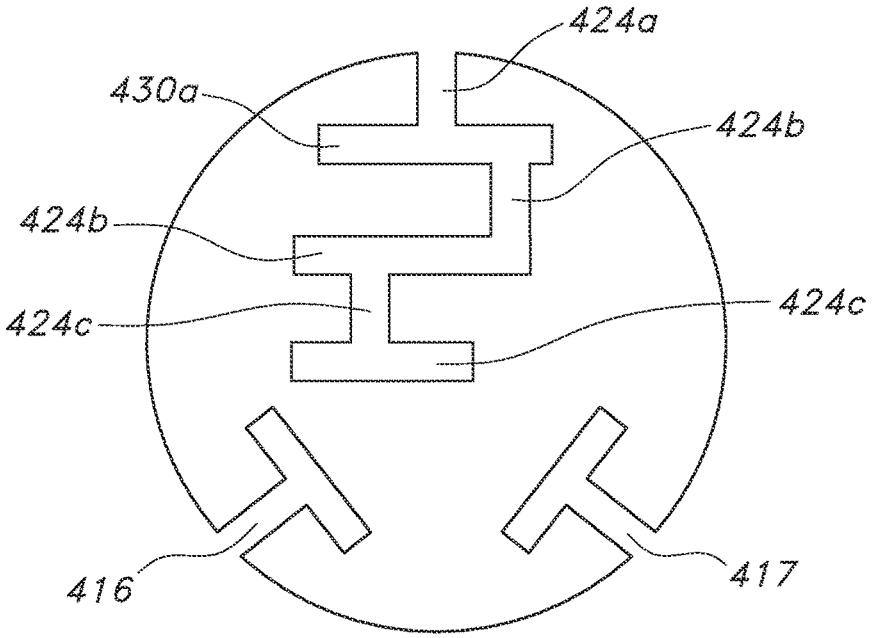

Referring to FIGS. 4A and 4B, another embodiment of a cord containment adaptor is illustrated. The cord containment adaptor 400 is cylindrical and has an anchor slot 410 and two entrapment chamber cord containment slots 416 and 417. The anchor slot 410 has multiple entrapment chambers

430*a*, 430*b*, and 430*c* and cord conduits 424*a*, 424*b*, and 424*c* coupled to the respective entrapment chambers as illustrated. One open end of the cord conduit 424*a* opens into and is co-extensive with the anchor slot entrance 412 and the other end of the cord conduit 424*a* opens into entrapment chamber 430*a*. The cord conduit 424*b* opens into the entrapment chambers 430*a* and 430*b*. The end opening into entrapment chamber 430*a* is offset from both ends of entrapment chamber 430*a* but the point or area of connection to the entrapment chamber 430*b* of the cord conduit 424*b* is not offset from both ends of the entrapment chamber 430*b*. The cord conduit 424*b* is only offset from one end of the entrapment chamber 430*b* as illustrated. Without the offset between cord conduit 424*b* and entrapment chamber 430*b*, when a cord segment reaches the end of the entrapment chamber for which the cord conduit is not offset, the cord may more easily funnel into the cord conduit, such as cord conduit 424*b*, when an earphone cord is pulled to the end of the entrapment chamber because the cord will not be able to continue beyond the cord conduit. The other cord conduit 424*c* is offset from both ends of the entrapment chamber 430*c*.

Figure 5A:
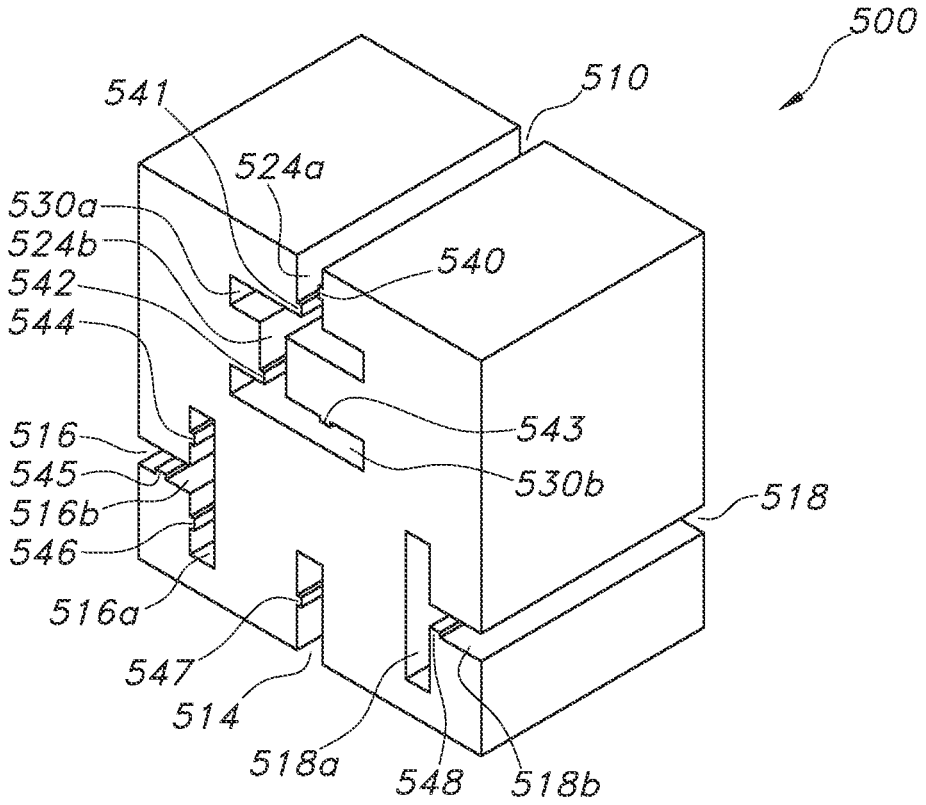
FIGS. 5A and 5B are views of a cord containment adaptor in accordance with an embodiment of the invention.
Figure 5B:
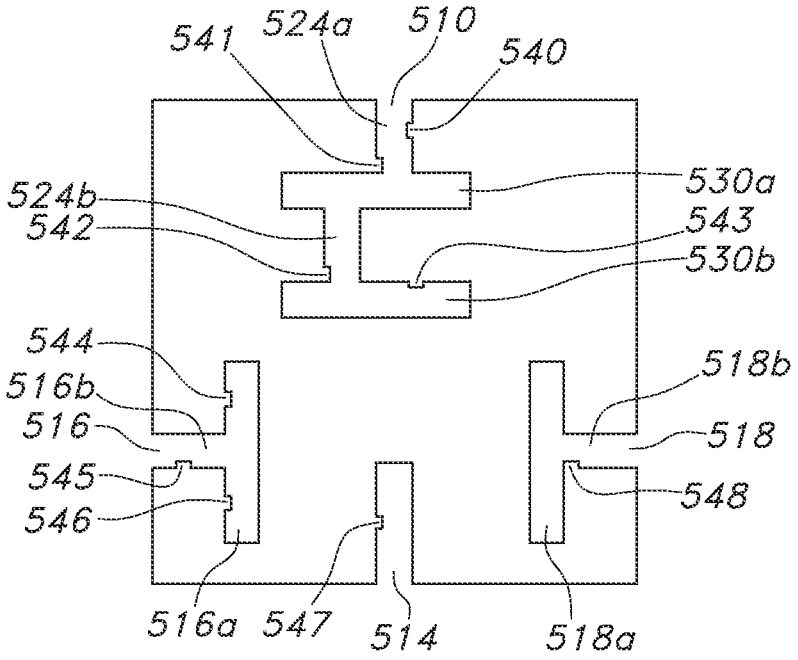

Referring to FIGS. 5A and 5B, another embodiment of a cord containment adaptor is illustrated. The cord containment adaptor 500 has a rectangular cuboid shape and has an anchor slot 510 and cord containment slots 514, 516, and 518. The cord containment slots 516 and 518 have entrapment chambers 516*a* and 518*a* and cord conduits 516*b* and 518*b*, like discussed in connection with FIG. 3. The cord containment slots are positioned on different surfaces or surface areas transverse to and displaced away from the anchor slot 510 via upstanding rigid walls. The positioning of the cord containment slots on surfaces away from and transverse to the anchor slot 510 enables the adaptor 500 to be used to secure earphone cords when they are wrapped around a mobile phone as illustrated and discussed in connection with FIGS. 10A and 10B.

Ridges 540-548, as shown or discussed herein, are other features helpful in maintaining a cord within an entrapment chamber or cord conduit. The cord conduit 524*a* has ridges 540 and 541 along a sidewall of the cord conduit 524*a*. The ridges 540 and 541 help further ensure that an earphone cord is not inadvertently dislodged from the anchor slot 510 to help retain the cord containment adaptor 500 on the earphone cord segment. Although areas of the sides or sidewalls that are on either side of the ridges are spaced apart a distance that will compress an earphone cord inserted between the sidewalls to retain the adaptor 500 on the cord segment 152*c*, the ridges 540 and 541, like the other ridges as discussed herein, each provide a gap or passageway between the sidewalls that is narrower or a shorter distance than the distance between the areas of the sidewalls of the passageway, conduit, or chamber not containing a ridge. The area not occupied by the ridges 540 and 541 within the cord conduit comprises the majority of the area within the cord conduit 524*a*. The narrower gap provided by the ridges 540-548 provides an additional restriction or compression between the ridge and the opposite wall for a cord that has been entrapped into an earphone cord passageway, such as cord conduits and entrapment chambers. In the illustrated embodiment, areas of compression are provided within the slot on either side of each ridge. Thus, the ridges 540 and 541 provide an additional impediment to help prevent a cord from being inadvertently forced in an unintended way out of the cord conduit 524*a*. Ridges in the cord conduit 524*a*, which leads or opens directly into the slot entrance, can be particularly helpful for preventing dislodgement of the adaptor from an earphone cord. The ridge 541 at the intersection with or opening of the cord conduit 524*a* into the entrapment chamber 530*a* is helpful for providing an extra measure to keep an earphone cord 152*c* in the entrapment chamber 530*a* and out of the cord conduit 524*a* leading directly to the entrance 512. Although the full length of the ridges, extending from one open exterior side to the other open exterior side of the slot, is not shown in FIGS. 5A and 5B, the ridges 540-548 extend the full length of the slot between the opened ended sides defining the end of the slots on the exterior surface of the cord containment adaptor. It should be appreciated that the ridges or a line of ridges along the slot length do not have to extend all the way across the passageway, slot, chamber or conduit in which the ridges are in. The ridges can be segmented across the length of a slot, chamber, or conduit or can be short or low height raised areas placed in various selected dispersed locations of a cord passageway, such as, for example, a cord conduit or entrapment chamber, to help prevent inadvertent dislodgement of a cord from the cord containment adaptor.

Because the ridges 540-548 serve to further compress an earphone cord, the ridges do not need to be substantially high above the surface of the sidewall from which the ridge extends. The height of a ridge will depend on the diameter or thickness or general parameters of cords intended to be compressed between opposing sidewalls. A ridge height of 0.1-0.6 mm will generally work for many cords that are to be compressed between sidewalls that are spaced apart from 0.9-3 mm. A ridge height that is between 10%-25% of the distance between opposing sidewalls should be sufficient for many earphone cords depending on the gap between opposing sidewalls. The gap between the ridge and the opposing sidewall should not be so small as to prevent the cord from passing through the passageway or that would make it difficult to move the cord through the passageway without damaging the cord. While the area on the sides of a ridge provides compression to limit inadvertent movement of a cord within the slot, the additional area of greater compression or restriction provided by ridges 540-548 can help prevent inadvertent movement past the location of the ridge in the event of significant force. It should be appreciated that ridges, as discussed in association with FIGS. 5A and 5B, are operative to be utilized and structured in cord passageways of the various other embodiments of cord containment adaptors, like illustrated and discussed herein.

Figure 6A:
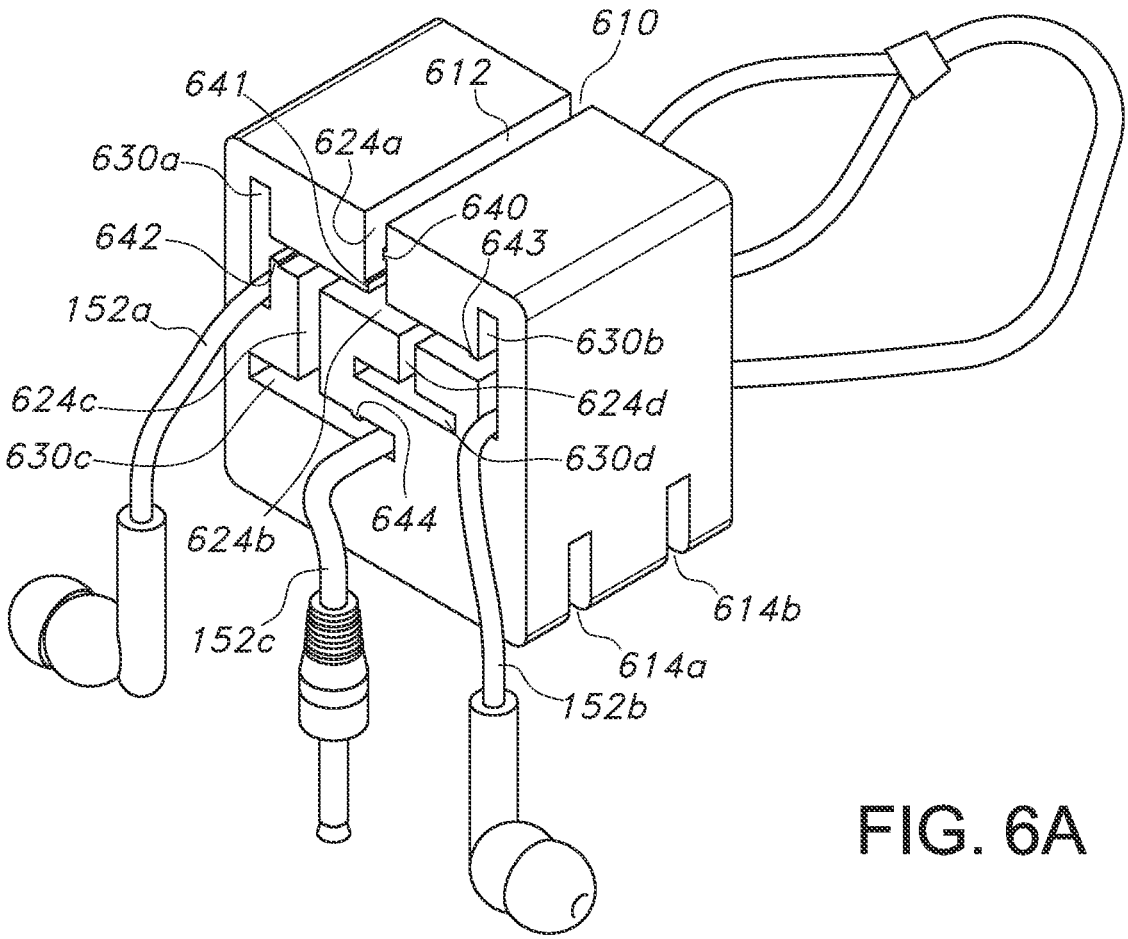
FIGS. 6A and 6B are views of a cord containment adaptor in accordance with an embodiment of the invention.
Figure 6B:
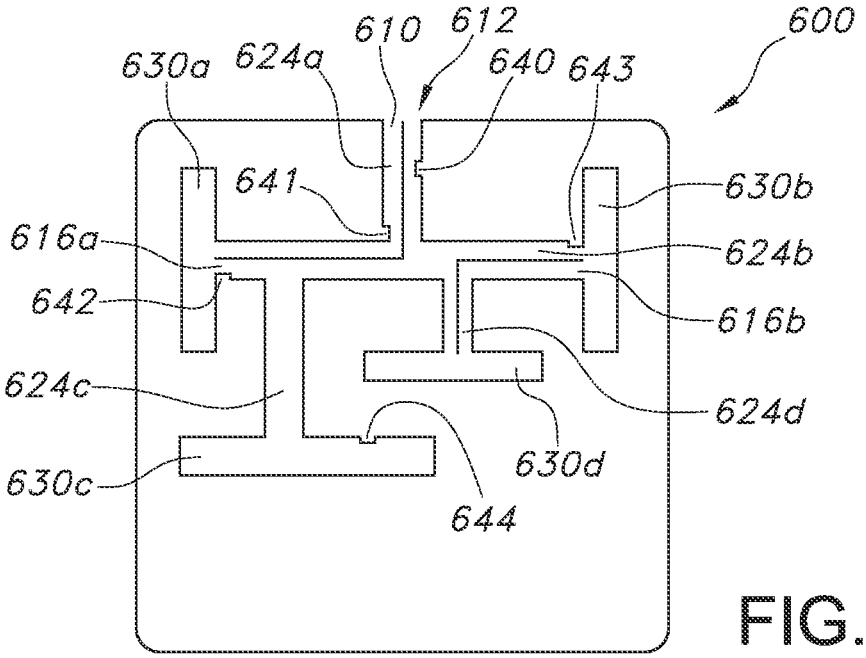

Referring to FIGS. 6A and 6B, another embodiment of a cord containment adaptor is illustrated. The cord containment adaptor 600 is a rectangular cuboid and has an anchor slot 610, an anchor slot entrance 612, cord containment slots 614*a* and 614*b*, cord conduits 624*a*, 624*b*, 624*c*, and 624*d*, and four entrapment chambers 630*a*, 630*b*, 630*c*, and 630*d*. The anchor slot has ridges 640-644 that provide narrower gaps in the passageways of cord conduits and an entrapment chamber and that are structured and can provide the same function as the ridges illustrated and discussed in association with FIGS. 5A and 5B. The distance between the respective opposing sidewalls of the entrapment chambers 630*a* and 630*b* that are structured to compress earphone cords can be different than the distance between respective opposing sidewalls of entrapment chambers 630*c* and 630*d* that are structured to compress earphone cords. The distances between opposing sidewalls of entrapment chambers 630*a* and 630*b* that are structured compress earphone cords are the same. By having entrapment chambers with different depths or widths for compressing earphone cord segments, the anchor slot 610 is adapted for multiple cord diameters and therefore provides a universal cord containment adaptor to attach firmly to various diameter or width cord segments, where differently sized entrapment chambers share a common anchor slot entrance 612.

Cord pathways, which comprise passageways through which a cord can pass, such as for example, a cord chamber or chambers and/or a cord conduit or conduits, connect each entrapment chamber or cord conduits with every other entrapment chamber, cord conduit, and/or the anchor slot entrance 612, like other anchor slots earphone cord pathways and passageways illustrated and discussed herein. Connecting cord pathways connect each entrapment chamber with every other entrapment chamber of the anchor slot and also connect each entrapment chamber with the anchor slot entrance, as shown in FIGS. 6A and 6B and other embodiments illustrated herein. An earphone cord pathway 616*a* is shown extending from the anchor slot entrance 612 through the cord conduit 624*a* and through a section of the cord conduit 624*b* to the opening into the entrapment chamber 630*a*, and an earphone cord pathway 616*b* is shown extending from the from the opening into entrapment chamber 630*d* through cord conduit 624*d* and through a section of the cord conduit 624*b* to the opening into entrapment chamber 630*b*. Although lines are not illustrated representing each of the earphone cord pathways between cord conduits, entrapment chambers, and/or an anchor slot entrance of each embodiment, the different pathways can be readily visualized from the connected cord pathways between cord conduits, entrapment chambers, and anchor slots illustrated.

The entrapment chambers of FIGS. 6A and 6B do not have more than one cord conduit opening into any single entrapment chamber. The entrapment chambers 630*a*, 630*b*, 630*c* and 630*d* are branched from a central conduit 624*a* via cord conduits. A non-linear pathway is provided between the end of each cord pathway opening into each entrapment chamber and the anchor slot entrance. The anchor slot 610 is structured such that a cord that is to be stored in an individual entrapment chamber does not have to pass through another entrapment chamber designated for another cord. The cord conduit 624*b* is transverse to the cord conduit 624*a* that has an opening that is coextensive with slot entrance 612. One open end of the cord conduit 624*b* opens into the entrapment chamber 630*a* and the other end of the cord conduit 624*b* opens into the entrapment chamber 630*b*. Cord conduits 624*c* and 624*d* are transverse to and open into cord conduit 624*b*. The other respective open ends of the cord conduits 624*c* and 624*d* are transverse to and open, respectively, open into entrapment chambers 630*c* and 630*d*. Non-linear pathways or passageways are individually provided from the anchor slot entrance 612 to each entrapment chamber of FIG. 6A.

The cord conduit 624*b* serves as an intermediary cord entrapment area between the anchor slot entrance 612 and the entrapment chambers 630*a*, 630*b*, 630*c* and 630*d*. The entrapment chambers 630*a*, 630*b*, 630*c*, and 630*d* are positioned at the terminal ends of the earphone cord pathways leading from the anchor slot entrance 612. The respective earphone cord pathways from the anchor slot entrance 612 leading to entrapment chambers 630*a* and 630*b* respectively have one change of direction between the anchor slot entrance 612 and the respective terminal ends of the pathway that open into the respective entrapment chambers 630*a* and 630*b*. The respective earphone cord pathways from the anchor slot entrance 612 leading to entrapment chambers 630*c* and 630*d* respectively have two changes of directions between the anchor slot entrance 612 and the respective terminal ends that open into respective entrapment chambers 630*c* and 630*d*. Like other embodiments discussed and illustrated, each of the different types of cord passageways are interconnected with every other cord passageway via cord passageways of the anchor slot through which an earphone cord can pass internally between and among the various cord passageways of the anchor slot without the earphone cord being removed from the anchor slot. Multiple entrapment chambers in an anchor slot enable a segment of an earphone cord that serves as an anchor segment to be embedded in an entrapment chamber at a level farther away from the anchor slot entrance than other entrapment chambers which may contain other earphone cord segments. In this way, a single anchor slot with multiple entrapment chambers can serve a dual purpose of anchoring the adaptor on an anchor earphone cord segment in one entrapment chamber yet enabling other selected segments, such as cord segments near earpieces of an earphone set, to be gripped in other entrapment chambers of the anchor slot for easier removal of selected cord segments than the anchor earphone cord segment.

The cord containment adaptor 600 is shown anchored on earphone cord segment 152*c* of earphone set 150. The cord segment 152*c* containing the plug is compressed and gripped in entrapment chamber 630*c*. Earphone cord segment 152*a* is compressed and gripped in entrapment chamber 630*a* and the earphone cord segment 152*b* is compressed and gripped in entrapment chamber 630*b*. The earphone cord segments 152*a* and 152*b* are smaller than or have a narrower diameter than the cord segment 152*c*. With different sized entrapment chambers, different size cord segments can be compressed and gripped in a customized chamber or manner for each differently sized cord segment within a single anchor slot. With the cord containment adaptor 600, a user may more easily utilize the same cord containment adaptor with different sets of earphones and use a single slot to grip varying sized cord segments of a single earphone set.

Figure 7A:
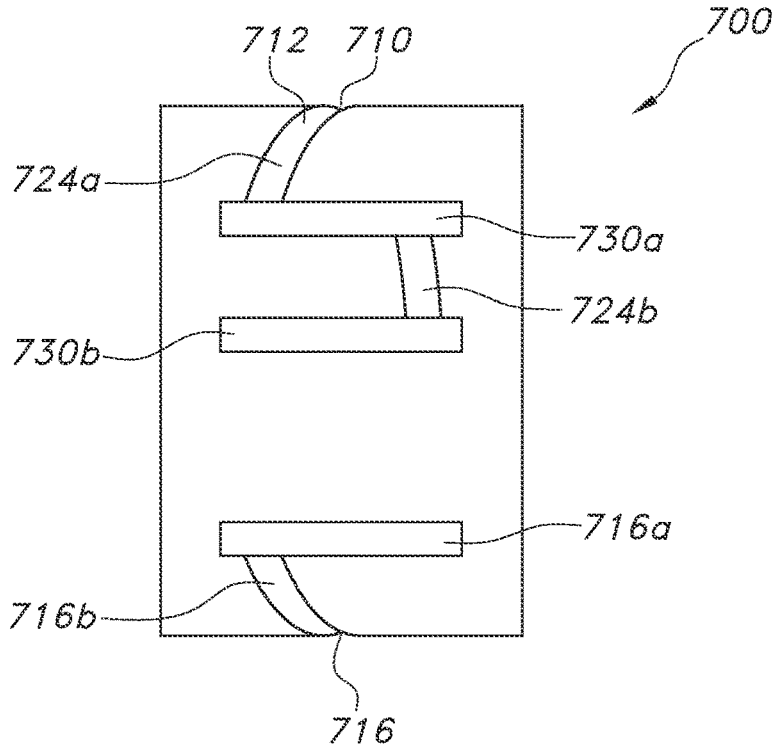
FIGS. 7A, 7B, 7C, and 7D are views of a cord containment adaptor in accordance with an embodiment of the invention.
Figure 7B:
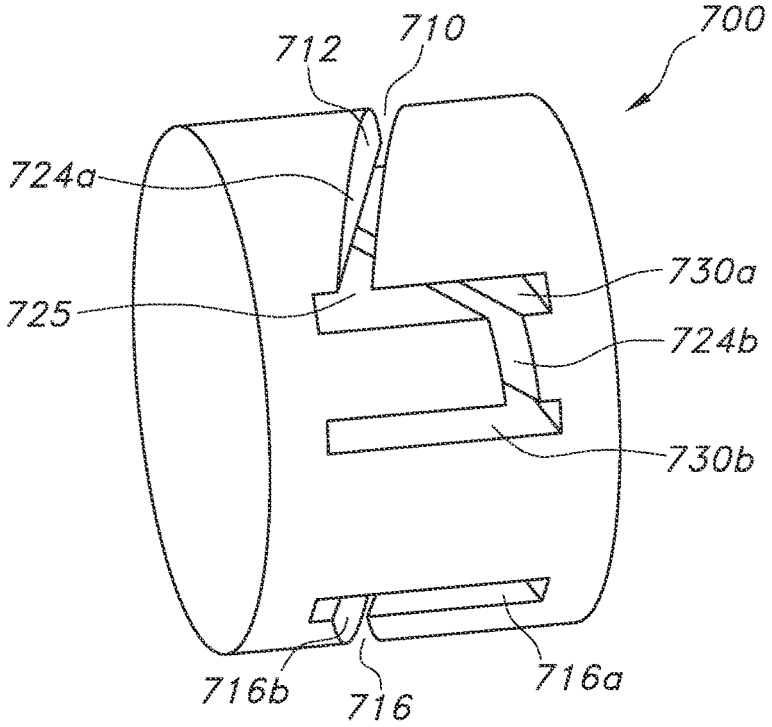
Figure 7C:
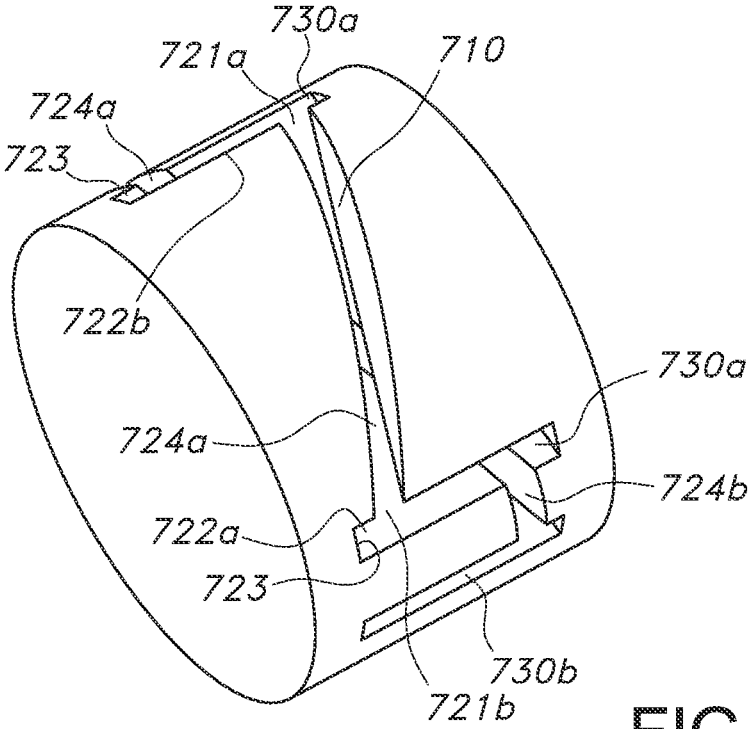

Referring to FIGS. 7A (front view), 7B and 7C (perspective views), and 7D (top view), a cord containment adaptor 700 is shown. A back view (not shown) is the mirror image of the front view 7A, and the circular side view, as can be seen in the perspective views, is the mirror image of the side on the opposite side of the adaptor 700. The cord containment adaptor 700 has an anchor slot 710, cord conduits 724*a* and 724*b*, entrapment chambers 730*a* and 730*b*, and a cord containment slot 716. The cord containment slot 716 has an entrapment chamber 716*a* and cord conduit 716*b*. The anchor slot 710 has an anchor slot entrance 712 and has a cord conduit 724*a* that is diagonal or slanted across a sidewall of the entrapment chamber 730*a* or the through-path of the entrapment chamber 730*a* to which cord conduit 724*a* is connected. The internal opening 725 of the cord conduit 724*a* into the entrapment chamber 730*a* is diagonal or slanted across the length of the entrapment chamber 730*a*. The exterior opening 721*a* of an exterior open-ended side of the cord conduit 724*a* is displaced away a different distance 722*a* (FIGS. 7C and 7D) from a first interior sidewall 723 (FIG. 7C) of the entrapment chamber 730*a* than the distance 722*b* (FIGS. 7C and 7D) of the exterior opening 721*b* of the other open-ended side of the cord conduit 724*a* from the sidewall 723 on the opposite side of the cord containment adaptor 700 and cord conduit 724*b*. The cord conduit 724*b* is also configured to open into and cut across the entrapment chamber 730*a* and 730*b* in a slanted configuration or diagonal across the entrapment chamber 730*a* in the manner as illustrated and discussed in association with the connection of cord conduit 724*a* and entrapment chamber 730*a*.

Figure 7D:
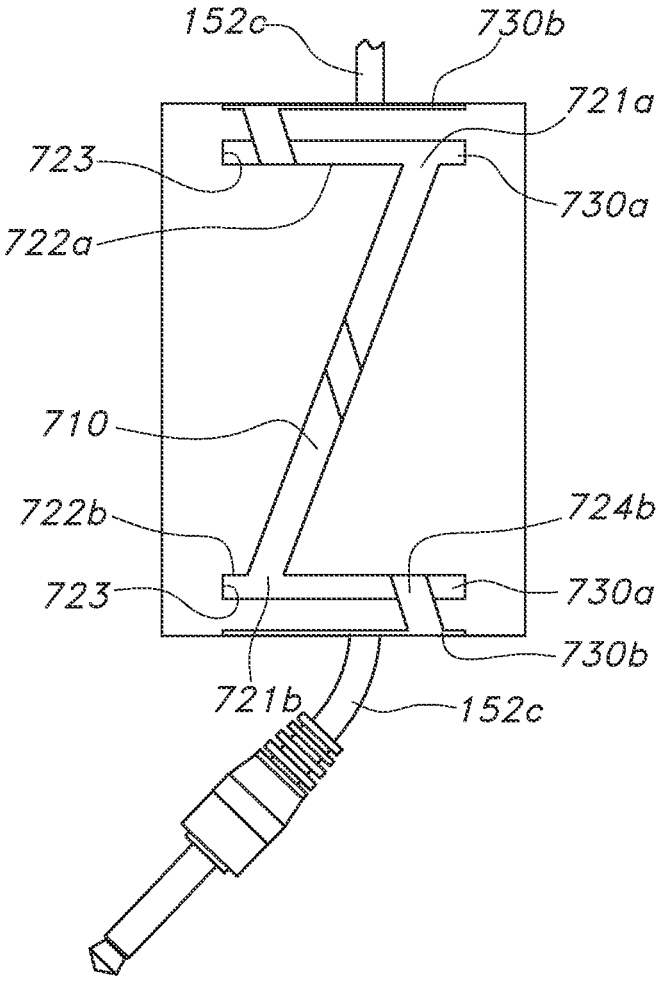

As viewed from the orientation of FIG. 7D, when an earphone cord 152*c* extends through and straight across entrapment chamber 730*b*, the earphone cord segment 152*c* will not be aligned with the cord conduit 724*b* connected to the entrapment chamber 730*b*. The diagonally configured path across the entrapment chamber 730*b* therefore helps with preventing inadvertent cord alignment with a conduit when a cord extends straight across, or approximately so, the entrapment chamber. As discussed herein, the slanted or diagonal paths of the cord conduits 724*a* and 724*b* that are attached to the same entrapment chamber 730*a* are not aligned symmetrically throughout the entire length of either cord conduit 724*a* or 724*b*. Thus, when an earphone cord 152*c* is transitioned from the entrapment chamber 730*b* via cord conduit 724*b* into entrapment chamber 730*a*, the ends of the earphone cord 152*c* extending out of the entrapment chamber 730*a* would have to be moved in opposite lateral directions in order to be aligned with the cord conduit 724*a*, which would aid in preventing inadvertent dislodgement of the adaptor 700 from an earphone cord. The earphone cord 152*c* would need to have one end of the cord moved or forced in one direction and the other end of the cord moved or forced in the opposite direction in order to be aligned with the diagonal cord conduit 724*b*. After that movement, the reverse opposite forces on each end of the earphone cord would be required to align an earphone cord 152*c* with the cord conduit 724*a* that leads to the anchor slot entrance 712. These impediments help maintain an earphone cord within the anchor slot 710. Neither of the entire length of cord conduits 724*a* or 724*b* nor the areas of openings into the entrapment chamber 730*a* are aligned directly across from the other on the opposite opposing walls to which the conduits are connected. The linear cord conduits 724*a* and 724*b* cross over a common area 727 of the entrapment chamber 730*a* to form a crossing pattern or "X" when perceived or viewed from above the anchor slot 710 as illustrated in FIG. 7D. The cord conduits 724*a* and 724*b*, which are connected to the entrapment chamber 730*a*, are transverse with respect to each other across an area within the entrapment chamber 730*a* but are on opposing sides of the entrapment chamber 730*a*. No portion of the exterior open ends of the cord conduits 724*a* is positioned directly across from the exterior open ends of the cord conduit 724*b* on the opposing side of the entrapment chamber 730*a*, yet a segment of the length of each cord conduit 724*a* and 724*b* (e.g. the center of the "X" pattern) is positioned directly across from the respective opposing cord conduit, as the cord conduits 724*a* and 724*b* extend across a common area of the entrapment chamber 730*a*. This directionally opposite orientation of the diagonal cord conduits 724*a* and 724*b* on opposing sides of the same entrapment chamber 730*a* provides the advantages discussed herein.

The cord conduit 716*b* of cord containment slot 716 is connected in the same diagonal or slanted manner to the entrapment chamber 716*a* as the cord conduit 724*a* is connected to entrapment chamber 730*a* and provides the advantages as discussed herein. The diagonal connection areas between internal pathways of the slots may be configured in numerous arrangements between like or different earphone cord pathway types. The manner of diagonal configuration of the linear cord conduits that extend across sidewalls of entrapment chambers that are designated for compressing earphone cords as illustrated and discussed in association with FIGS. 7A, 7B, 7C, and 7D may also be utilized as the manner of connection of cord conduits and entrapment chambers in other cord containment adaptor embodiments discussed herein. The embodiments of FIGS. 1A-7D are particularly adapted for use with rounded earphone cords.

Figure 8A:
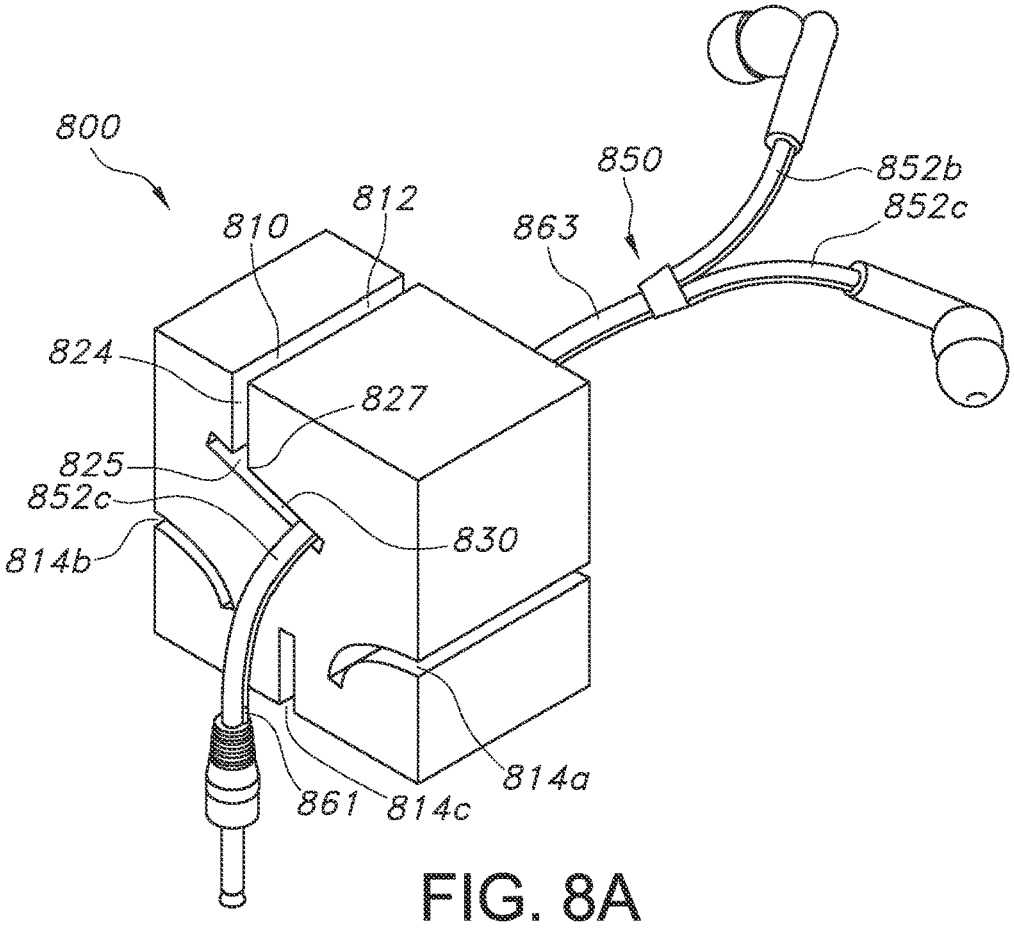
FIGS. 8A, 8B, and 8C are views of a cord containment adaptor in accordance with an embodiment of the invention for use with an earphone set with ribbon type cords.

Referring to FIGS. 8A (perspective view) and 8B (front view), another embodiment of a cord containment adaptor is illustrated. A back view (not shown) is the mirror image of the front view of FIG. 8B, and the rectangular side view, as can be seen in the perspective view of FIG. 8A, is the mirror image of the side on the opposite side of the adaptor 800. The cord containment adaptor 800 is operative to be fixed on an earphone set 850 that has a flat or ribbon type profile or cross section, where the thickness of the earphone cord segments is significantly less than the width of the earphone cord segments. The earphone set 850 has cord segments 852*a*, 852*b*, and 852*c* each with a ribbon type or flat profile. The cord segment 852*c*, for example, has a thickness 861 and a width 863. The length of the cord segment 852*c* extends along the dimension from the plug 868 to the junction 866. In ribbon type earphone cords, as referenced herein, the width 863 is at least twice the thickness 861 and for many ribbon type cords, the width 863 is at least three times the thickness 861. The thickness 863 of many ribbon type earphone cords is about 1 mm and the width typically ranges from 3-5 mm. Ribbon type earphone cords may be interchangeably referred to herein as ribbon earphone cords.

The cord containment adaptor 800 is illustrated as a rigid adaptor with a rigid anchor slot 810 and cord containment slots 814*a*, 814*b*, and 814*c*. The anchor slot 810 has an anchor slot entrance 812, a cord conduit 824, and an entrapment chamber 830 that each extend all the way through the cord containment adaptor from one open-ended side to the corresponding open-ended side as discussed in connection with other embodiments of cord containment adaptors described herein. The configuration or orientation of the entrapment chamber 830 is transverse and slanted with respect to the cord conduit 824 relative to the orientation of the cord path extending from the anchor slot entrance to the cord path within the entrapment chamber 830. The cord conduit 824 is connected to the side of the entrapment chamber 830 at an oblique angle. The entrapment chamber 830 has a section that slants downward away from the anchor slot entrance 812 and downward and away from the connection point of the cord conduit 824 with the entrapment chamber 830. The entrapment chamber 830 is not perpendicular to the cord conduit 824 with respect to the depth-wise orientation from the anchor slot entrance 812 to the terminal end of the anchor slot, which in the FIGS. 8A and 8B terminates in entrapment chamber 830. This slanted connection structure or orientation of the entrapment chamber 830 and cord conduit 824 is a feature that enables a cord containing a flat or ribbon profile to be accommodated and positioned in a rigid anchor slot of the cord containment adaptor 800. The slanted connection structure aids in facilitating the insertion of a flat profile earphone cord into an entrapment chamber. If an anchor slot was rigid and had cord conduits and entrapment chambers connected at ninety degree angles and in which both the conduit and chamber are configured to compress or grip the intended earphone cord near the connection area, a ribbon type earphone cord would not typically be flexible enough to bend at ninety degree angles to make the transition from one channel to another channel at the point or area of connection of the cord conduit and cord chamber. Ribbon type earphone cords are not constructed for substantial widthwise bending around a perpendicular corner. By providing an entrapment chamber 830 oriented as illustrated and described herein, an angular or slanted transition area beyond ninety degrees is provided to enable a ribbon type or flat profile earphone cord to transition from the cord conduit 824 to the entrapment chamber 830 and vice versa, particularly in a rigid anchor slot construction. This slanted structure or configuration is useful when both the cord conduit and entrapment chamber have approximately the same gripping or compressing distance between the respective sidewalls of the respective cord conduit and entrapment chamber near the area of connection of the two elements. This enables a ribbon type earphone cord of a particular width and thickness to be gripped and moved along a rigid pathway of the anchor slot conveniently by a user. Angling the entrapment chamber 830 with respect to the cord conduit 824 in the depth-wise dimension of the entrapment chamber provides a structure that enables the gapped apart walls of the cord containment passages to remain narrow yet enables a ribbon type earphone cord to transition between the different pathways while being sufficiently compressed or gripped in an entrapment chamber or channel during the transition process to keep a cord containment adaptor 830 fixed on the earphone cord segment 852*c*. Maintaining gripping or compression spacing along or throughout most of the anchor slot earphone cord pathway helps ensure the cord containment adaptor 800 does not inadvertently move on an earphone cord.

Figure 8B:
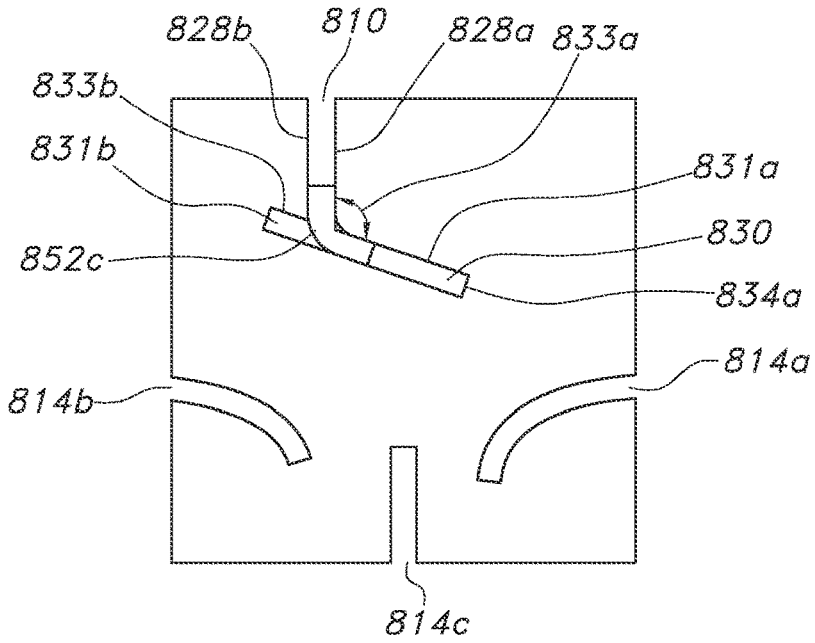

Referring to FIG. 8B, the sidewall 831*a* of the earphone cord entrapment chamber 830 slants or slopes at a first angle 833*a* away from the parallel sidewalls 828*a* and 828*b* of the earphone cord conduit 824. The section of the entrapment chamber 830 between the sidewall 831*a* and the side opposing sidewall 831*a* slants at the angle 833*a*. The sidewall 828*b* forms an angle 833*b* with the sidewall 831*b*. The angle 833*a* is more than ninety degrees and the angle 833*b* is less than ninety degrees. The sum of the angles 833*a* and 833*b* formed along the side comprising the sidewall 831*a* and 831*b* equal one hundred eighty degrees. An angle 833*a*, of at least 110 degrees, can aid in the transition of a cord from the cord conduit 824 into entrapment chamber 830. Configuring the angle 833*a* to be greater than one hundred ten degrees would make the transition easier for a given ribbon type earphone cord segment. An angle of less than one hundred and eighty degrees should be sufficiently sized to provide wall space to support the walls between the entrapment chamber and the cord conduit on either side of the cord conduit that intersects or adjoins with the entrapment chamber. An angle 833*a* of about 115-135 degrees provides an adequate transition angle for many typical ribbon cords that have a thickness of about 0.8-1.2 mm and a width of 3-5 mm. The angle 833*a* enables the ribbon type earphone cord segment 852*c* to transition at an angle from the cord conduit 824 to entrapment chamber 830. A representation of the widthwise cross-section of the cord segment 852*c* is shown completely transitioned and gripped in entrapment chamber 830 in FIG. 8A. The slope between the cord conduit 824 and entrapment chamber 830 provides an angular or slanted transition area from the earphone cord conduit 824 to the earphone cord entrapment chamber 830. The entrapment chamber 830 is adjoined to and crosses the cord conduit 824*c* and at a non-perpendicular angle.

The slanted transition area includes the area in the entrapment chamber 830 that is directly below cord conduit 824 and that extends out along the width of entrapment chamber 830 that is slanted down away from the cord conduit 824 towards the short sidewall 834*a* defining the widthwise end of the section of the entrapment chamber 830 that is slanted down at the angle 833*a*. It is advantageous for the slanted transition area that extends down away from the cord conduit 824 to be configured to be wider than the width of a ribbon type earphone cord segment that is intended to be anchored in the anchor slot to ensure that the ribbon cord can entirely transition into the entrapment chamber 830. A distance greater than 5 mm between the opening of the cord conduit 824 into the entrapment chamber 830 and the end of the section of the entrapment chamber 830 that is slanted down at the angle 833*a* will work for many ribbon type earphone cords. After a ribbon type earphone cord is entirely transitioned into the entrapment chamber 830, the ribbon type earphone cord can be moved to either side of the cord conduit 824 within the entrapment chamber 830. A width or distance for a slanted transition area that is at least four to five times the gripping or compression distance between walls is sufficient for many ribbon type earphone cords. A slanted transition area width greater than five times the gripping or compression distance provides further assurance that the transition area will be sufficient for a variety of ribbon type earphone cords. Although the length of the width of the section of the entrapment chamber 830 (FIG. 8B) on one side of the cord conduit 824 is illustrated as being shorter than the length of the width of the section of the entrapment chamber on the other side of the cord conduit 824, the illustrated shorter section can be constructed to be equal to or longer than the other section. Having each section of the entrapment chamber 830 on either side of the cord conduit 824 to be configured to be 5 mm or greater can ensure that most ribbon type earphone cord segments can be positioned on either side of the cord conduit 824.

Because the width 863 of a ribbon cord is significantly more than the thickness 861, the width of the opening 825 at the connection area of the cord conduit 824 with the entrapment chamber 830 can be wider than the thickness 861 of the ribbon cord but the width of the opening 825 should be narrower that the width of the ribbon cord. The corners or edges of the opening 825 or the width of the opening 825 help maintain the cord within the entrapment chamber. If the opening 825 was as wide as or nearly as wide as the ribbon cord, the cord containment adaptor would more easily slide along the length of the cord segment 852*c* or become dislodged when the ribbon cord extends in alignment between the edges or gap of the opening 825. In FIG. 8A, the edge 827 on the interior opening 825 at the point of connection or transition from the cord conduit to the entrapment chamber is shown as slightly rounded which further aids in the transition of a ribbon type earphone cord into another channel or earphone cord pathway. It should be appreciated that the angled transition can be made with a non-rounded edge or connection point between the cord conduit and entrapment chamber.

Figure 8C:
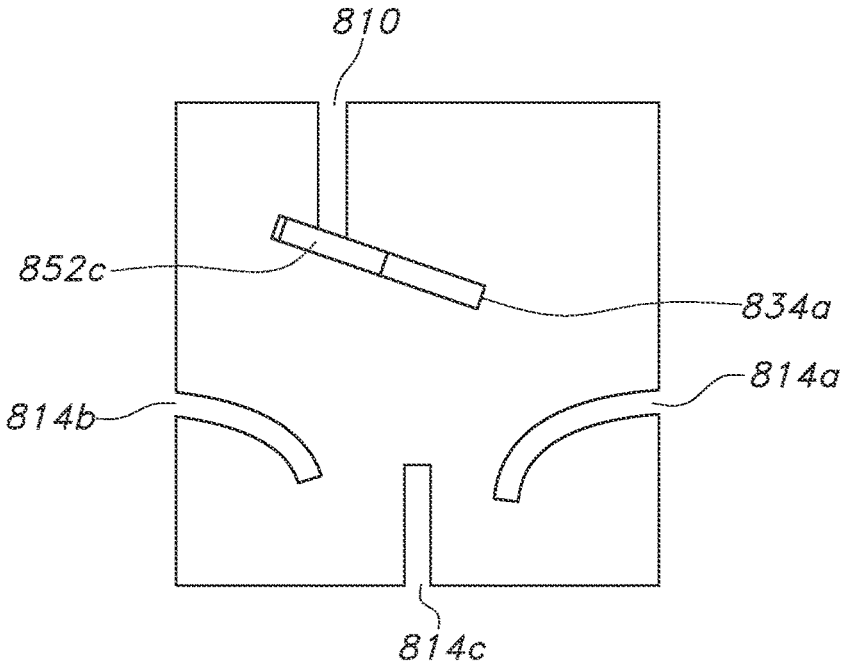

As illustrated in FIG. 8C, once fully transitioned into the entrapment chamber 830, both the offset of the cord conduit 824 with respect to the ends of the entrapment chamber 830 and the grip due to the opposing walls that compress or grip the ribbon type earphone cord help anchor the cord containment adaptor 800 on the cord segment 852*c* as shown by the representation of the widthwise cross-section of cord segment 852*c*. The cord conduit 824 is offset from the ends of the entrapment chamber as discussed herein. With an offset, a ribbon cord can be partially or entirely positioned on either side of the cord conduit 824 and compressed or gripped within the entrapment chamber 830 on either side of the cord conduit 824. The rigid walls that compress or grip a ribbon type earphone cord are spaced apart at least 0.7 mm. A distance between opposing gripping walls near 1 mm is sufficient for gripping many ribbon earphone cords and supporting a cord containment adaptor on an earphone cord.

The thickness of ribbon type earphone cords does not typically compress as much as rounded earphone cords.

The cord containment slots 814*a*, 814*b*, and 814*c* are quick release slots and only have a single pathway or channel that is configured to grip or compress the thickness 861 of a ribbon earphone cord inserted through the anchor slot entrance 812. The ribbon type cord segment does not have to incur impediments when received within or pulled out of the slots 814*a*, 814*b*, and 814*c* beyond the grip on the cord between the gapped-apart opposing sidewalls of each slot. The cord containment slots 814*a* and 814*b* are curved single channel pathways with cord gripping or compressing gapped-apart walls that extend entirely through the cord containment adaptor. The curvature of the slots 814*a* and 814*b* provides a path that requires more directional guidance to dislodge a ribbon type cord from the slots than the straight slot 814*c* illustrated. The cord containment slots 814*a*, 814*b*, and 814*c* do not have an edge or impediment at the entrance of the slots nor do the opposing sidewalls forming the slot narrow at the entrance of the slot. The quick release slots are better suited to provide inadvertent dislodgement of a cord if the quick release slots are at least as deep as the width of the ribbon type cord to be contained, and quick release cord containment slots for ribbon cords that are near twice the width of the ribbon cord intended for the slot provides more resistance to dislodgement. Quick release slots that are 3.5-11 mm in depth are suitable for many ribbon type earphone cords.

Like other cord containment adaptor embodiments shown herein, the cord containment adaptor 800 provides two types of slots that can be connected to and released from an earphone cord by hand, where one type slot is a cord releasable anchoring slot structured to anchor the cord containment adaptor to an earphone cord and the other type of slot is a quicker release slot that can be utilized to secure the loose ends of earphone cord segments on the adaptor firmly enough to resist inadvertent dislodgement. Embodiments of quick release slots are structured to enable a user to remove a cord from the slot without directing the cord through more than one channel within the quick release slot and/or to provide a configuration that enables easier removal of a cord segment from the quick release slot than from an earphone cord anchored in the anchor slot of the cord containment adaptor.

Figure 9A:
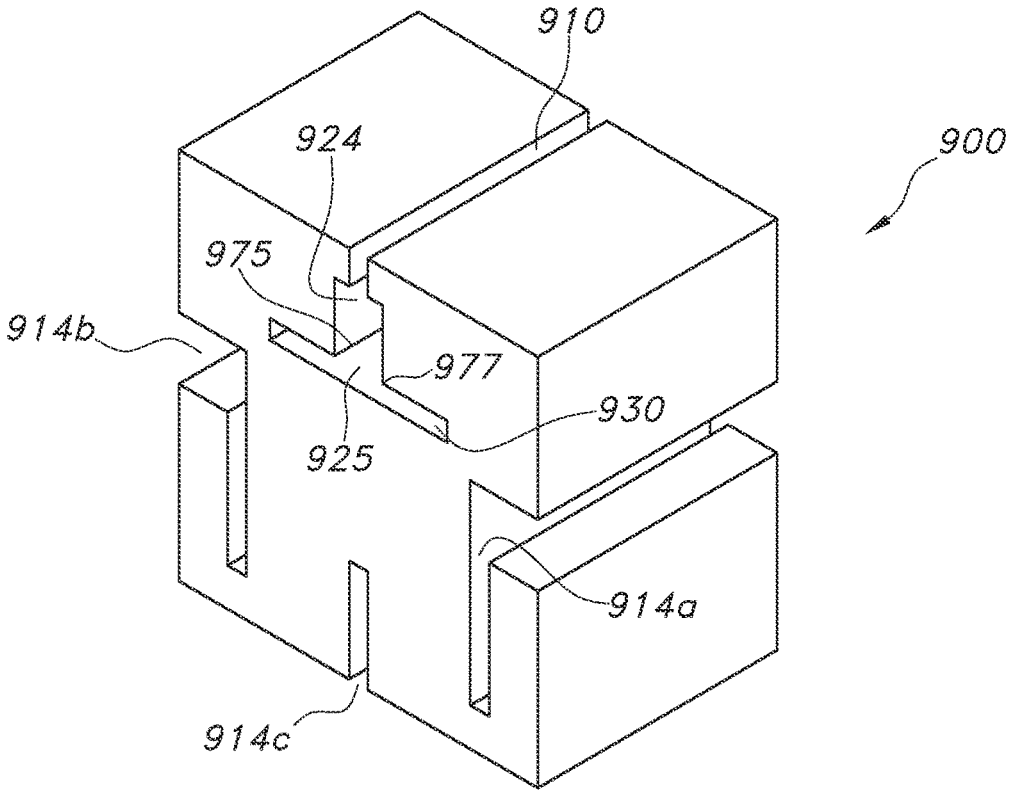
FIGS. 9A, 9B, and 9C are views of a cord containment adaptor in accordance with an embodiment of the invention for use with an earphone set with ribbon type cords.

Referring to FIGS. 9A (perspective view) and 9B (front view), another embodiment of an earphone cord adaptor is illustrated. A back view (not shown) is the mirror image of the front view of FIG. 9B, and the rectangular side view, as can be seen in the perspective view of FIG. 9A, is the mirror image of the side on the opposite side of the adaptor 900. Like the cord containment adaptor 800 discussed in association with FIGS. 8A and 8B, the cord containment adaptor 900 is operative to be fixed on an earphone cord that has a flat or ribbon type profile, where the thickness of the earphone cord is significantly less than the width of the earphone cord. The cord containment adaptor 900 is shown as a rigid adaptor that has a rigid anchor slot 910 and rigid quick release cord containment slots 914*a*, 914*b*, and 914*c*. The anchor slot 910 has an anchor slot entrance 912 opening on the exterior of the adaptor 900, a cord conduit bend chamber 924, and an entrapment chamber 930.

Figure 9B:
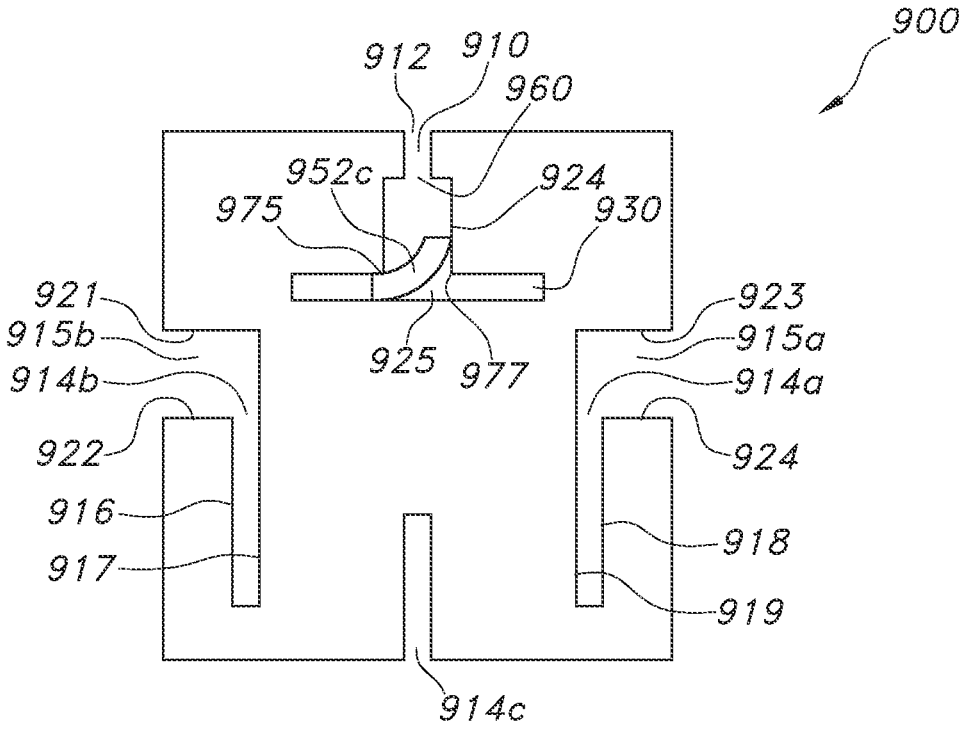

The cord conduit bend chamber 924 has a transition section at the opening 925 or area of connection of the cord conduit bend chamber 924 into the entrapment chamber 930, where the transition section is wider than the thickness of a ribbon type earphone cord but is narrower than the width of the ribbon type earphone cord. The cord conduit bend chamber 924 provides a volume at and directly adjacent to the point of connection of the cord conduit bend chamber 924 with the entrapment chamber 930, and the volume of the area is large enough for a widthwise cross-section of the a ribbon type earphone cord 952*c* to bend sufficiently to be slid or transition into an attached entrapment chamber 930 as illustrated in FIG. 9B. The bend chamber 924 aids in facilitating the insertion of a flat profile earphone cord into the entrapment chamber 930. The cord conduit bend chamber 924 opens into the side of the entrapment chamber 930. The bend chamber volume, in proximity to the connection point, is structured for the ribbon cord to be fed or to be bent back into the cord conduit bend chamber 924 from the entrapment chamber 930 after an earphone cord is within the entrapment chamber 930. The sidewalls defining the volume or area where the cord bending occurs are not structured to compress or grip the thickness of a ribbon type cord in the bend area of the bend chamber 924. The bend chamber walls are located between the exterior earphone cord entrance 912 and the opening 925. The bend chamber 924 also has a narrow slit or gap 960, which is positioned at a distance away from the opening 925, that is narrower than the opening 925. The illustrated gap 960 is located at the anchor slot entrance 912 at the end of the bend chamber that is positioned at the end of the bend chamber opposite the opening 925. The gap 960 helps to maintain an earphone cord within the bend chamber 924 if the ribbon type earphone cord is inadvertently pulled into the bend chamber 924 from the entrapment chamber 930. In addition to the illustrated structure, the volume dimensions or wall structure of the cord conduit bend chamber 924 can narrow or taper to a narrow gap opening, like gap 960, or may extend up in parallel to be co-extensive with the entrance opening of the cord conduit bend chamber 924 that opens to the exterior of the cord containment adaptor 900.

Figure 9C:
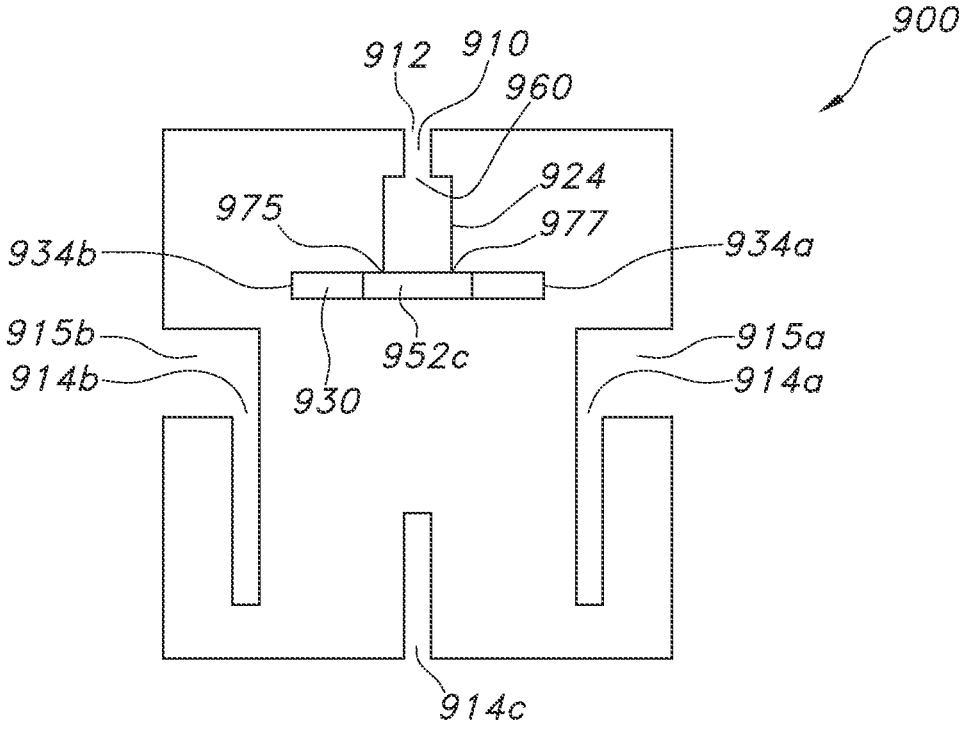

The walls defining the area or width of the opening 925 should be wide enough to allow one side of the ribbon type cord to be partially fitted between the gapped-apart compression or gripping walls in the below entrapment chamber 930 and then for the opposite side of the ribbon type cord to be slid or transitioned on the opposite side of opening 925 into the entrapment chamber 930, while also being narrow enough to maintain support of the cord containment adaptor 900 on the ribbon cord within the entrapment chamber after the ribbon cord is fully inserted into the entrapment chamber 930. Referring to FIG. 9C, the edges 975 and 977 defining the opening 925 are gapped apart or spaced at a distance that enables a ribbon cord to be bent and slid into the below entrapment chamber and yet are narrower than the width of a ribbon cord to enable a ribbon cord to be held within the entrapment chamber when a ribbon cord is positioned along the width of the gap between the two edges defining the width of the opening 925. The edges of the opening 925 and distance between the edges, as well as the bend chamber area or volume are fixed in a rigidly structured adaptor and anchor slot. Consequently, these features, such as the gap or distance between the edges or area or volume defined by the rigid bend chamber may remain fixed and need not expand when an earphone cord is bent into or out of the bend chamber between the edges. An earphone cord can be bent or transitioned into or out of either the bend chamber 924 or entrapment chamber 930 via the open volume provided at the opening of the entrapment chamber without expansion of the gap, gap distance, or edges along the opening into the entrapment chamber 930.

The distance between the gapped apart opposing sidewalls defining the opening width of the opening 925 is greater than the distance between the pair of gapped apart opposing chamber sidewalls of the earphone cord entrapment chamber 930 that are structured to compress an earphone cord. For ribbon earphone cords, which typically range in width from 3 mm-5 mm, an opening width at the connection point that is greater than or equal to 1.7 mm and less than or equal to 3.3 mm is sufficient to maintain a cord containment adaptor on a ribbon cord for an appropriately matched ribbon cord within the typical ribbon type earphone cord width range. The width of the opening 925 configured to be about two-thirds of the width of the ribbon type earphone cord can ensure that enough space is provided at the opening 925 for bending a cord to fit within a connected entrapment chamber and small enough to prevent the ribbon type cord from inadvertently pulling through the opening 925. A width of the opening 925 (or distance between the edges of the gap) that is at least sixty percent larger than the distance between the opposing sidewalls of the entrapment chamber 930 that compress or grip a ribbon type earphone cord when the cord conduit and entrapment chamber are connected at ninety degree angles can provide enough space for bending certain ribbon type earphone cords, and yet provide edges wide enough to hold the ribbon type earphone cord in the entrapment chamber when the cord is positioned between the gap. A distance of 2 mm between the edges 975 and 977 is sufficient to support various cord containment adaptors for various ribbon type cords that have a width of 3 mm. For a ribbon cord that is 3 mm in width, the height of the bend chamber 924 area can extend up approximately 2 mm or greater from the connection point of the opening to provide sufficient volume for a ribbon cord of approximately 3 mm to fit within chamber 924 down to the entrapment chamber 930. The two edges 975 and 977 and the appropriate distance between the edges 975 and 977 in combination with the compression or grip provided by the gapped apart walls of the entrapment chamber that grip or compress the earphone cord segments hold a ribbon cord within the entrapment chamber and consequently, within the anchor slot 910.

The lower transition area for a ribbon type earphone cord includes the area in the entrapment chamber 930 that is directly below the cord conduit bend chamber 924 and that extends on along the width of entrapment chamber 930 on a side of the cord conduit bend chamber 924 towards either short sidewall 934*a* or 934*b* defining a widthwise end of the entrapment chamber 930. It can be advantageous for the lower transition area that is directly below the cord conduit 924 or opening 925 and out to either widthwise side of the entrapment chamber 930 to be configured to be wider than the width of a ribbon type earphone cord segment that is intended to be anchored in the anchor slot to ensure that the ribbon cord can entirely transition into the entrapment chamber 930. A lower transition area greater than 5 mm will work as a lower transition area for many ribbon cords. After the widthwise cross-section of the ribbon type earphone cord 952*c* is fully transitioned, the ribbon type cord can be moved to either side of the cord conduit bend chamber 924 within the entrapment chamber 930. The width or distance for the lower transition area along the entrapment chamber 930 for the adaptor 900 that is at least four to five times the gripping or compression distance between gapped apart sidewalls works for many ribbon type earphone cords.

The cord containment slots 914*a*, 914*b*, and 914*c* are quick release slots, with the cord containment slots 914*a* and 914*b* having a different structure than the cord containment slot 914*c*. The cord containment slots 914*a* and 914*b* have entrances 915*a* and 915*b* that are significantly wider than the respective gapped apart sidewalls 916, 917, 918, and 919 of the slots that are designated for compressing or gripping the thickness of a ribbon type earphone cord segment. The walls defining the entrances 915*a* and 915*b* are transverse to the sidewalls that grip or compress the earphone cord in the slots 914*a* and 914*b*. The entrances 915*a* and 915*b* are wider than both the thickness and width of a typical ribbon type earphone cord. Once a ribbon type cord is gripped in the slot, the quick release cord containment slots 914*a* and 914*b* do not have two edges, like the edges 975 and 977 shown in anchor slot 910, to entrap or hold an earphone cord in the entrapment chamber. The respective walls 921, 922, 923, and 924 defining the entrance section of the cord containment slots 914*a* and 914*b* that lead down to the sidewalls that compress or grip the ribbon type earphone cord are not offset from both ends of the respective gapped apart sidewalls of the slots 914*a* and 914*b* that compress or grip the thickness of a ribbon type earphone cord.

The cord containment slots 914*a* and 914*b* each have a slot pathway where one section of the pathway is orthogonal or perpendicular with respect to another section of the slot pathway of the respective slot. The walls 921 and 922 of quick release slot 915*b* are orthogonal to the walls 917 and 916 of the slot 915*b*. The wall 921 can serve as slight impediment or barrier wall for a cord exiting the opposing sidewalls 916 and 917 that are spaced to compress or grip an earphone cord positioned therebetween, particularly when the cord length is not aligned with the length of the slot entrance. The walls 921 and 922 can be gapped apart a distance that is less than the width of a ribbon cord segment but far enough apart to provide a bend area in which the ribbon type earphone cord can be bent and removed from the slot, in manner similar to the discussion in association with the bend chamber 924. The quick release slot 915*a* is constructed in the same manner as the quick release slot 915*b*. In the quick release slots 915*a* and 915*b*, the respective barrier walls 923 and 921 can force a ribbon cord pulled into either wall from the section orthogonal to it to bend upward toward the entrance of the respective slot. It should be appreciated that quick release slots as illustrated in connection with FIGS. 8A and 8B may be used in the cord containment adaptor as illustrated in FIGS. 9A and 9B and vice versa.

The entire body of each earphone cord containment adaptor, as shown in the figures, is configured to fit in or to be entirely encompassed within a 1 inch by 1 inch by 1 inch cubic volume or less. The illustrated bodies, however, or additional bodies, shapes and/or passageway configurations can be structured to exceed a 1 cubic inch volume, such as, for example, volumes of 1.25 inches by 1.25 inches by 1.25 inches or 1.5 inches by 1.5 inches by 1.5 inches. Each of these volumes is also sufficiently small to be supported by and convenient for transport on an earphone cord. When less volume is occupied by a cord containment adaptor, it is more convenient for the adaptor to remain dangling on and supported by an earphone cord and for placement in small pockets or purses. Earphone cord containment adaptors that will not fit entirely within a volume of 2.5 inches by 2.5 inches by 2.5 inches are generally not convenient for storage in small pockets or for dangling from earphone cords. It should be appreciated that each cord containment adaptor embodiment is suitable for a rigid construction throughout the embodiments, although some aspects an adaptor may have flexible sections and yield the advantages discussed herein. Cord containment adaptors can be any weight that can be supported on an earphone cord that will not create too much of a downward pull to cause easy dislodgement of the earpieces from a person's ears during use of the earphone set. Cord containment adaptors weighing 30 g or less are convenient for carrying and for attachment to earphone cords. Cord containment adaptors, however, can weigh more than 30 g and be suitable to meet advantages discussed herein.

Figure 10A:
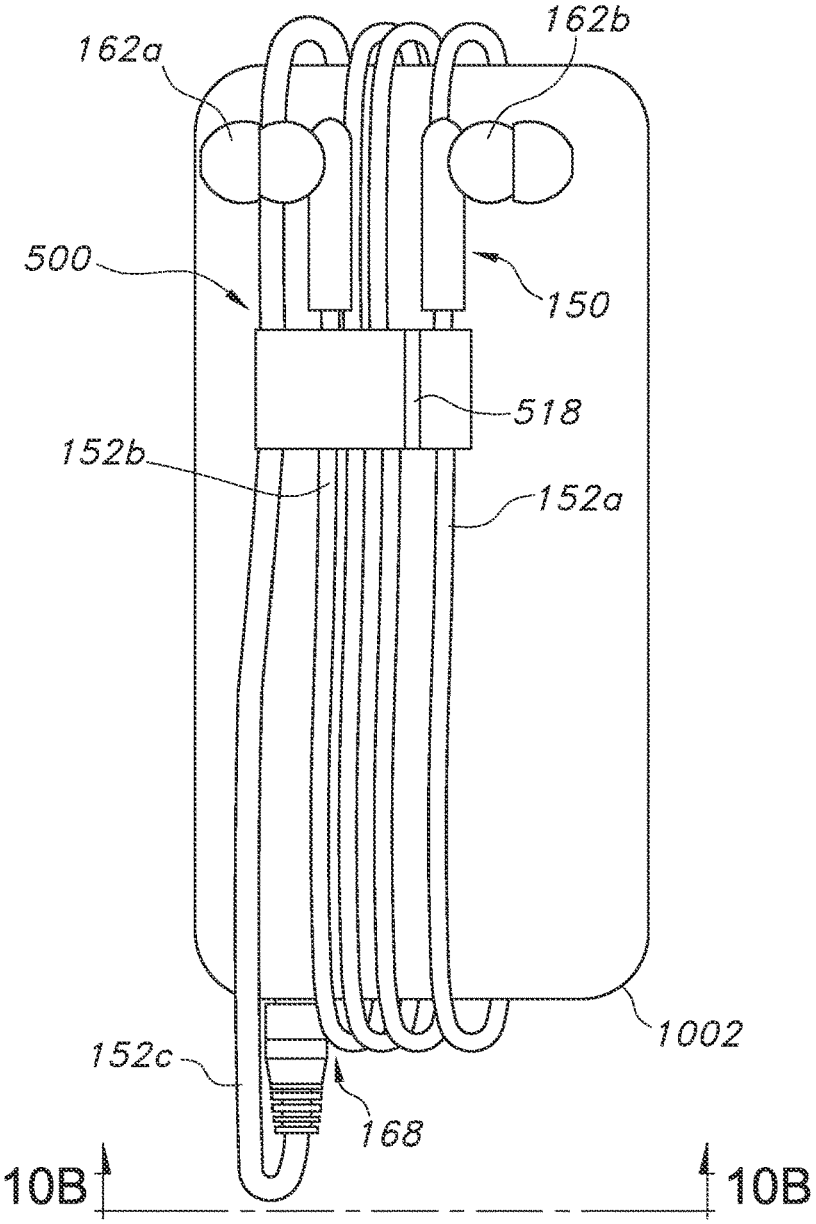
FIGS. 10A and 10B are views of the cord containment adaptor of FIGS. 5A and 5B secured to a set of earphones that are plugged into a mobile telephone via an earphone plug.

Referring to FIG. 10A, the cord containment adaptor 500 is shown attached to a set of earphones 150 that are plugged into a mobile telephone 1002 via earphone plug 168. The mobile telephone 1002 may be for example, an Apple iPhone 10, Samsung Galaxy 10s, or Xiomi Mi Mix 3. Many users of earphones and mobile telephones wrap the cord segments of their earphones around the mobile telephone when they store or discontinue use of the mobile telephone. When this is done, sometimes the cords become unraveled or the user must intertwine the loose ends of the cords, such as the ends containing the earpieces 162*a* and 162*b*, after they have been wrapped. The loose ends are not fixed and may move about and become more entangled or unravel entirely. Cord containment adaptors, like discussed herein such as the cord containment adaptor 500, when fixed on an earphone cord segment of a set of earphones can remain on a set of earphone cords and hold cord containment slots upward away from the media device via upstanding walls, thus enabling a user to clip loose ends of earphone cords that have been wrapped around a mobile phone into the cord containment adaptor 500 to form a closed loop around the telephone.

Figure 10B:
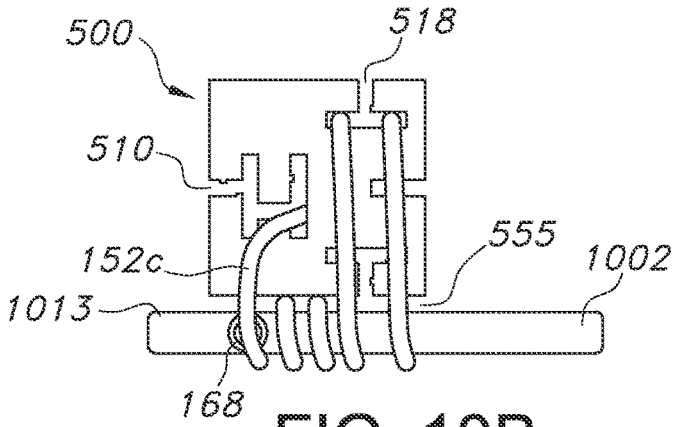
Figure 11C:
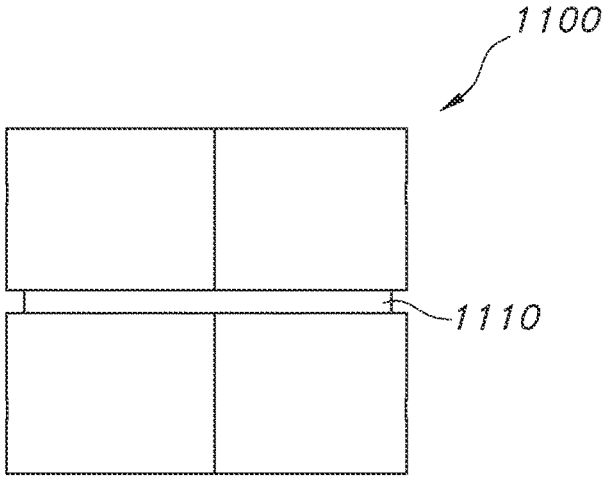
FIGS. 11A, 11B, 11C, 11D, and 11E are views of a cord containment adaptor 1100 in accordance with an embodiment of the invention.
Figure 11A:
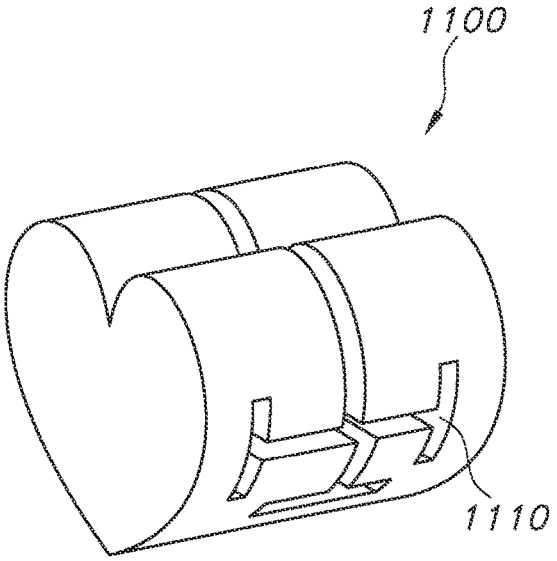
Figure 11D:
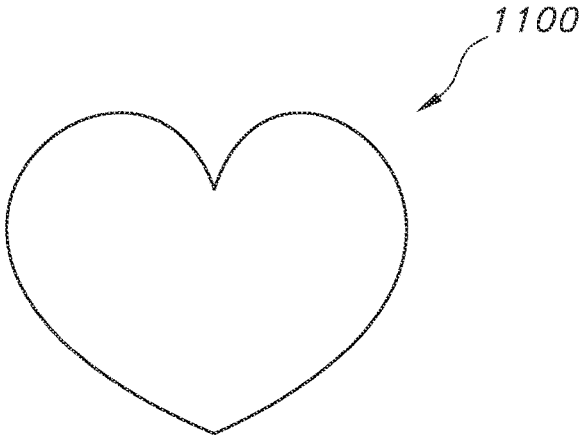
Figure 11B:
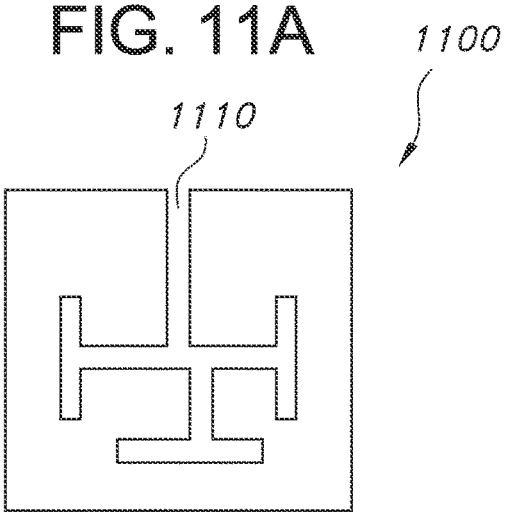
Figure 11E:
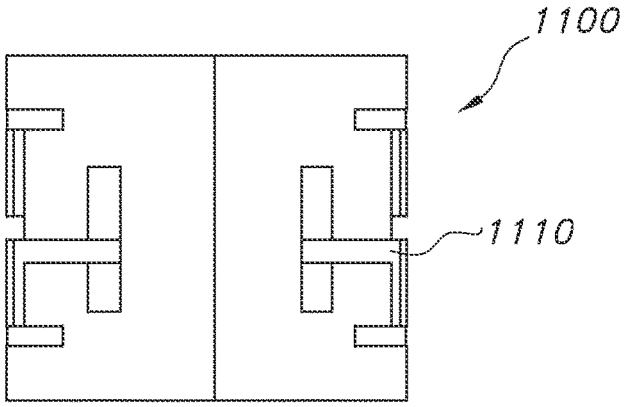
Figure 12A:
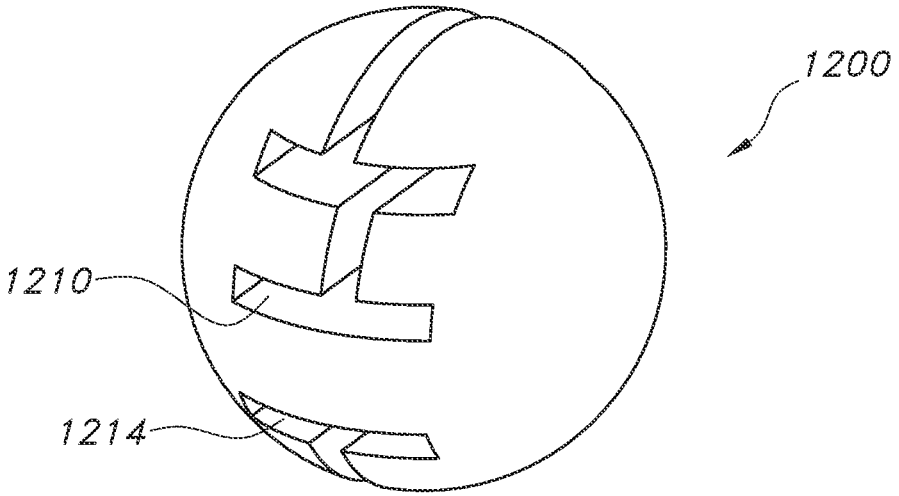
FIGS. 12A, 12B, 12C, 12D, and 12E are views of a cord containment adaptor 1200 in accordance with an embodiment of the invention.
Figure 12B:
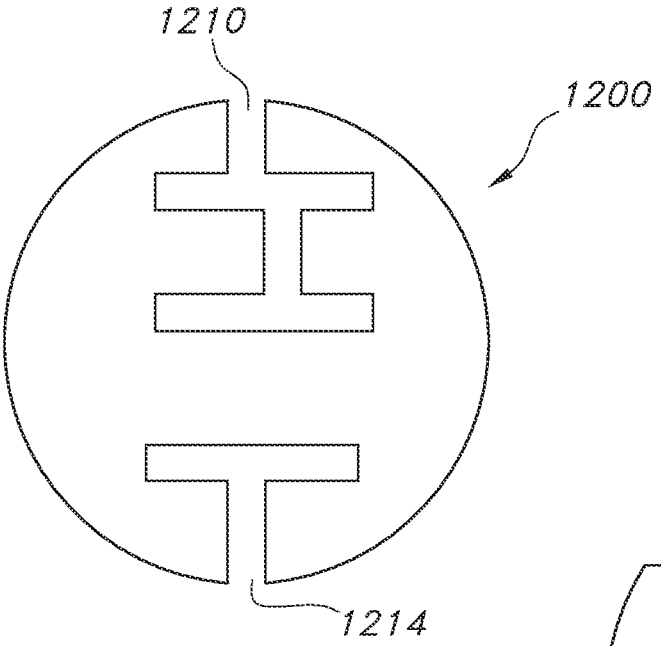
Figure 12C:
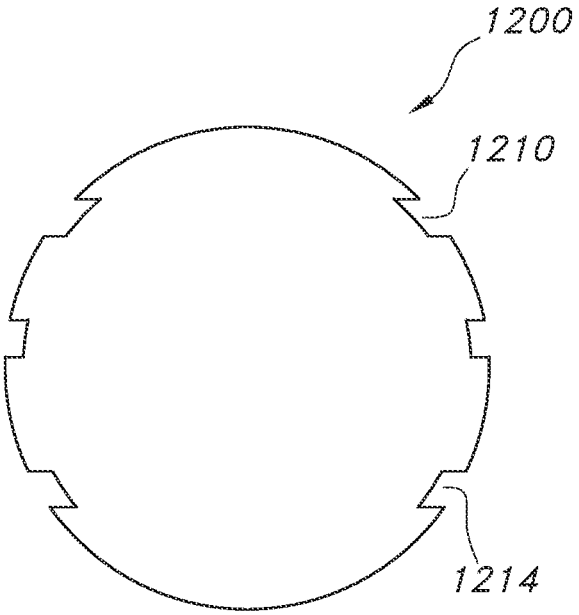
Figure 12D:
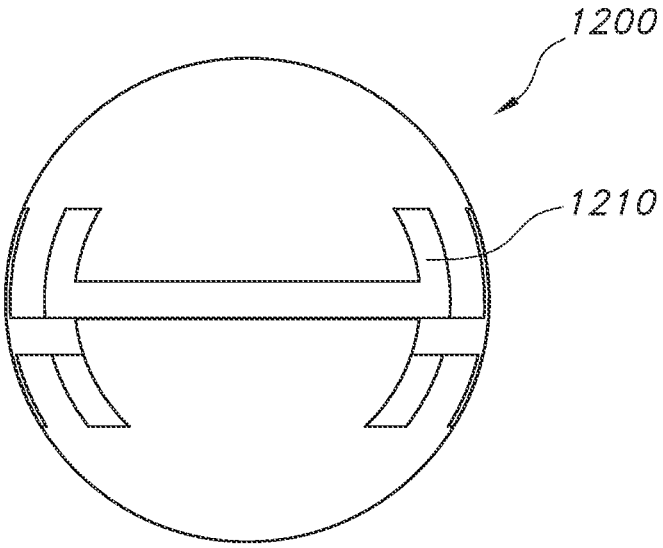
Figure 12E:
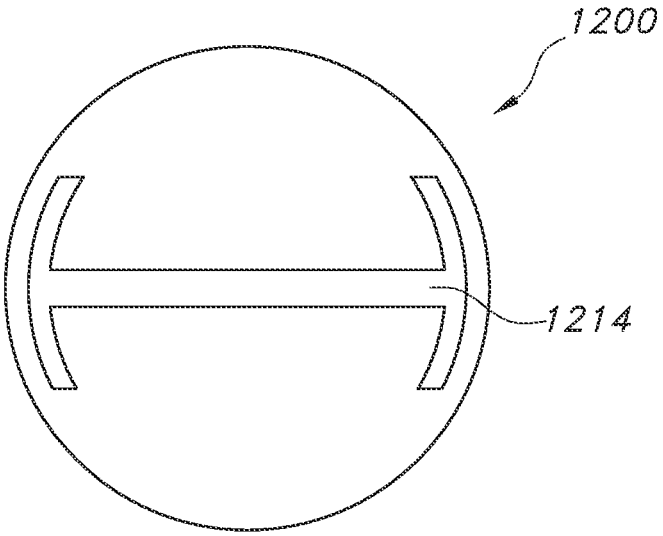
Figure 13C:
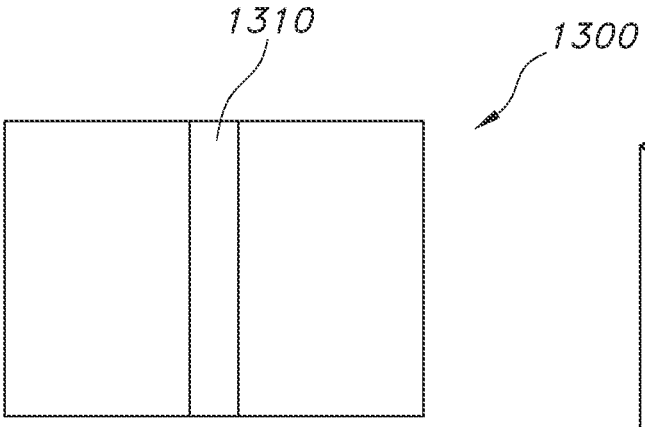
FIGS. 13A, 13B, 13C, and 13D are views of a cord containment adaptor 1300 in accordance with an embodiment of the invention.
Figure 13B:
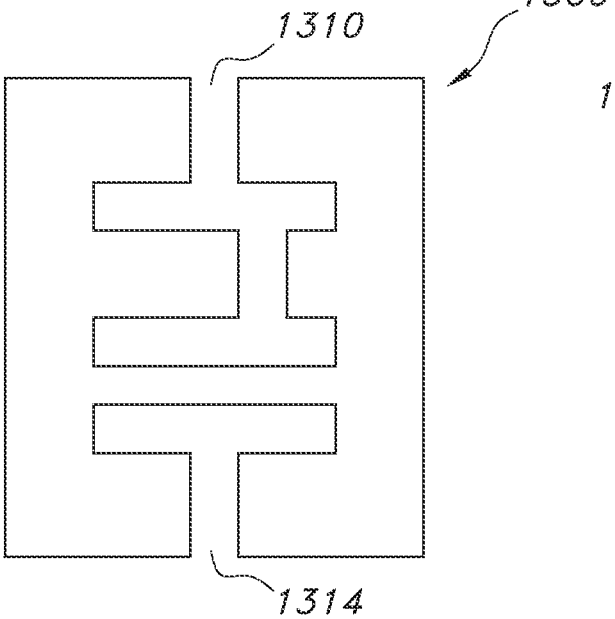
Figure 13D:
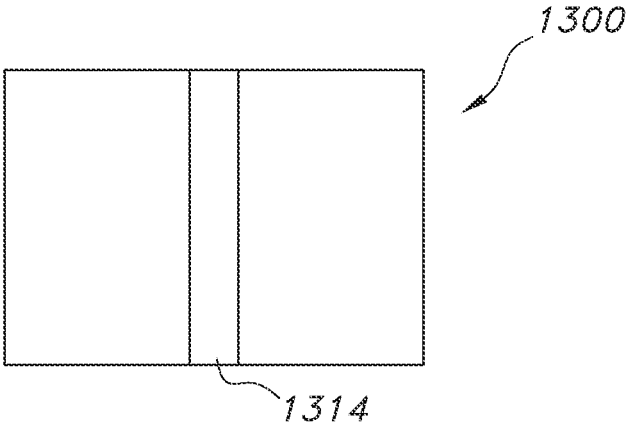
Figure 13A:
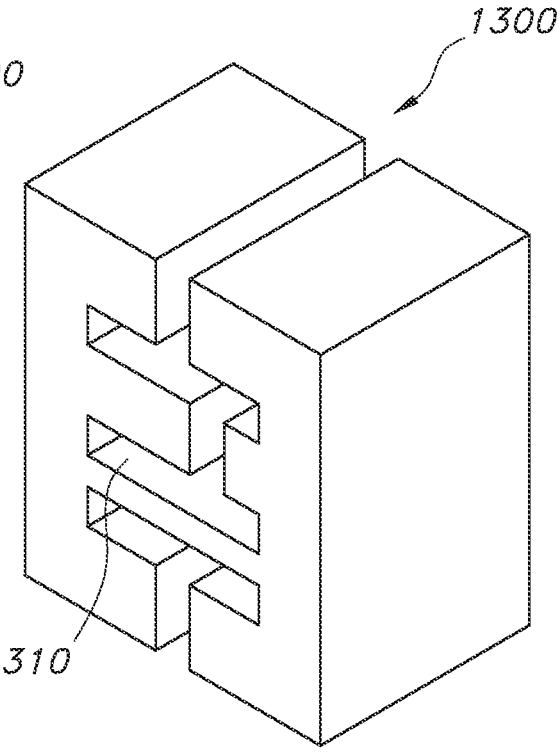

FIG. 10B is a side view taken along the line 10B-10B of the mobile telephone 1002 and cord containment adaptor 500 as shown in FIG. 10A. Referring to FIGS. 10A and 10B, the cord containment adaptor 500 has a support surface or base 555 that can rest or be positioned on a front or back planar surface 1013 of a mobile phone as shown, where the support base 555 has a wall or surface extending up therefrom that contains or supports another surface of the adaptor that contains cord containment slots that are positioned away from the support base or surface. The positioning of the cord containment slot 518 via a wall away from the support base enables cord segments to be inserted into cord containment slots that are held above the front or back surface 1013 of the telephone. The support base and adjacent walls of the adaptor 500 should be firm or wide enough to support the open ends of the passageway of the cord containment slot 518 above the support base 555. Walls that support the open ends of the cord containment slot at least 5-6 mm above the support base can provide the benefits of the cord containment adaptor 500 shown in FIGS. 10A and 10B. The cord containment slot 518 grips and contains the two earphone cord segments 152*a* and 152*b* that are wrapped around the media device when the media device is not in use. In FIG. 10A, the ends of earphone cord segments 152*a* and 152*b* are shown compressed into cord containment slot 518. In FIG. 10B, the earphone cord segment 152*c* is shown extending through the anchor slot through-passage of the cord containment adaptor 500. The other embodiments shown herein can be positioned on a mobile telephone in a similar manner as the cord containment adaptor 500 shown positioned on the mobile telephone 1002 to achieve like advantages.

Referring to FIGS. 11A-13D, various configurations of anchor slots are shown illustrated in various shaped embodiments of cord containment adaptors. Referring to FIGS. 11A, 11B, 11C, 11D, and 11E, a perspective view, a side view, top view, front view, and bottom view are respectively shown of an earphone cord containment adaptor 1100. An anchor slot 1110 configuration is shown illustrated in the heart-shaped cord containment adaptor 1100. A back view (not shown) of the cord containment adaptor that is on the opposite side of the front view (FIG. 11D) is the mirror image of the front view of FIG. 11D, and the side view (not shown) that is on the opposite side of the cord containment adaptor 1100 is the mirror image of the side view of FIG. 11B.

Referring to FIGS. 12A, 12B, 12C, 12D and 12E, a perspective view, a front view, a side view, a top view, and bottom view are respectively shown of an earphone cord containment adaptor 1200. An anchor slot 1210 and cord containment slot 1214 configuration are shown illustrated in the sphere-shaped cord containment adaptor 1200. A back view (not shown) that is on the opposite side of the cord containment adaptor 1200 of the front view (FIG. 12B) is the mirror image of the front view of (FIG. 12B), and the side view (not shown) that is on the opposite side of the cord containment adaptor 1200 is the mirror image of the side view of FIG. 12C.

Referring to FIGS. 13A, 13B, 13C, and 13D, a perspective view, a front view, a side view, a top view, front view, and bottom view are respectively shown of an earphone cord containment adaptor 1300. An anchor slot 1310 and a cord containment slot 1314 configuration are shown illustrated in the rectangular-cuboid shaped cord containment adaptor 1300. A back view (not shown) that is on the opposite side of the cord containment adaptor 1300 of the front view (FIG. 13B) is the mirror image of the front view (FIG. 13B), and the side view (not shown) that is on the opposite side of the cord containment adaptor 1300 is the mirror image of the side view of FIG. 13C.

Figure 14A:
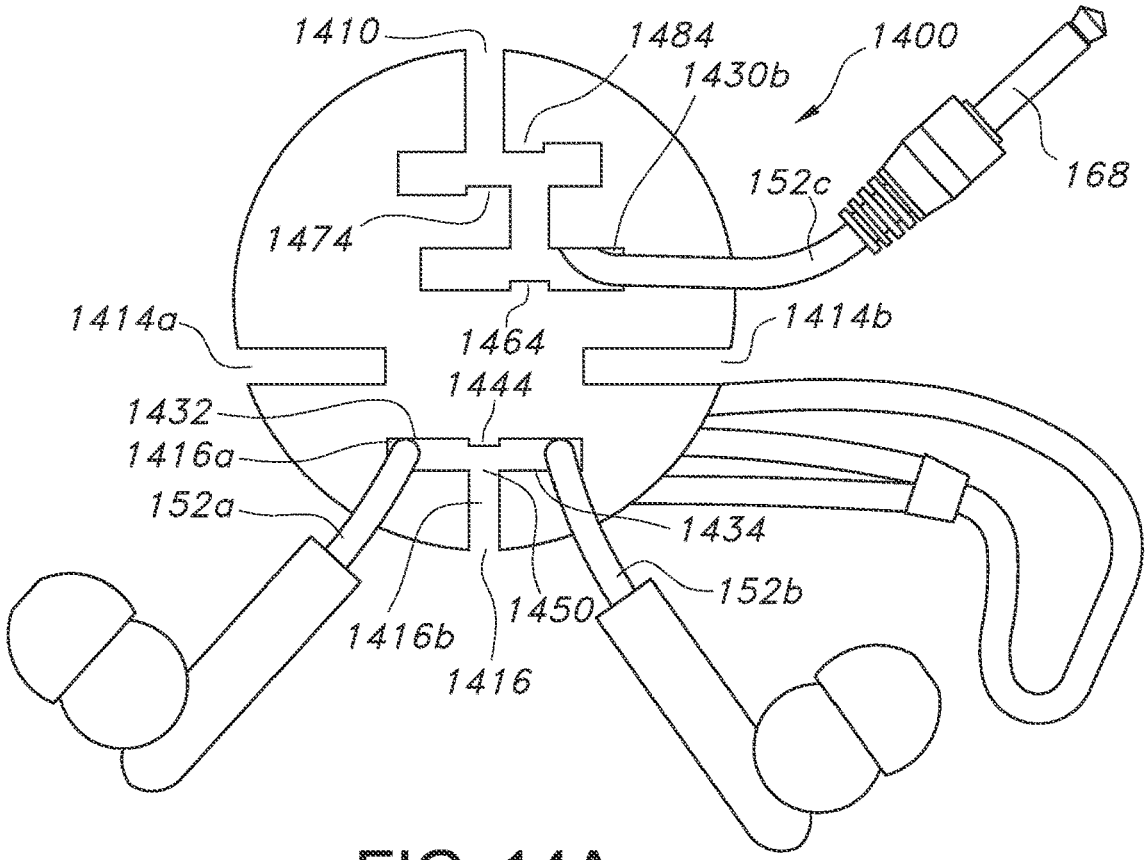
FIGS. 14A and 14B are views of a cord containment adaptor in accordance with an embodiment of the invention.
Figure 14B:
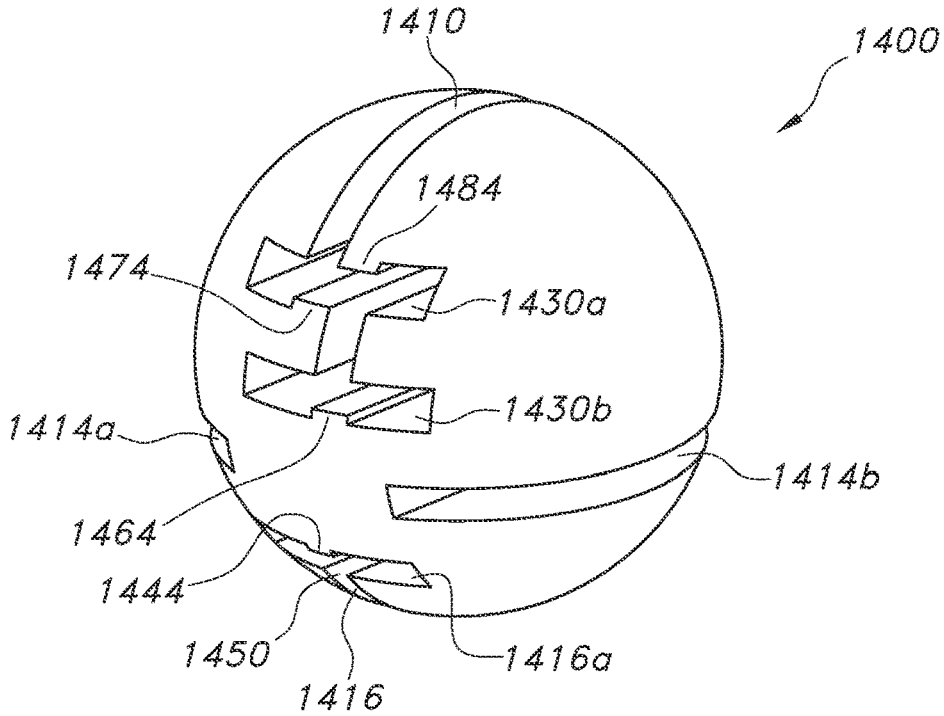

Referring to FIGS. 14A and 14B, another embodiment of a cord containment adaptor is illustrated. The cord containment adaptor 1400 is spherical and is constructed in the same general manner as the cord containment adaptor 300. The cord containment adaptor 1400 has an anchor slot 1410 and cord containment slots 1414*a*, 1414*b*, and 1416. The illustrated slots extend all the way through the adaptor from one open-ended side to the open-ended side on the opposite side of the adaptor in a manner that mirrors the openings shown, like the other cord containment adaptors illustrated herein. The cord segment 152*c* containing the plug 168 is shown compressed in the anchor slot 1410. The cord containment slot 1416 has a single entrapment chamber 1416*a* and a cord conduit 1416*b*, similar to the cord containment slot 316. As discussed in connection with FIG. 3, with the cord containment slot 1416, two segments of an earphone cord can be stored on either side of the cord conduit 1416*b*, where the cord segments 152*a* and 152*b* are shown compressed between the sides 1432 and 1434. The cord containment slot 1416 additionally includes a ridge 1444 positioned within the earphone cord entrapment chamber 1416*a* on the side 1432 and directly across from and near the opening 1450. The ridge 1444 extends across the length of the entrapment chamber 1416*a* from one open-ended side of the anchor slot to the opposing open-ended side of the anchor slot 1410. It should be appreciated that the ridge does not have to extend the full length of the entrapment chamber, and further, it should be appreciated that a series of ridges can be positioned along the length of a cord conduit opening rather than being a single long ridge.

The top or peak of the ridge 1444 provides a narrower gap between the peak and the opposite side 1434 than the gap between either section of the side 1432 adjacent to the ridge 1444 and the opposite side 1434. For an earphone cord positioned on either side of the ridge 1444, the ridge 1444 provides an impediment between or to the chamber opening 1450 and an exit of an earphone cord from the cord entrapment chamber 1416*a* via the chamber opening 1450. A force exerted on an earphone cord positioned on either side of the ridge 1444 must overcome the force or resistance of compression between the area adjacent to the ridge 1444 as well as additional resistance and the need for further compression as a result of the narrower gap in the entrapment chamber 1416*a* at the peak of the ridge 1444. Without a ridge located directly across the opening of a cord conduit into an entrapment chamber, a cord would more easily come to rest or get lodged at the cord conduit/chamber opening because a portion of the compressed cord would expand, to some extent, into the opening. An earphone cord can become lodged in the opening when the cord inadvertently is pushed or pulled toward to the opening. By providing a ridge across from the opening, a barrier or obstacle is provided in the entrapment chamber that the cord must rise above and overcome. The barrier within the earphone cord chamber and across from and adjacent to the opening makes it more difficult for an earphone cord to become lodged at the opening into the cord conduit and therefore, helps to maintain an earphone cord on either side of the ridge away from the opening to prevent inadvertent dislodgement of the cord containment adaptor from the cord. It should be appreciated that a ridge positioned across from a cord conduit opening should provide enough space for a cord to transition past the ridge when an intentional force is directed to move the cord past the ridge despite any additional compression that would occur due the height of the ridge.

Like noted in connection with the slot 316 (FIG. 3), a rigid cord containment slot containing an entrapment chamber, such as cord containment slot 1416 containing entrapment chamber 1416*a*, can serve as an anchor slot for an adaptor or an earphone cord attachment or object to be connected to an earphone cord. The cord containment slot 1416 is better equipped to stay anchored to an earphone cord than the slot 316 due to the ridge 1444 and the location of the ridge 1444 at and across from the opening 1450 as illustrated. Because the width of cord conduit 1416*b* is narrower than the diameter of an earphone cord designated for insertion into the conduit, an earphone cord positioned on the ridge 1444 would be further compressed on the perimeter of the cord between the ridge top and the sidewall opposite the ridge peak.

Like the structure and function of the ridge 1444, the ridge 1464 of the entrapment chamber 1430*b* helps prevent inadvertent dislodgement of an earphone cord segment, such as the segment 152*c*, from the entrapment chamber 1430*b* of the anchor slot 1410. The ridge 1464 is slightly wider than the width of the opening of the opening into the chamber. There is enough space on each side of the ridge 1464 for a cord to be held on either side of the ridge within the entrapment chamber, like shown in connection with entrapment chamber 1416*a*. For an anchor slot containing two entrapment chambers, such as anchor slot 1410, a ridge or ridges directly across from a cord conduit opening provides an extra measure of adaptor fixation to a cord, in addition to the intermediate entrapment chamber 1430*a* and non-linear off-set of an earphone cord pathway leading from the anchor slot entrance to the entrapment chamber 1430*b*. Similar to the ridges 1444 and 1464, the ridges 1474 and 1484 of the entrapment chamber 1430*a* help retain an earphone cord positioned in the wider compression area or gap adjacent to the ridges away from the cord conduit opening proximate to the particular ridge. The bi-level entrapment chambers 1430*a*, 1430*b* and 1416*a* of FIGS. 14A and 14B, with the ridge location directly across from the respective conduit openings, provides an enhanced barrier to movement of an earphone cord to the location of the entrance into to the respective cord conduit.

Figure 15A:
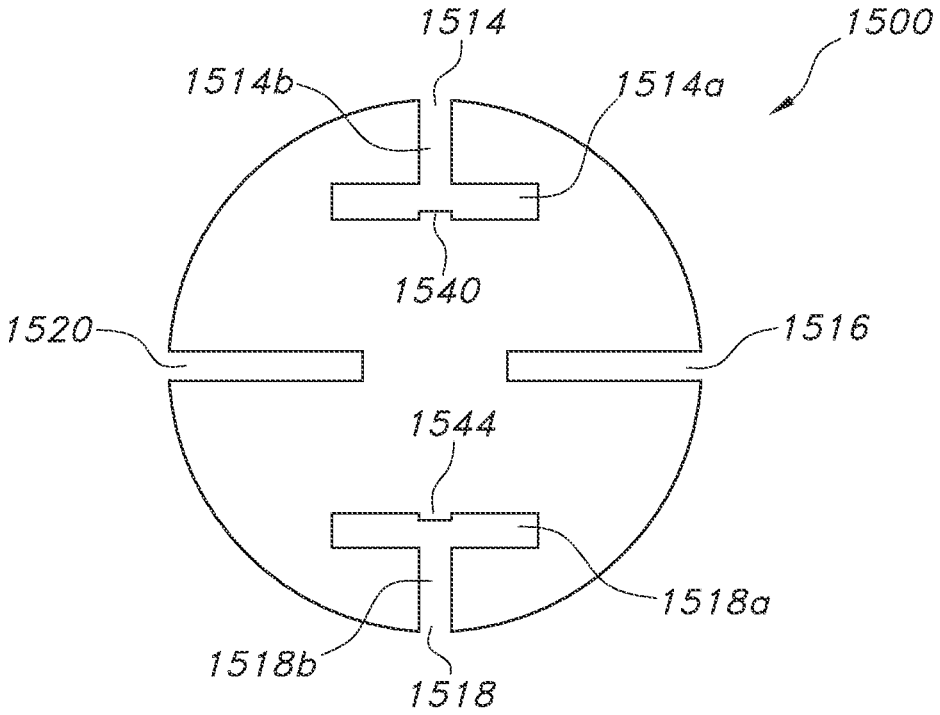
FIGS. 15A and 15B are views of a cord containment adaptor in accordance with an embodiment of the invention.
Figure 15B:
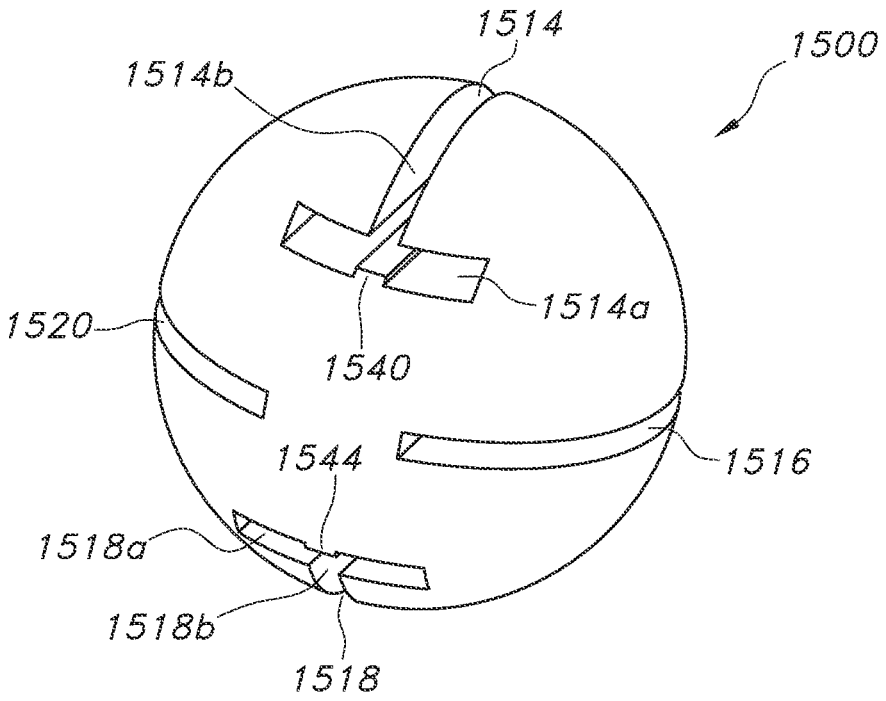

Referring to FIGS. 15A and 15B, another embodiment of a cord containment adaptor is illustrated. The cord containment adaptor 1500 has a spherical shape and has cord containment slots 1514, 1516, 1518, and 1520. Cord containment slots 1516 and 1520 are quick release linear compression slots as discussed herein. The cord containment slots 1514 and 1518 have entrapment chambers 1514*a* and 1518*a* and have cord conduits 1514*b* and 1518*b* constructed in the same manner as the cord containment slot 316 (FIG. 316) and cord containment slot 1416 (FIG. 14*a*). Each of the entrapment chambers 1514*a* and 1518*a* has ridges 1540 and 1544 respectively. Each of the ridges is positioned within the entrapment chambers directly across from the open end of the cord conduit that opens into each of the respective entrapment chambers, like discussed in connection with FIGS. 14A and 14B. The cord containment slots are positioned at spaced apart surface areas of the rigid spherical body at approximately ninety, one hundred eighty, and two hundred seventy degrees from every other slot. The positioning of the cord containment slots on surfaces, as illustrated, enables the adaptor 1500 to be used to secure earphone cords when they are wrapped around a mobile phone as discussed in connection with FIGS. 10A and 10B. In this embodiment, the single rigid entrapment chambers of cord containment slots 1514 and 1518 can serve to anchor the adaptor 1500 to a cord and serve to contain cord segments or loose ends of a set of earphones. The sizes of each of the anchor slots of the single adaptor 1500 can be different to accommodate variously sized cord diameters of a single earphone set or multiple earphone sets. The cord containment adaptor 1500 provides a measure of universality in a compact rigid structure of the entire body of the adaptor 1500. It should be appreciated that an adaptor or earphone cord holder can be anchored permanently on an earphone cord where an additional slot, like a cord containment slot 1514 with a ridge positioned directly across from the conduit opening can be used to secure the loose ends of an earphone cord.

Figure 16A:
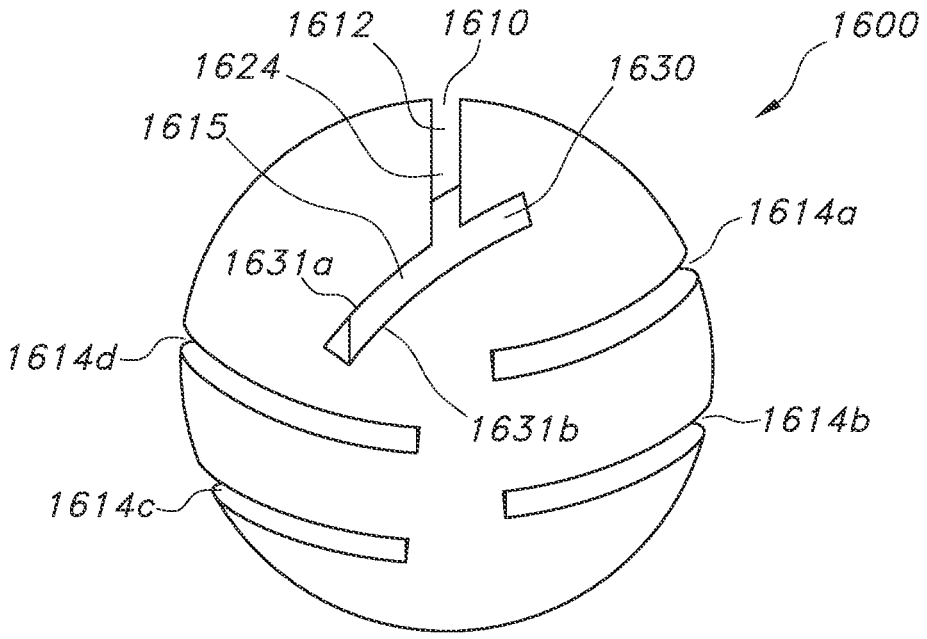
FIGS. 16A and 16B are views of a cord containment adaptor in accordance with an embodiment of the invention.
Figure 16B:
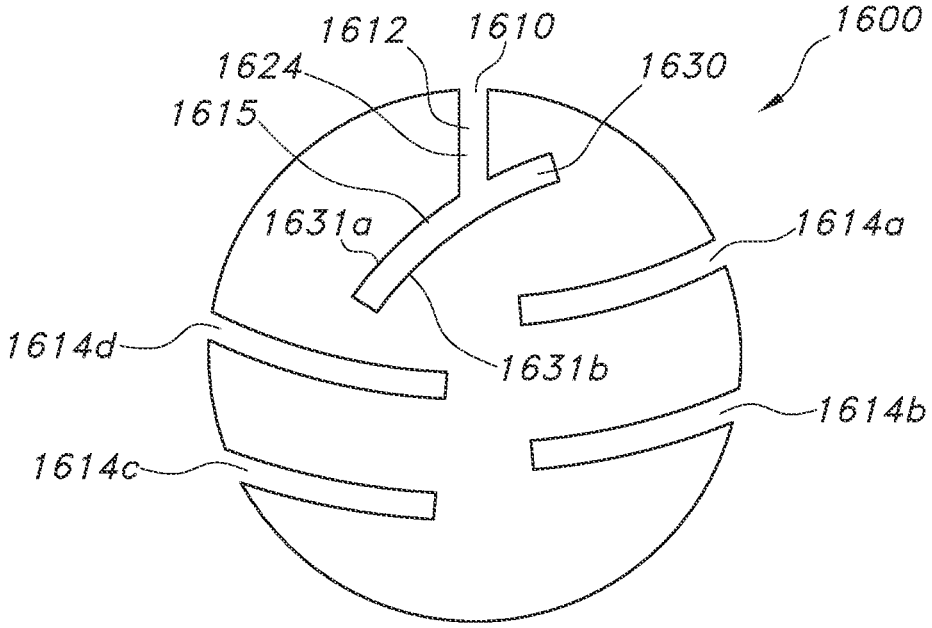

Referring to FIGS. 16A (a perspective view) and FIG. 16B (a front view), an embodiment of a cord containment adaptor 1600 is illustrated and is constructed in the same general manner as the cord containment adaptor 800 discussed in connection with FIGS. 8A-8C, which has a section of the entrapment chamber of the anchor slot slanting downward away from the cord conduit that opens into the entrapment chamber. The cord containment adaptor 1600 additionally has an entrapment chamber that slants downward and away and that has concentric curved walls that grip or compress an earphone cord placed therebetween. Like the cord containment adaptor 800, the cord containment adaptor 1600 is operative to be fixed on cords of an earphone set that have a flat or ribbon type profile or cross section. The cord containment adaptor 1600 is illustrated as a rigid adaptor with a rigid anchor slot 1610 and cord containment slots 1614*a*, 1614*b*, 1614*c*, and 1614*d* that extend all the way through the cord containment adaptor. The anchor slot 1610 has an anchor slot entrance 1612, a cord conduit 1624, and an entrapment chamber 1630. The configuration or orientation of the entrapment chamber 1630 is transverse and slanted with respect to the cord conduit 1624.

The entrapment chamber 1630 has a section 1615 that curves or slants downward away in a curve from the anchor slot entrance 1612 and curves away from the connection point of the cord conduit 1624 with the entrapment chamber

1630. This slanted-curved connection structure of the entrapment chamber 1630 and cord conduit 1624 is a feature that enables a flat or ribbon profile cord to be accommodated and positioned in an entrapment chamber of the rigid anchor slot of the cord containment adaptor 1600. The curved connection structure provides a cord path with an increasing angle away from the path of the cord conduit orientation or structure and thereby aids in facilitating the insertion of a flat profile earphone cord into an entrapment chamber, when the walls of the connected cord conduit and entrapment chamber are narrow enough to grip or compress an earphone cord. The sidewall 1631*a* of the earphone cord entrapment chamber 1630 that slants or curves downward away from the sidewalls of the earphone cord conduit 1624 is concentric with the sidewall 1631*b* of the entrapment chamber 1630. The opposing sidewalls 1631*a* and 1631*b* or opposing sides of the entrapment chamber 1630 are concentric and compress or grip a ribbon cord positioned therebetween. The curved structure of the arched sidewalls will bend the ribbon cord placed therebetween which further provides resistance to help retain a ribbon cord in the entrapment chamber or anchor slot. Although the length of the width of the section of the entrapment chamber 1630 on one side of the cord conduit 1624 is illustrated as being shorter than the length of the width of the section of the entrapment chamber on the other side of the cord conduit 1624, the illustrated shorter section can be constructed to be equal to or longer than the other section. Although not illustrated, the arched sections of an arched entrapment chamber on either side of the cord conduit that opens into the arched entrapment chamber can be of equal lengths and equally convex with respect to a cord conduit. For example, each side of the arched entrapment chamber can slant downward away from the connection point of the cord conduit into the arched entrapment chamber rather than as illustrated in FIGS. 16A and 16B where one section on one side slants upward and away and one side slants downward and away from the cord conduit 1624. It should be appreciated that other entrapment chambers discussed in association with the various other embodiments herein may also be constructed as arched entrapment chambers. It should be appreciated that cord conduits and pathways connecting to entrapment chambers can be arched or curved. The cord containment slots 1614*a*, 1614*b*, 1614*c*, and 1614*d* are curved quick release slots and are configured to grip or compress the thickness of a ribbon earphone cord and similarly bend a ribbon cord inserted therebetween to provide another element of resistance that can aid in keeping a ribbon type cord within the designated slot. The opposing-arched sidewalls of each of the cord containment slots 1614*a*, 1614*b*, 1614*c*, and 1614*d* are concentric.

Figure 17:
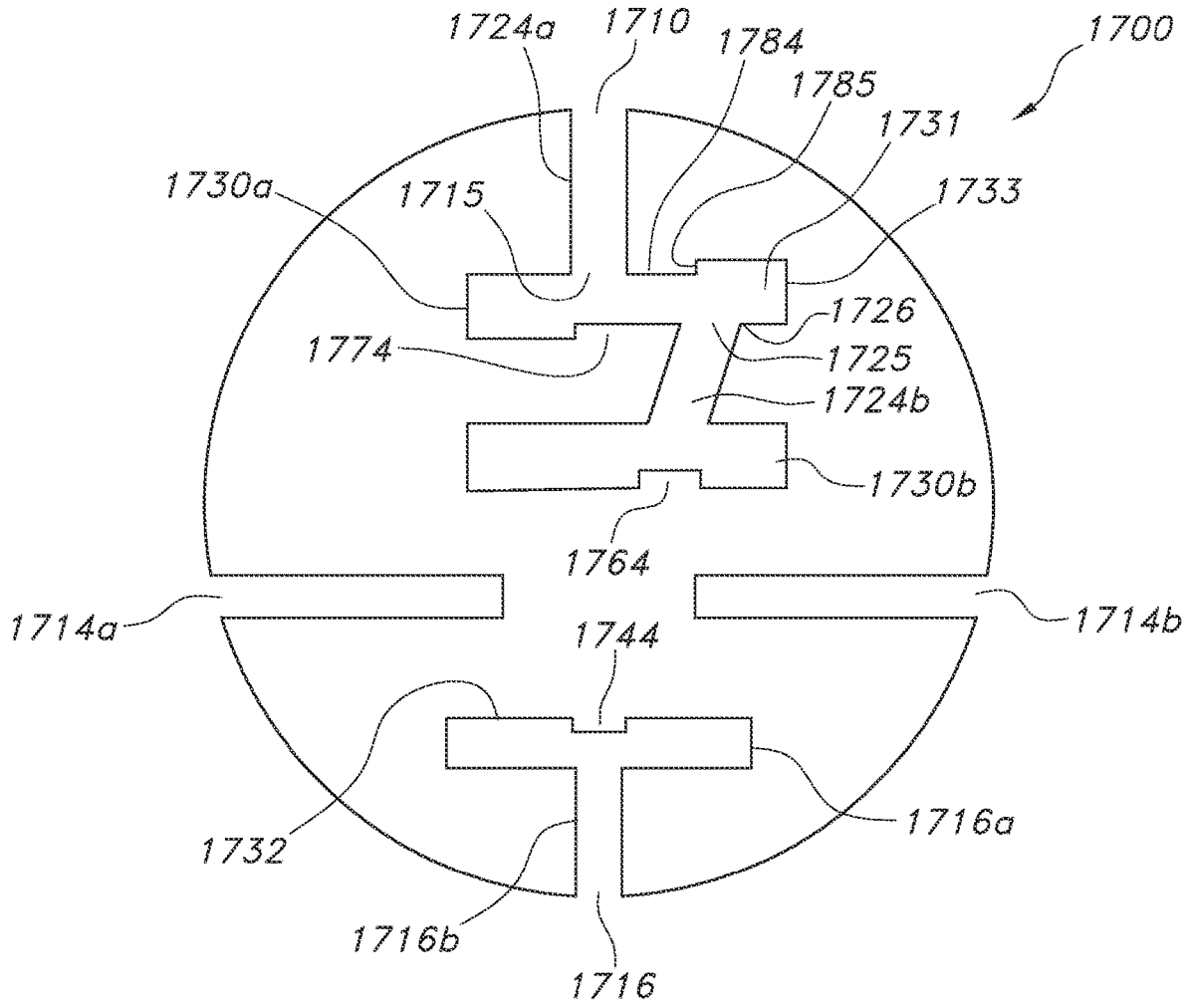
FIG. 17 is a view of a cord containment adaptor in accordance with an embodiment of the invention.

Referring to FIG. 17, a front view of another embodiment of a cord containment adaptor is illustrated. The cord containment adaptor 1700 is spherical and is constructed in the same general manner as the cord containment adaptor 300 and 1400. The cord containment adaptor 1700 has an anchor slot 1710 and cord containment slots 1714*a*, 1714*b*, and 1716. The anchor slot 1710 has entrapment chambers 1730*a* and 1730*b* and cord conduits 1724*a* and 1724*b*. The illustrated slots extend all the way through the adaptor from one open-ended side to the open-ended side on the opposite side of the adaptor in a manner that mirrors the openings shown, like discussed in association with the other cord containment adaptors illustrated herein. The cord containment slot 1716 has a single entrapment chamber 1716*a* and a cord conduit 1716*b*, similar to the cord containment slot 316. Like discussed in connection with FIG. 14, the cord containment slot 1716 includes a ridge 1744 positioned within the earphone cord entrapment chamber 1716*a*. Similarly, the ridges 1764, 1774, and 1784 are structured in the same manner as the ridges 1464, 1474, and 1484, respectively within the corresponding entrapment chambers and slots and provide the same functional and structural advantages as discussed in connection with adaptor 1400. Additionally, the cord conduit 1724*b* is shown to extend and slant at a non-perpendicular angle between and to connect the two entrapment chambers 1730*a* and 1730*b*. In FIG. 17, the cord conduit 1724*b* slants toward an expanded section 1731 of the bi-level chamber 1730*a* and to an area of the entrapment chamber in which the edge 1785 of the ridge 1784 is positioned between the area and the opening 1715 of the cord conduct 1724*a*. The expanded section 1731 has a greater depth between the edge 1785 of ridge 1784 and the end 1733 of the entrapment chamber 1730*a* than the depth of the chamber between the edge 1785 of the ridge and opening 1715 of the cord conduit 1724*a*. By slanting the cord conduit 1724*a* toward the expanded section 1731, a cord proceeding from the entrapment chamber 1730*b* to the entrapment chamber 1730*a* is funneled or directed to the expanded section 1731 and is directed to be positioned within the expanded section 1731 when the cord exits the opening 1725 of the cord conduit 1724*b*. The expanded section 1731 is located at one end of the entrapment chamber 1730*a*.

As illustrated, the majority of or all of the width of the opening 1725 is positioned closer to the end 1733 of the entrapment chamber 1730*a* than the edge 1785 of ridge 1784 is to the end 1733 of the entrapment chamber 1730*a*. Likewise, at least one edge 1726 of the width of the opening 1725 is positioned closer to the end 1733 of the entrapment chamber than the ridge 1784 is to the end 1733 of the entrapment chamber 1730*a* which helps funnel a cord to the expanded section 1731. In an embodiment, the ridge 1784 or edge 1785 can be positioned directly across from the opening 1725 where the edge 1726 of the opening 1725 is closer to the end 1733. Positioning the edge 1726 of the opening 1725 to be closer to the end 1733 of the entrapment chamber than the ridge 1784 is to the end 1733 by a distance greater than or equal to half of the width of an earphone cord to be used in the adaptor can help ensure that the cord slides or gravitates toward the expanded section 1731 or end 1733 of the entrapment chamber. This differential in distance between the ridge 1784 to the end 1733 in relation to the edge 1726 to the end 1733 in most cases would be at least 0.5 mm. It should be appreciated that both edges defining the opening 1725 into the entrapment chamber 1730*a* can be closer to the end 1733 than the edge 1785 of the ridge 1784 to the end 1733. Similarly, the edge 1785 can be closer to either edge of the opening 1715 of the cord conduit 1724*a* along the width of the entrapment chamber 1730*a* than either edge of the opening 1725 is to either edge of the opening 1715. Likewise, the entire width of the ridge 1784 can be positioned to be entirely between the edges or boundaries of the openings 1715 and 1725 that are closest to each other.

The funneling of the cord to the side of the ridge 1784 toward the end 1733 of the entrapment chamber 1730*a* and away from the opening 1715 of the cord conduit 1724*a* adds an impediment for a cord to overcome before a cord is able to move to the opening 1715 leading to the entrance/exit of the anchor slot 1710. With the edge 1785 being positioned closer to the opening 1715 of the cord conduit 1724*a* than both edges of the opening 1725, a cord more easily funnels to a position within the entrapment chamber 1730*a* that creates an impediment for a cord to inadvertently exit the anchor slot. A ridge or ridge edge can be advantageously positioned at various locations along either of the widthwise sides of an entrapment chamber between separate openings into or out of the entrapment chamber to provide the structure, function and advantages discussed herein to prevent the inadvertent dislodgement of an earphone cord from an entrapment chamber or anchor slot.

The various inventive aspects of anchor slots discussed herein may be utilized to hold identifying objects or cord attachments on an earphone cord, of which a cord containment adaptor can be. For example, when a first earphone set contains a cord containment adaptor that has a spherical shape and another earphone set has a cord containment adaptor that has a rectangular cuboid shape, the earphones can be easily identified by the owner of each earphone set by the shape of the cord containment adaptor attached to the cord segment of the earphone set. Identifying indicia or features can be printed, cut, molded or engraved on or in an object or be included to form a feature of the object so as to distinguish the adaptor from other adaptors. Another identifying feature could be the configurations of slots on a first adaptor that is different than the configuration of slots on another adaptor. It should be appreciated that an adaptor embodying an anchor slot constructed in accordance with an aspect of the invention may not have additional slots separate and apart from the anchor slot and can serve as an identifier adaptor by including the various identifying features, for example, as discussed herein. Colors, printed or engraved shapes, text or other symbols can be used as identifiers on adaptors or other rigid bodied objects containing rigid anchor slots as discussed herein. Rigid body anchor slot cord attachment or identifier devices or objects that are attachable to and removeable from cord segments from earphone cord segments are advantageous to earphone set users to identify or distinguish the users' individual earphone sets from others. It should be appreciated that an adaptor embodying an anchor slot constructed in accordance with an aspect of the invention may not have additional slots separate and apart from the anchor slot and will serve as an identifier adaptor by including the selected identifying features, for example, as discussed herein.

The foregoing descriptions have been illustrative of various embodiments that aid in preventing earphone cords from becoming entangled when stored. Embodiments of the cord containment elements are attachable near the end of an earphone cord segment and are selectively removeable by hand. Embodiments of cord containment adaptors can be retrofitted to earphones without physically altering or removing components of the earphones or cords. Embodiments of cord containment adaptors constructed in accordance with teachings herein provide a cord containment structure that can be securely positioned on a set of earphones for cord containment and are selectively detachable and yet are not easily dislodged during use of the headphones nor during storage of the headphones.

The components and casing of cord containment adaptor embodiments may be produced via various manufacturing techniques, such as casting, molding, assembly, forming, machining, joining, additive manufacturing, or other suitable manufacturing processes. The cord containment slots shown in adaptors as discussed herein may be produced as part of an initial manufacturing process of cord containment adaptor or can be cut, punched, stamped, carved, adhered, or the like into a cord containment adaptor after initial production of components. A cord containment shell or cover can be affixed to structures by varying ways, including, for example, over-molding, adhesive, bonding, and inter-locking tongue and grooves. Although slots are shown with the sidewalls being below the outer surface area of larger outer surface area of the cord containment adaptor, the sidewalls of a slot of a cord containment element may extend up or above the general or larger outer surface area of the cord containment adaptor that is near the base of the slot.

Various types of earphones, as well as cords, may be used in connection with various embodiments of the inventions. The diameter or cross-sectional shape or dimension of a channel, slot, or cord outlet can be sized to accommodate the various cross-sectional sizes, shapes or diameters of cords. Embodiments herein may be used with a variety of cords. It should be appreciated that various embodiments herein may be used on cord segments of wireless earphones that do not have a plug but instead have only earpieces that are tethered together by a rounded or ribbon type earphone cord.

Those skilled in the art will appreciate that embodiments may provide one or more advantages or features, and not all embodiments necessarily provide all advantages or features as set forth here. Additionally, it will be apparent to those skilled in the art that various modifications or variations can be made to the structures, configurations, and methodologies referenced herein. Some aspects of various embodiments may be combined with other embodiments and variations may be made in or to the specific illustrated embodiments without departing from the scope of the embodiments or inventions discussed herein. What follows is a listing of claim sets focusing on one or more aspects of the different embodiments described herein.

The invention claimed is:

1. A cord containment adaptor structured to be secured to and removed from a rounded earphone cord segment of an assembled earphone set via an anchor slot and having cord containment slots structured to contain earphone cord segments, comprising:

an external surface or surfaces defining the exterior surface of the body of the cord containment adaptor;

an anchor slot defined along the exterior surface of and extending into the body of the cord containment adaptor; wherein sidewalls of the anchor slot are rigid and delineate passageways through which an earphone cord can pass and are gapped apart to receive and compress an earphone cord segment between opposing sidewalls; wherein the anchor slot has an anchor slot first open side and an anchor slot second open side, each open side opening on the exterior surface of the body of the cord containment adaptor; and wherein the anchor slot has an anchor slot entrance opening and extending along the exterior surface of the body of the cord containment adaptor to receive an earphone cord segment into the anchor slot and defined between and through the anchor slot first open side and the anchor slot second open side;

the anchor slot having a plurality earphone cord entrapment chambers and having a plurality of earphone cord conduits, wherein each earphone cord entrapment chamber and each earphone cord conduit extend between and open into the anchor slot first open side and anchor slot second open side;

wherein each earphone cord entrapment chamber comprises a chamber having a first pair of chamber sides and second pair of chamber sides that define interior boundaries of the earphone cord entrapment chamber; and wherein the first pair of chamber sides are positioned between the second pair of chamber sides; and wherein the first pair of chamber sides are positioned to receive and compress an earphone cord segment between the first pair of chamber sides and delineate a passageway through which an earphone cord can pass;

wherein each earphone cord conduit is defined by rigid gapped apart conduit opposing sides that are positioned to receive and compress and earphone cord segment and that delineate a passageway through which an earphone cord can pass; wherein the ends of the conduit opposing sides terminate at conduit entrance open ends through which and earphone cord can pass;

wherein a first earphone cord conduit extends from the anchor slot entrance to a first earphone cord entrapment chamber;

wherein a first conduit entrance open end of the first earphone cord conduit opens into a first side of the first pair of chamber sides of the first earphone cord entrapment chamber and defines a first conduit-first entrapment chamber opening;

a second earphone cord entrapment chamber and a second earphone cord conduit;

wherein the second earphone cord conduit extends from a first side of the first pair of chamber sides of the second earphone cord entrapment chamber to a second side of the first pair of chamber sides of the first earphone cord entrapment chamber;

wherein a first conduit entrance open end of the second earphone cord conduit opens into the second side of the first pair of chamber sides of the first earphone cord entrapment chamber and defines a second conduit-first entrapment chamber opening;

wherein a second conduit entrance open end of the second earphone cord conduit opens into the first side of the first pair of chamber sides of the second earphone cord entrapment chamber and defines a second conduit-second entrapment chamber opening; and wherein at least part of the second conduit-first chamber opening is offset from the first conduit-first chamber opening along the width of the first earphone cord entrapment chamber to a first offset side of the first conduit-first chamber opening; and wherein a first ridge edge of a first ridge is positioned to the first offset side within the first earphone cord entrapment chamber and on the first side of the first pair of chamber sides of the first earphone cord entrapment chamber between the first conduit-first chamber opening and at least one boundary of the second conduit-first chamber opening.

2. The adaptor of claim 1 wherein the first ridge edge is located directly across from the second conduit-first chamber opening.

3. The cord containment adaptor of claim 1 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber;

wherein the first ridge edge defines a boundary between the first narrow section and the first expanded section; and wherein the second earphone cord conduit extends from the second earphone cord entrapment chamber to the first expanded section of the first earphone cord entrapment chamber.

4. The cord containment adaptor of claim 1 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber;

wherein the first ridge edge defines a boundary between the first narrow section and the first expanded section; and wherein the second earphone cord conduit slants from the second earphone cord entrapment chamber towards the first expanded section of the first earphone cord entrapment chamber.

5. The cord containment adaptor of claim 1 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber;

wherein the first ridge edge defines a boundary between the first narrow section and the first expanded section; and wherein the second earphone cord conduit slants from the second earphone cord entrapment chamber and provides a funnel to the first expanded section of the first earphone cord entrapment chamber.

6. The cord containment adaptor of claim 1 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber; and wherein the first ridge edge defines a boundary between the first narrow section and first expanded section; and wherein the first ridge edge is located directly across from the second conduit-first chamber opening of the first earphone cord entrapment chamber.

7. The cord containment adaptor of claim 1 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber, and wherein the first expanded section is adjacent to the first narrow section;

wherein the distance between a first side and a second side of the first pair of chamber sides is shorter in a second narrow section of the first earphone cord entrapment chamber than the distance between the first side and the second side of the first pair of chamber sides in a second expanded section of the first earphone cord entrapment chamber, and wherein the second expanded section is adjacent to the second narrow section;

wherein the first cord conduit-first chamber opening is located between the first expanded section and the second expanded section; and wherein the second earphone cord conduit extends from the second earphone cord entrapment chamber to the first expanded section of the first earphone cord entrapment chamber.

8. The cord containment adaptor of claim 7 wherein a second ridge is located on the second side of the first pair of chamber sides of the first earphone cord entrapment chamber and directly across from the first conduit-first chamber opening.

9. The cord containment adaptor of claim 8 wherein a second ridge is located on the second side of the first pair of chamber sides of the second earphone cord entrapment chamber and directly across from the second conduit-second chamber opening.

10. A cord containment adaptor structured to be secured to and removed from a rounded earphone cord segment of an assembled earphone set via an anchor slot and having cord containment slots structured to contain earphone cord segments, comprising:

an external surface or surfaces defining the exterior surface of the body of the cord containment adaptor;

an anchor slot defined along the exterior surface of and extending into the body of the cord containment adaptor; wherein sidewalls of the anchor slot are rigid and delineate passageways through which an earphone cord can pass and are gapped apart to receive and compress an earphone cord segment between opposing sidewalls; wherein the anchor slot has an anchor slot first open side and an anchor slot second open side, each open side opening on the exterior surface of the body of the cord containment adaptor; and wherein the anchor slot has an anchor slot entrance opening and extending along the exterior surface of the body of the cord containment adaptor to receive an earphone cord segment into the anchor slot and defined between and through the anchor slot first open side and the anchor slot second open side;

the anchor slot having a plurality earphone cord entrapment chambers and having a plurality of earphone cord conduits, wherein each earphone cord entrapment chamber and each earphone cord conduit extend between and open into the anchor slot first open side and anchor slot second open side;

wherein each earphone cord entrapment chamber comprises a chamber having a first pair of chamber sides and second pair of chamber sides that define interior boundaries of the earphone cord entrapment chamber; and wherein the first pair of chamber sides are positioned between the second pair of chamber sides; and wherein the first pair of chamber sides are positioned to receive and compress an earphone cord segment between the first pair of chamber sides and delineate a passageway through which an earphone cord can pass;

wherein each earphone cord conduit is defined by rigid gapped apart conduit opposing sides that are positioned to receive and compress and earphone cord segment and that delineate a passageway through which an earphone cord can pass; wherein the ends of the conduit opposing sides terminate at conduit entrance open ends through which and earphone cord can pass;

wherein a first earphone cord conduit extends from the anchor slot entrance to a first earphone cord entrapment chamber;

wherein a first conduit entrance open end of the first earphone cord conduit opens into a first side of the first pair of chamber sides of the first earphone cord entrapment chamber and defines a first conduit-first entrapment chamber opening;

a second earphone cord entrapment chamber and a second earphone cord conduit;

wherein the second earphone cord conduit extends from a first side of the first pair of chamber sides of the second earphone cord entrapment chamber to a second side of the first pair of chamber sides of the first earphone cord entrapment chamber;

wherein a first conduit entrance open end of the second earphone cord conduit opens into the second side of the first pair of chamber sides of the first earphone cord entrapment chamber and defines a second conduit-first entrapment chamber opening;

wherein a second conduit entrance open end of the second earphone cord conduit opens into the first side of the first pair of chamber sides of the second earphone cord entrapment chamber and defines a second conduit-second entrapment chamber opening; and wherein each boundary of the second conduit-first chamber opening is offset from the first conduit-first chamber opening along the width of the first earphone cord entrapment chamber to a first offset side of the first conduit-first chamber opening; and wherein a first ridge edge of a first ridge is positioned to the first offset side within the first earphone cord entrapment chamber and on the first side of the first pair of chamber sides of the first earphone cord entrapment chamber between the first conduit-first chamber opening and at least one boundary of the second conduit-first chamber opening.

11. The cord containment adaptor of claim 10 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber;

wherein the first ridge edge defines a boundary between the first narrow section and the first expanded section; and wherein the second earphone cord conduit extends from the second earphone cord entrapment chamber to the first expanded section of the first earphone cord entrapment chamber.

12. The cord containment adaptor of claim 10 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber;

wherein the first ridge edge defines a boundary between the first narrow section and the first expanded section; and wherein the second earphone cord conduit slants from the second earphone cord entrapment chamber and provides a funnel to the first expanded section of the first earphone cord entrapment chamber.

13. The cord containment adaptor of claim 10 wherein the distance between a first side and a second side of the first pair of chamber sides is shorter in a first narrow section of the first earphone cord entrapment chamber than the distance between the first side and the second side of the first pair of chamber sides in a first expanded section of the first earphone cord entrapment chamber, and wherein the first expanded section is adjacent to the first narrow section;

wherein the distance between a first side and a second side of the first pair of chamber sides is shorter in a second narrow section of the first earphone cord entrapment chamber than the distance between the first side and the second side of the first pair of chamber sides in a second expanded section of the first earphone cord entrapment chamber, and wherein the second expanded section is adjacent to the second narrow section;

wherein the first cord conduit-first chamber opening is located between the first expanded section and the second expanded section; and wherein the second earphone cord conduit extends from the second earphone cord entrapment chamber to the first expanded section of the first earphone cord entrapment chamber.

14. A cord containment adaptor structured to be secured to and removed from a rounded earphone cord segment of an assembled earphone set via an anchor slot and having cord containment slots structured to contain earphone cord segments, comprising:

an external surface or surfaces defining the exterior surface of the body of the cord containment adaptor;

an anchor slot defined along the exterior surface of and extending into the body of the cord containment adaptor; wherein sidewalls of the anchor slot are rigid and delineate passageways through which an earphone cord can pass and are gapped apart to receive and compress an earphone cord segment between opposing sidewalls; wherein the anchor slot has an anchor slot first open side and an anchor slot second open side, each open side opening on the exterior surface of the body of the cord containment adaptor; and wherein the anchor slot has an anchor slot entrance opening and extending along the exterior surface of the body of the cord containment adaptor to receive an earphone cord segment into the anchor slot and defined between and through the anchor slot first open side and the anchor slot second open side;

the anchor slot having a plurality earphone cord entrapment chambers and having a plurality of earphone cord conduits, wherein each earphone cord entrapment chamber and each earphone cord conduit extend between and open into the anchor slot first open side and anchor slot second open side;

wherein each earphone cord entrapment chamber comprises a chamber having a first pair of chamber sides and second pair of chamber sides that define interior boundaries of the earphone cord entrapment chamber; and wherein the first pair of chamber sides are positioned between the second pair of chamber sides; and wherein the first pair of chamber sides are positioned to receive and compress an earphone cord segment between the first pair of chamber sides and delineate a passageway through which an earphone cord can pass;

wherein each earphone cord conduit is defined by rigid gapped apart conduit opposing sides that are positioned to receive and compress and earphone cord segment and that delineate a passageway through which an earphone cord can pass; wherein the ends of the conduit opposing sides terminate at conduit entrance open ends through which and earphone cord can pass;

wherein a first earphone cord conduit extends from the anchor slot entrance to a first earphone cord entrapment chamber;

wherein a first conduit entrance open end of the first earphone cord conduit opens into a first side of the first pair of chamber sides of the first earphone cord entrapment chamber and defines a first conduit-first entrapment chamber opening;

a second earphone cord entrapment chamber and a second earphone cord conduit;

wherein the second earphone cord conduit extends from a first side of the first pair of chamber sides of the second earphone cord entrapment chamber to a second side of the first pair of chamber sides of the first earphone cord entrapment chamber;

wherein a first conduit entrance open end of the second earphone cord conduit opens into the second side of the first pair of chamber sides of the first earphone cord entrapment chamber and defines a second conduit-first entrapment chamber opening;

wherein a second conduit entrance open end of the second earphone cord conduit opens into the first side of the first pair of chamber sides of the second earphone cord entrapment chamber and defines a second conduit-second entrapment chamber opening; and wherein a first earphone cord pathway extends from the second cord conduit to the anchor slot entrance and is defined through the sides of the first earphone cord entrapment chamber and first earphone cord conduit; and wherein at least a first part of a first ridge is positioned between the second conduit-first chamber opening and the anchor slot entrance along the first earphone cord pathway on one of the sides of the first earphone cord entrapment chamber or first earphone cord conduit.

15. The cord containment adaptor of claim 14 wherein the first part of the first ridge is located on the second side of the first pair of chamber sides of the first earphone cord entrapment chamber directly across from the first conduit-first chamber opening that opens into the first side of first pair of chamber sides of the first earphone cord entrapment chamber.

16. The cord containment adaptor of claim 15 wherein a first part of a second ridge is located on the second side of the first pair of chamber sides of the second earphone cord entrapment chamber.

17. The cord containment adaptor of claim 14 wherein a first part of a second ridge is located on the first side of the first pair of chamber sides of the first earphone cord entrapment chamber.

18. The cord containment adaptor of claim 17 where a part of a third ridge is located on the second side of the first pair of chamber sides of the second earphone cord entrapment chamber directly across from the second conduit-second chamber opening that opens into the second earphone cord entrapment chamber.

* * * * *